US009423720B2

(12) United States Patent
Hosokawa et al.

(10) Patent No.: US 9,423,720 B2
(45) Date of Patent: Aug. 23, 2016

(54) POWDER CONTAINER AND IMAGE FORMING APPARATUS

(71) Applicants: Hiroshi Hosokawa, Kanagawa (JP); Shunji Katoh, Kanagawa (JP)

(72) Inventors: Hiroshi Hosokawa, Kanagawa (JP); Shunji Katoh, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/773,934

(22) PCT Filed: Mar. 14, 2014

(86) PCT No.: PCT/JP2014/057941

§ 371 (c)(1),
(2) Date: Sep. 9, 2015

(87) PCT Pub. No.: WO2014/142361

PCT Pub. Date: Sep. 18, 2014

(65) Prior Publication Data

US 2016/0018758 A1 Jan. 21, 2016

(30) Foreign Application Priority Data

Mar. 15, 2013 (JP) ..... 2013-053806
Mar. 15, 2013 (JP) ..... 2013-054089
Jan. 9, 2014 (JP) ..... 2014-002539

(51) Int. Cl.
*G03G 15/08* (2006.01)

(52) U.S. Cl.
CPC ..... *G03G 15/0843* (2013.01); *G03G 15/0884* (2013.01); *G03G 15/0865* (2013.01);

(Continued)

(58) Field of Classification Search
CPC ..... G03G 15/0843; G03G 15/0884; G03G 2215/069
USPC ..... 399/106, 262
See application file for complete search history.

(56) References Cited

U.S. PATENT DOCUMENTS 5,495,323 A 2/1996 Meetze, Jr.
5,613,177 A 3/1997 Meetze, Jr. et al.

(Continued)

FOREIGN PATENT DOCUMENTS

EP 1 193 570 A2 4/2002
JP 5-46023 2/1993

(Continued)

OTHER PUBLICATIONS

International Search Report issued Jun. 17, 2014 in PCT/JP2014/057941 filed Mar. 14, 2014.

(Continued)

*Primary Examiner* — Benjamin Schmitt
(74) *Attorney, Agent, or Firm* — Oblon, McClelland, Maier & Neustadt, L.L.P.

(57) ABSTRACT

A toner container which is a powder container includes a container body that stores toner which is powder; a nozzle receiver having a nozzle insertion opening which is a nozzle insertion opening through which a powder conveying nozzle of a powder conveying device is inserted in the container body; and an elastic sheet which is an elastic sheet member that blocks the nozzle insertion opening and is elastically deformed so that the powder conveying nozzle can pass through when the powder conveying nozzle is inserted. A plurality of elastic sheets is arranged so as to overlap at least partially.

18 Claims, 28 Drawing Sheets

(52) U.S. Cl.
CPC .... *G03G15/0872* (2013.01); *G03G 2215/0132* (2013.01); *G03G 2215/069* (2013.01); *G03G 2215/0678* (2013.01)

(56) References Cited

U.S. PATENT DOCUMENTS

| | | | | |
|---|---|---|---|---|
| 2001/0021326 | A1 | 9/2001 | Yanagisawa et al. | |
| 2002/0106215 | A1 | 8/2002 | Ban et al. | |
| 2002/0114646 | A1 | 8/2002 | Sudo et al. | |
| 2002/0122104 | A1* | 9/2002 | Hatasa | B41J 2/17523 347/86 |
| 2003/0116923 | A1 | 6/2003 | Meetze, Jr. et al. | |
| 2003/0170049 | A1 | 9/2003 | Itoh et al. | |
| 2004/0197119 | A1* | 10/2004 | Matsumoto | G03G 15/0898 399/258 |
| 2004/0223790 | A1 | 11/2004 | Hosokawa et al. | |
| 2006/0193659 | A1 | 8/2006 | Tanda | |
| 2007/0077100 | A1 | 4/2007 | Suzuki et al. | |
| 2008/0286013 | A1 | 11/2008 | Hosokawa et al. | |
| 2009/0175660 | A1 | 7/2009 | Hosokawa et al. | |
| 2012/0099902 | A1 | 4/2012 | Yoshida et al. | |
| 2012/0213555 | A1* | 8/2012 | Komatsu | G03G 15/087 399/262 |
| 2013/0272750 | A1 | 10/2013 | Matsumoto et al. | |

FOREIGN PATENT DOCUMENTS

| | | |
|---|---|---|
| JP | 6-329102 | 11/1994 |
| JP | 7-261492 | 10/1995 |
| JP | 9-197818 | 7/1997 |
| JP | 2001-201926 | 7/2001 |
| JP | 2002-202656 | 7/2002 |
| JP | 2003-195616 | 7/2003 |
| JP | 2003-233247 | 8/2003 |
| JP | 2003-241496 | 8/2003 |
| JP | 2004-198765 | 7/2004 |
| JP | 2005-221825 | 8/2005 |
| JP | 2009-175521 | 8/2009 |
| JP | 4342958 | 10/2009 |
| JP | 2009-276659 | 11/2009 |
| JP | 4441581 | 3/2010 |

OTHER PUBLICATIONS

Extended European Search Report issued Feb. 5, 2016 in Patent Application No. 14763610.4.

* cited by examiner (a)

(b)

POWDER CONTAINER AND IMAGE FORMING APPARATUS

TECHNICAL FIELD

The present invention relates to a powder container that stores powder such as toner and an image forming apparatus including the powder container.

BACKGROUND ART

In an image forming apparatus such as a copying machine, a printer, and a facsimile that uses an electrophotographic process, a latent image formed on a photoreceptor is visualized with toner of a developing device. However, since toner is consumed when the latent image is developed, it is necessary to replenish toner into the developing device. Thus, a toner replenishing device as a powder supply device provided in the apparatus body conveys toner from a toner container as a powder container to the developing device to replenish toner into the developing device. With the developing device that replenishes toner in this manner, it is possible to perform developing continuously. Moreover, the toner container can be detachably attached to the toner replenishing device and is replaced with a new toner container having toner stored therein when the toner stored therein runs out.

As an example of a toner container detachably attached to the toner replenishing device, a toner container which includes a toner storing member that forms a storage unit that storing toner therein, and in which a spiral projection serving as a powder conveyor is provided on a cylindrical inner circumferential surface of the toner storing member is known (see Japanese laid-open Patent Application (JP-A) No. 2003-241496, JP-A 2005-221825, Japanese patent No. 4342958, JP-A No. 2002-202656, JP-A No. 2003-233247, JP-A No. 2009-276659, and JP-A No. 07-261492, for example). In such a toner container, when the toner storing member rotates in a state of being attached to the toner replenishing device, the toner stored therein is conveyed from one end side in the rotation axis direction of the toner storing member to the other end side. The toner is delivered from an opening provided on the other end side of the toner storing member toward the main body of the toner replenishing device.

JP-A Nos. 2009-276659 and 07-261492 each disclose a toner container in which toner stored in a storage unit is conveyed from one end side thereof to the other end side when a toner storing member rotates, and in which a conveying nozzle fixed to a toner replenishing device is inserted from an opening on the other end side of the toner storing member into the storage unit. A toner inlet is provided near a front end in the insertion direction of the conveying nozzle inserted from the opening of the toner storing member into the storage unit, and the conveying nozzle receives the toner in the toner storing member into the nozzle from the toner inlet in a state of being inserted in the toner container and conveys the toner toward the main body of the toner replenishing device. Moreover, the toner container has a nozzle insertion portion in which a nozzle insertion opening for inserting the conveying nozzle is provided in the opening at the other end of the toner storing member. Further, the toner container includes an opening blocking member that blocks the nozzle insertion opening before the conveying nozzle is inserted and opens the nozzle insertion opening when the conveying nozzle is inserted.

The opening blocking member included in the toner container disclosed in JP-A No. 2009-276659 is a shutter member that can slide in the nozzle insertion path provided in the toner container, and is biased by a spring from one end side of the nozzle insertion path to the other end side. In this structure, when the shutter member biased by the spring bumps against the vicinity of the nozzle insertion opening until the conveying nozzle is inserted, the nozzle insertion opening maintains a blocked state. Moreover, when the conveying nozzle is inserted, the front end of the conveying nozzle presses the shutter member so that the spring biasing the shutter member is contracted, whereby the shutter member can move from the other end side of the nozzle insertion path to one end side and the conveying nozzle can be inserted into the nozzle insertion path.

However, in the toner container disclosed in JP-A No. 2009-276659, a spring and an insertion path defining portion that supports the spring and forms a nozzle conveying path are required in addition to the shutter member which is an opening blocking member, and the structure that opens and blocks the nozzle insertion opening becomes complex.

On the other hand, the opening blocking member included in the toner container disclosed in JP-A No. 07-261492 is an elastic sheet member which is formed of a sheet-shaped elastic member and has a slit provided so as to penetrate from one surface to the other surface thereof. In the toner container disclosed in JP-A No. 07-261492, when a conveying nozzle is inserted in the slit of the elastic sheet member provided so as to block the nozzle insertion opening, the elastic sheet member is elastically deformed so that the slit is expanded. By expanding the slit in this way, the conveying nozzle can pass through portion of the nozzle insertion opening blocked by the elastic sheet member and the conveying nozzle can be inserted in the nozzle insertion opening. Since the nozzle insertion opening is opened and blocked by elastic deformation of the elastic sheet member, it is possible to simplify the structure of opening and blocking the nozzle insertion opening as compared to the toner container of JP-A No. 2009-276659.

In the toner container disclosed in No. JP-A 07-261492, in a state where the elastic sheet member is not elastically deformed, the slit is blocked and toner leakage can be prevented. However, when vibration or impact is applied to the toner container while conveying before it is attached to the toner replenishing device, vibration or impact may be transmitted to the elastic sheet member which may be temporarily elastically deformed, and a gap may be provided in the slit. When a gap is provided in the slit even if temporarily, toner in the storage unit may pass through the slit in the elastic sheet member. When toner passes through the slit in the elastic sheet member during conveying of the toner container, this can cause toner leakage.

In the foregoing description, the problem occurring in the toner container that stores toner as powder has been described. However, the same problem can occur in a powder container that stores powder different from toner. That is, the same problem can occur if a powder container includes an elastic sheet member that blocks a nozzle insertion opening when a powder conveying nozzle fixed to a powder conveying device is not inserted, and the elastic sheet member is elastically deformed to allow the powder conveying nozzle to pass when the conveying nozzle is inserted.

Therefore, there is a need to provide a powder container that includes an elastic sheet member that blocks a nozzle insertion opening in which a powder conveying nozzle that delivers powder stored therein to the outside and that can suppress leakage of powder in a state where a powder conveying device is not attached thereto, and to provide an image forming apparatus including the powder container.

DISCLOSURE OF INVENTION

It is an object of the present invention to at least partially solve the problems in the conventional technology.

According to an embodiment, there is provided a powder container that includes a container body that stores powder to be supplied to a powder conveying device; a nozzle insertion portion having a nozzle insertion opening through which a powder conveying nozzle of the powder conveying device is inserted into the container body; and an elastic sheet member formed of a plurality of sheet-shaped elastic bodies. The elastic sheet member blocks the nozzle insertion opening in a state where the powder conveying nozzle is not inserted. Inserting the powder conveying nozzle causes the elastic sheet member to elastically deform so that the powder conveying nozzle passes through a blocked portion of the nozzle insertion opening. At least a part of the plurality of elastic bodies is arranged so as to overlap in at least a diametric direction of the nozzle insertion opening in an insertion direction of the powder conveying nozzle.

The above and other objects, features, advantages and technical and industrial significance of this invention will be better understood by reading the following detailed description of presently preferred embodiments of the invention, when considered in connection with the accompanying drawings.

BEST MODE(S) FOR CARRYING OUT THE INVENTION

Figure 1:
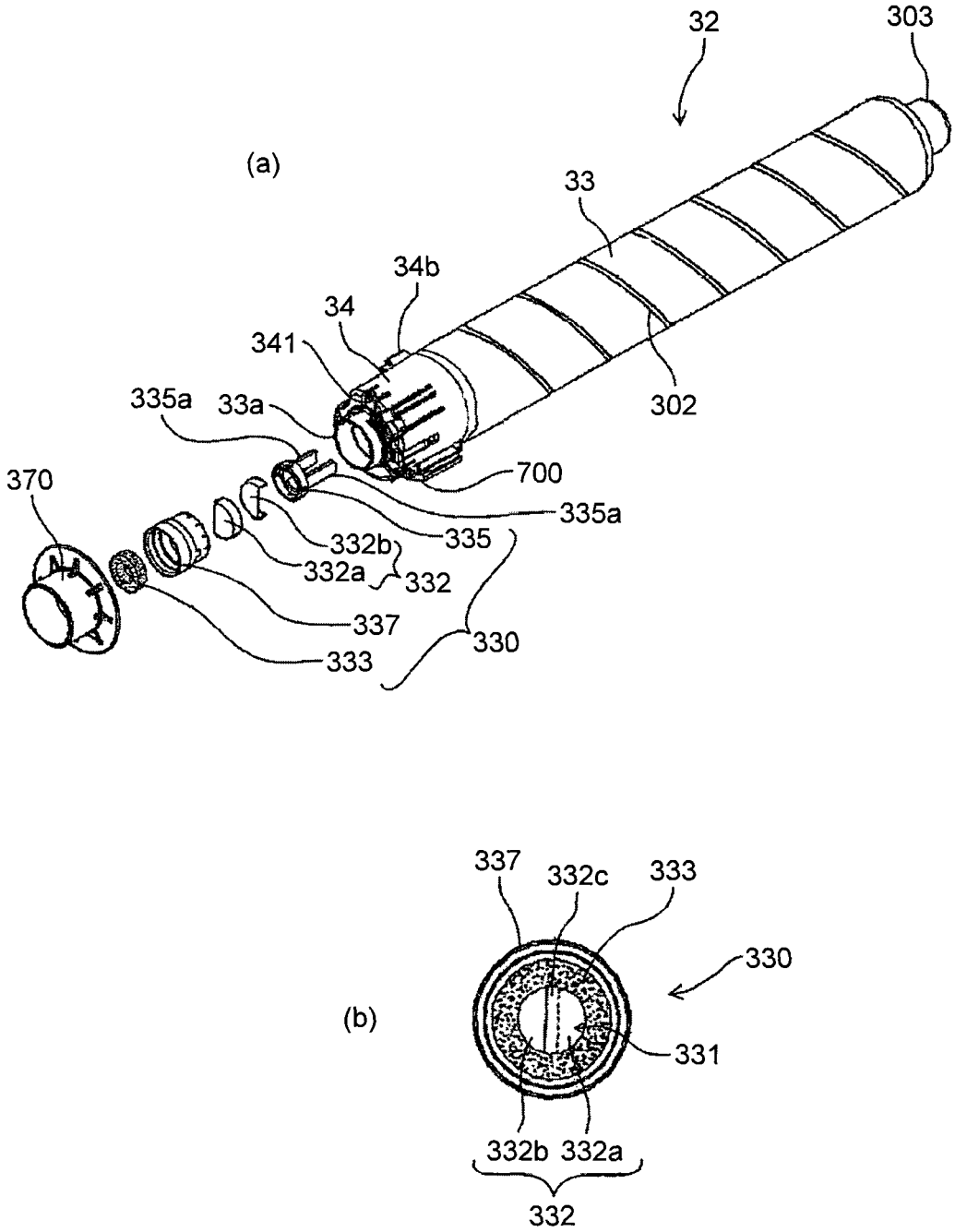
FIG. 1 illustrates a toner container according to a first embodiment, in which (a) is an exploded perspective view of the toner container and (b) is a front view of a nozzle receiver when seen from the other end side.

Hereinafter, a plurality of embodiments of the present invention will be described with reference to the drawings. In the respective embodiments, the same members or members having the same functions will be denoted by the same reference numerals, and the description thereof will not be repeated. The following description is an example and the scope of the claim is not limited thereto. In the drawings, Y, M, C, and K are subscripts attached to constituent members corresponding to the colors yellow, magenta, cyan, and black, and may be omitted appropriately.

First Embodiment

First, a configuration of a first embodiment of the present invention in which the present invention is applied to a copying machine (hereinafter referred to as a copying machine 500) as an image forming apparatus will be described.

Figure 2:
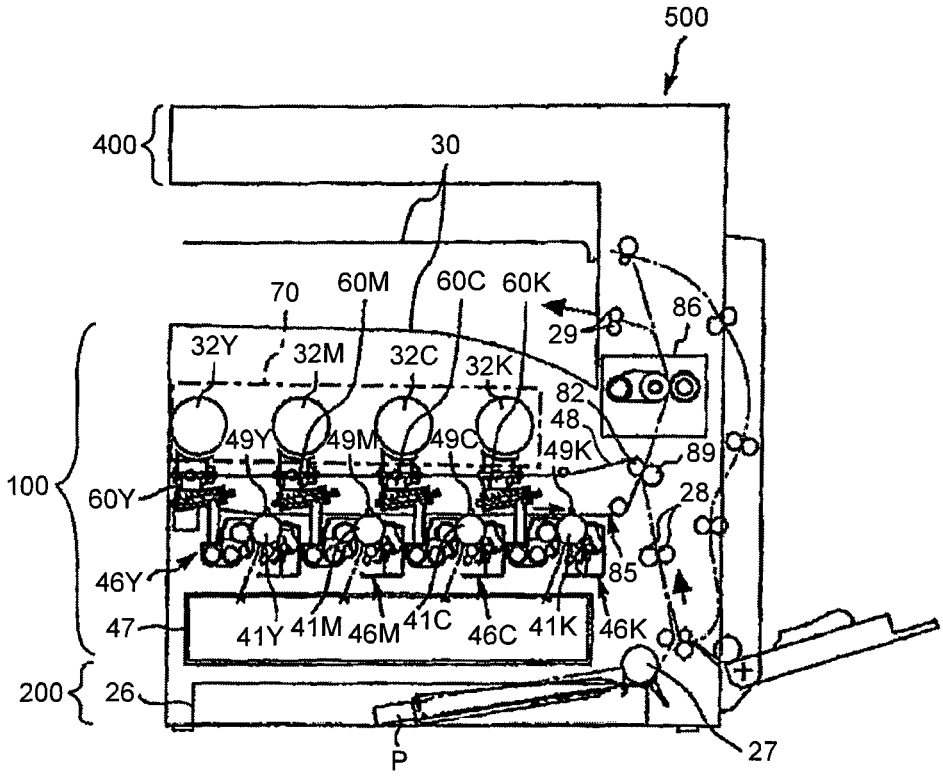
FIG. 2 is a diagram illustrating an entire configuration of a copying machine, common to all embodiments.

FIG. 2 is a diagram illustrating a schematic configuration of the copying machine 500 according to the present embodiment. The copying machine 500 includes a copying machine body (hereinafter referred to as a printer unit 100), a sheet feeding table (hereinafter referred to as a sheet feeding unit 200), and a scanner (hereinafter referred to as a scanner unit 400) attached onto the printer unit 100.

Four toner containers 32 (Y, M, C, and K) as powder containers corresponding to respective colors (yellow, magenta, cyan, and black) are detachably (replaceably) attached to a toner container receiving portion 70 that is provided in an upper part of the printer unit 100. An intermediate transfer unit 85 is arranged below the toner container receiving portion 70.

The intermediate transfer unit 85 includes an intermediate transfer belt 48, four primary transfer bias rollers 49 (Y, M, C, and K), a secondary transfer backup roller 82, a plurality of tension rollers, and an intermediate transfer cleaning device. The intermediate transfer belt 48 is stretched and supported by a plurality of roller members and moves endlessly in the direction indicated by an arrow in FIG. 2 by rotation of the secondary transfer backup roller 82 which is one of the plurality of roller members.

Four image forming units 46 (Y, M, C, and K) corresponding to the respective colors are arranged in parallel in the printer unit 100 so as to face the intermediate transfer belt 48. Moreover, corresponding four toner replenishing devices 60 (Y, M, C, and K) are arranged below the four toner containers 32 (Y, M, C, and K). Moreover, the toner stored in the toner containers 32 (Y, M, C, and K) is supplied (replenished) into developing devices (powder consuming units) of the image forming units 46 (Y, M, C, and K) corresponding to the respective colors by the corresponding toner replenishing devices 60 (Y, M, C, and K).

Moreover, as illustrated in FIG. 2, the printer unit 100 includes an exposure device 47 which is a latent image forming means and which is disposed below the four image forming units 46. The exposure device 47 exposes the surface of a photoreceptor 41 to be described later with light based on image information of a document image read by the scanner unit 400 or image information input from an external device such as a personal computer and forms an electrostatic latent image on the surface of the photoreceptor 41. Although the exposure device 47 included in the printer unit 100 employs a laser beam scanner that uses laser diodes, an exposure means may employ an optional configuration that uses an LED array.

Figure 3:
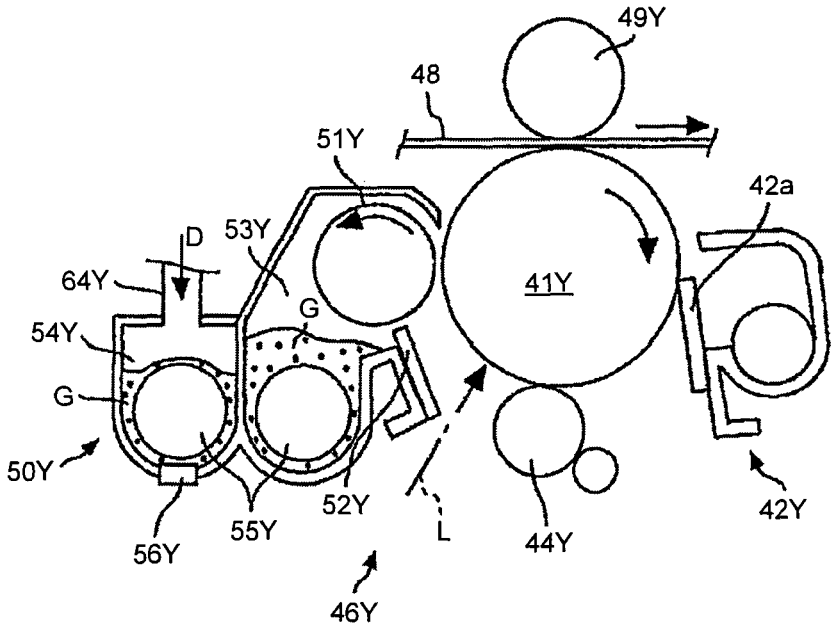
FIG. 3 is a schematic view illustrating an image forming unit of the copying machine.

FIG. 3 is a schematic diagram illustrating a schematic configuration of the image forming unit 46Y corresponding to yellow.

The image forming unit 46Y includes a drum-shaped photoreceptor 41Y which is a latent image carrier. Further, in the image forming unit 46Y, a charging roller 44Y which is a charging means, a developing device 50Y which is a developing means, a photoreceptor cleaning device 42Y, a neutralization device, and the like are arranged around the photoreceptor 41Y. Image forming processes (including charging step, exposure step, developing step, transfer step, and cleaning step) are performed on the photoreceptor 41Y whereby a yellow image is formed on the photoreceptor 41Y.

The other three image forming units 46 (M, C, and K) have approximately the same configuration as the image forming unit 46Y corresponding to yellow except that the colors of toner used are different, and images of the colors corresponding to the respective toner components are formed on the photoreceptors 41 (M, C, and K). Hereinafter, the description of the other three image forming units 46 (M, C, and K) will be omitted appropriately, and the image forming unit 46Y corresponding to yellow only will be described.

The photoreceptor 41Y is rotated in the clockwise direction in FIG. 3 by a driving motor. The surface of the photoreceptor 41Y at the position where the surface faces the charging roller 44Y is uniformly charged (charging step). After that, when the surface of the photoreceptor 41Y reaches an irradiation position where the surface is irradiated with a laser beam L emitted from the exposure device 47, exposure scanning is carried out at this position, and an electrostatic latent image corresponding to yellow is formed on the surface (exposure step). After that, when the surface of the photoreceptor 41Y reaches a position where the surface faces the developing device 50Y, the electrostatic latent image is developed at this position, and a yellow toner image is formed (developing step).

The four primary transfer bias rollers 49 (Y, M, C, and K) of the intermediate transfer unit 85 and the photoreceptors 41 (Y, M, C, and K) form primary transfer nips with the intermediate transfer belt 48 interposed. A transfer bias having a polarity opposite to toner is applied to the primary transfer bias rollers 49 (Y, M, and K).

When the surface of the photoreceptor 41Y on which a toner image is formed in the developing step reaches the primary transfer nip at which the surface faces the primary transfer bias roller 49Y with the intermediate transfer belt 48 interposed, the toner image on the photoreceptor 41Y is transferred to the intermediate transfer belt 48 at the primary transfer nip (primary transfer step). In this case, a very small amount of toner that has not been transferred remains on the photoreceptor 41Y. After the toner image is transferred to the intermediate transfer belt 48 at the primary transfer nip, the surface of the photoreceptor 41Y reaches a position where the surface faces the photoreceptor cleaning device 42Y. At this position, the non-transferred toner remaining on the photoreceptor 41Y is mechanically collected by a cleaning blade 42*a*. Finally, when the surface of the photoreceptor 41Y reaches a position where the surface faces the neutralization device, a residual potential on the photoreceptor 41Y is removed. In this way, a series of image forming processes performed on the photoreceptor 41Y ends.

Such image forming processes are also performed on the other image forming units 46 (M, C, and K) in the same manner as the image forming unit 46Y. That is, a laser beam L based on image information is irradiated from the exposure device 47 arranged below the image forming units 46 (M, C, and K) toward the photoreceptors 41 (M, C, and K) of the respective image forming units 46 (M, C, and K). Specifically, the exposure device 47 emits a laser beam L from a light source so as to be radiated onto the respective photoreceptors 41 (M, C, and K) with a plurality of optical elements while scanning the laser beam L with a rotating polygon mirror. After that, a developing step is performed, and the toner images of the respective colors formed on the respective photoreceptors 41 (M, C, and K) are transferred to the intermediate transfer belt 48.

In this case, the intermediate transfer belt 48 rotates in the direction indicated by the arrow in FIG. 2 to sequentially pass through the primary transfer nips of the respective primary transfer bias rollers 49 (Y, M, C, and K). In this way, the toner images of the respective colors on the respective photoreceptors 41 (Y, M, and K) are superimposed and primarily transferred to the intermediate transfer belt 48, and a color toner image is formed on the intermediate transfer belt 48.

The intermediate transfer belt 48 on which the toner images of the respective colors are superimposed and transferred so that the color toner image is formed reaches a position where it faces a secondary transfer roller 89. At this position, the secondary transfer backup roller 82 and the secondary transfer roller 89 configurate a secondary transfer nip with the intermediate transfer belt 48 interposed therebetween. Moreover, the color toner image formed on the intermediate transfer belt 48 is transferred to a recording medium P such as a transfer sheet conveyed to the position of the secondary transfer nip. In this case, toner that has not been transferred to the recording medium P remains on the intermediate transfer belt 48. When the intermediate transfer belt 48 having passed through the secondary transfer nip reaches the position of an intermediate transfer cleaning device, the non-transferred toner on the surface thereof is collected. In this way, a series of transfer processes performed on the intermediate transfer belt 48 ends.

Next, the movement of the recording medium P will be described.

The recording medium P conveyed to the secondary transfer nip described above is a recording medium which is conveyed from a sheet feeding tray 26 of the sheet feeding unit 200 arranged below the printer unit 100 via a sheet feeding roller 27, a registration roller pair 28, and the like. Specifically, a plurality of recording media P is stacked and stored in the sheet feeding tray 26. When the sheet feeding roller 27 is rotated in the counter-clockwise direction in FIG. 2, an uppermost recording medium P is conveyed toward a roller nip configurated by two rollers of the registration roller pair 28.

The recording medium P conveyed to the registration roller pair 28 temporarily stops at the position or the roller nip of the registration roller pair 28 that stops rotating. The registration roller pair 28 is rotated in synchronization with the point in time when the color toner image on the intermediate transfer belt 48 reaches the secondary transfer nip, and the recording medium P is conveyed toward the secondary transfer nip. After that, when the recording medium P passes through the secondary transfer nip, the color toner image on the intermediate transfer belt 48 is transferred to the recording medium P.

The recording medium P to which the color toner image is transferred at the secondary transfer nip is conveyed to the position of a fixing device 86. In the fixing device 86, the color toner image transferred to the surface is fixed onto the recording medium P by the heat and pressure applied by a fixing belt and a pressing roller. The recording medium P having passed through the fixing device 86 is discharged outside the apparatus by passing between the rollers of a sheet discharging roller pair 29. The recording medium P discharged outside the apparatus by the sheet discharging roller pair 29 is sequentially stacked on a stacking portion 30 as an output image. In this way, a series of image forming processes in the copying machine 500 is completed.

Next, the configuration and operation of the developing device 50 in the image forming unit 46 will be described in further detail. In this description, although the image forming unit 46Y corresponding to yellow will be described by way of an example, the same is true for the image forming units 46 (M, C, and K) of the other colors.

As illustrated in FIG. 3, the developing device 50Y includes a developing roller 51Y, a doctor blade 52Y, two developer conveying screws 55Y, and a toner density detection sensor 56Y. The developing roller 51Y faces the photoreceptor 41Y, and the doctor blade 52Y faces the developing roller 51Y. Moreover, the two developer conveying screws 55Y are arranged in two developer accommodating portions (53Y and 54Y). The developing roller 51Y includes a magnet roller that is provided therein and a sleeve that rotates around the magnet roller. A two-component developer G that is made up of carrier and toner is stored in the first and second developer accommodating portions 53Y and 54Y. The second developer accommodating portion 54Y communicates with a falling path defining portion 64Y through an opening that is provided above the second developer accommodating portion 54Y. Moreover, the toner density detection sensor 56Y detects a toner density of the developer G in the second developer accommodating portion 54Y.

The developer G in the developing device 50 circulates between the first and second developer accommodating portions 53Y and 54Y while being stirred by the two developer conveying screws 55Y. The developer G in the first developer accommodating portion 53Y is supplied to and carried on the surface of the sleeve of the developing roller 51Y by a magnetic field generated by the magnet roller in the developing roller 51Y while being conveyed toward one of the developer conveying screws 55Y. The sleeve of the developing roller 51Y is rotated in the counter-clockwise direction as indicated by an arrow in FIG. 3, and the developer G carried on the developing roller 51Y moves on the developing roller 51Y with rotation of the sleeve. In this case, toner in the developer G is charged into potential having a polarity opposite to the carrier by triboelectric charging with the carrier in the developer G to be electrostatically adsorbed in the carrier. Then, the toner is carried on the developing roller 51Y together with the carrier attracted by the magnetic field generated on the developing roller 51Y.

The developer G carried on the developing roller 51Y is conveyed in the direction indicated by the arrow in FIG. 3 and reaches a doctor portion at which the doctor blade 52Y and the developing roller 51Y face each other. When the developer G on the developing roller 51Y passes through the doctor portion, the amount thereof is adjusted appropriately, and after that, the developer G is conveyed up to a developing area which is a position where the developing roller 51Y faces the photoreceptor 41Y. In the developing area, the toner in the developer G is adsorbed in the latent image formed on the photoreceptor 41Y by a developing electric field generated between the developing roller 51Y and the photoreceptor 41Y. The developer G remaining on the surface of the developing roller 51Y having passed through the developing area reaches a position above the first developer accommodating portion 53Y with rotation of the sleeve. At this position, the developer G is separated from the developing roller 51Y.

The developer G in the developing device 50Y is adjusted so that the toner density is within a predetermined range. Specifically, toner stored in the toner container 32Y is replenished into the second developer accommodating portion 54Y by a toner replenishing device 60Y to be described later in response to the amount consumed by development, of the toner included in the developer G in the developing device 50Y.

The toner replenished into the second developer accommodating portion 54Y circulates between the first and second developer accommodating portions 53Y and 54Y while being mixed and stirred together with the developer G by the two developer conveying screws 55Y.

Next, the toner replenishing devices 60 (Y, M, C, and K) will be described.

Figure 4:
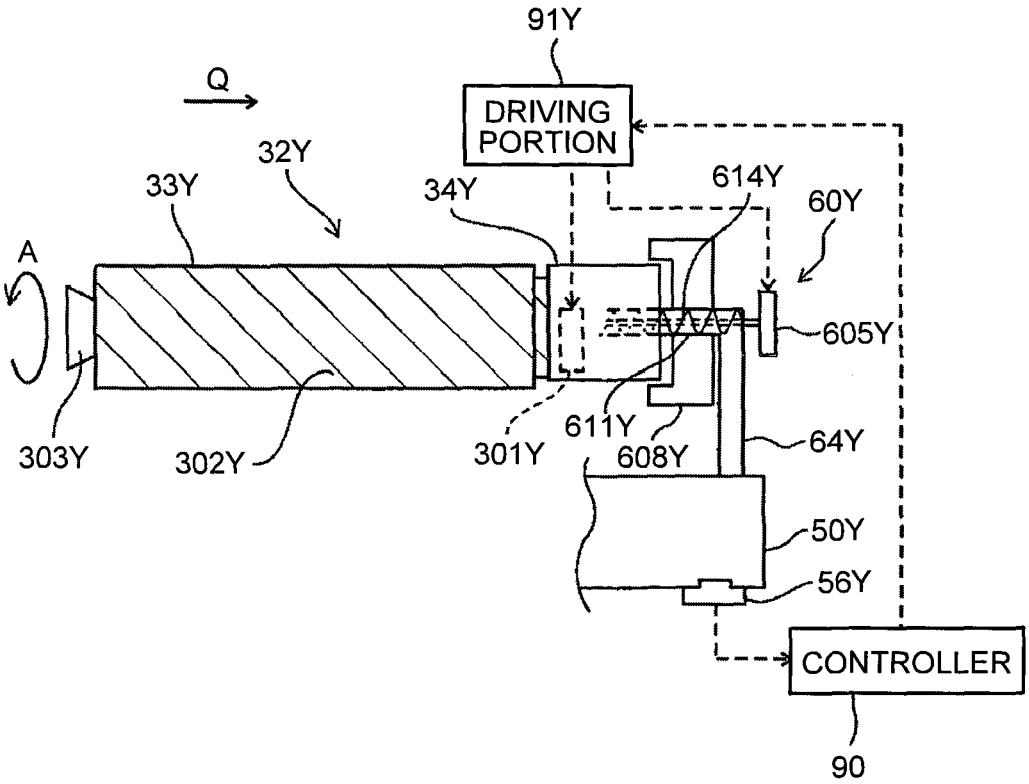
FIG. 4 is a schematic view illustrating a state where a toner container is provided in a toner replenishing device of the copying machine.
Figure 5:
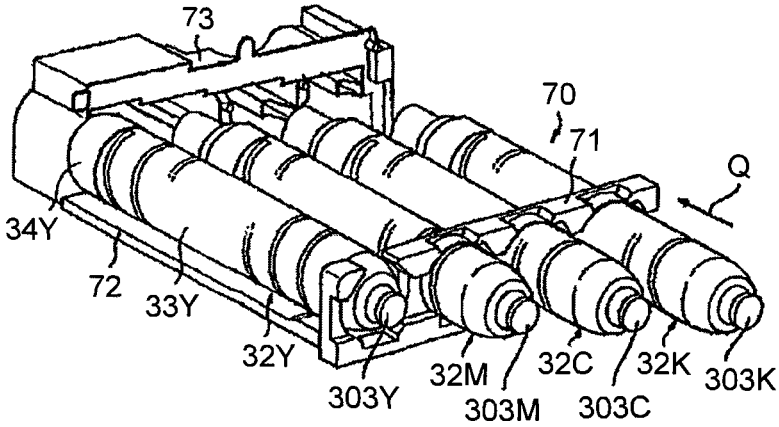
FIG. 5 is a schematic perspective view illustrating a state where a toner container is provided in a toner container receiving portion of the copying machine.

FIG. 4 is a schematic view illustrating a state where the toner container 32Y is provided in the toner replenishing device 60Y, and FIG. 5 is a schematic perspective view illustrating a state where four toner containers 32 (Y, M, C, and K) are provided in the toner container receiving portion 70.

The toner in the respective toner containers 32 (Y, M, C, and K) provided in the toner container receiving portion 70 of the printer unit 100 is appropriately replenished into the respective developing devices 50 (Y, M, C, and K). In this case, the toner in the respective toner containers 32 (Y, M, C, and K) is replenished by the toner replenishing devices 60 (Y, M, C, and K) provided for the respective toner colors. The four toner replenishing devices 60 (Y, M, C, and K) and the toner containers 32 (Y, M, C, and K) have approximately the same structure except that the colors of the toner components used in the image forming processes are different. Therefore, hereinafter, the toner replenishing device 60Y and the toner container 32Y corresponding to yellow only will be described, and the description of the toner replenishing devices 60 (M, C, and K) and the toner containers 32 (M, C, and K) corresponding to the other three colors will be omitted appropriately.

The toner replenishing devices 60 (Y, M, C, and K) includes the toner container receiving portion 70, conveying nozzles 611 (Y, M, C, and K), conveying screws 614 (Y, M, C, and K), falling path defining portions 64 (Y, M, C, and K), and container rotation driving units 91 (Y, M, C, and K).

When the toner container 32Y moves in the direction indicated by arrow Q in the figure to be attached to the toner container receiving portion 70 of the printer unit 100, the conveying nozzle 611Y which is a conveying nozzle of the toner replenishing device 60Y is inserted from a front end side of the toner container 32Y in response to the attaching operation. In this way, the toner container 32Y communicates with the conveying nozzle 611Y. The details of a configuration in which a communication state is created in response to the attaching operation will be described later.

The toner container 32Y of the present embodiment is an approximately cylindrical toner bottle and mainly includes a container front end cover 34Y non-rotatably held in the toner container receiving portion 70 and a container body 33Y having a container gear 301Y integrated therewith. The container body 33Y is held so as to be rotatable in relation to the container front end cover 34Y.

The toner container receiving portion 70 mainly includes a cap portion 73, a container receiving portion 72, and an insertion opening defining portion 71. The cap portion 73 is a portion for holding the container front end cover 34Y of the toner container 32Y, and the container receiving portion 72 is a portion for holding the container body 33Y of the toner container 32Y. Moreover, the insertion opening defining portion 71 is a portion that forms an insertion opening when the toner container 32Y is attached to the container receiving portion 72. When a body cover provided on the front side (the front side in the direction perpendicular to the drawing sheet of FIG. 2) of the copying machine 500 is opened, the insertion opening defining portion 71 of the toner container receiving portion 70 is revealed. Moreover, in a state where the longitudinal direction of the respective toner containers 32 (Y, M, C, and K) is arranged in the horizontal direction, operation (operation of arranging the longitudinal direction of the toner container 32 in an attaching and detaching direction) of attaching and detaching the respective toner containers 32 (Y, M, C, and K) from the front side of the copying machine 500 is performed. A set cover 608Y in FIG. 4 is a part of the cap portion 73 of the toner container receiving portion 70.

The container receiving portion 72 is provided such that the length in the longitudinal direction is approximately the same as the length in the longitudinal direction of the container body 33Y. Moreover, the cap portion 73 is provided on the other end side in the longitudinal direction (attaching and detaching direction) of the container receiving portion 72, and the insertion opening defining portion 71 is provided on one end side in the longitudinal direction of the container receiving portion 72. Thus, in response to the attaching operation of the toner container 32Y, the container front end cover 34Y passes through the insertion opening defining portion 71 and then temporarily slides on the container receiving portion 72 and is then attached to the cap portion 73.

In a state where the container front end cover 34Y is attached to the cap portion 73, when rotational driving force is input to the container gear 301Y from the container rotation driving unit 91Y that is configurated of a driving motor, a driving gear, and the like, the container body 33Y is rotated in the direction indicated by arrow A in FIG. 4. When the container body 33Y itself rotates, the toner stored in the container body 33Y is conveyed from the left to the right in FIG. 4 along the longitudinal direction of the container body by a spiral projection (serving as a powder conveyor) 302Y, provided in a spiral form on the inner circumferential surface of the container body 33Y. As a result, the toner is supplied into the conveying nozzle 611Y from the side of the container front end cover 34Y.

The conveying screw 614Y is disposed in the conveying nozzle 611Y, and when rotational driving force is input from the container rotation driving unit 91Y to a conveying screw gear 605Y, the conveying screw 614Y rotates to convey the toner supplied into the conveying nozzle 611Y. A downstream end in the conveying direction of the conveying nozzle 611Y is connected to the falling path defining portion 64Y, and the toner conveyed by the conveying screw 614Y free-falls along the falling path defining portion 64Y and is replenished into the developing device 50Y (the second developer accommodating portion 54Y).

When the toner containers 32 (Y, M, C, and K) reach their service life (the toner stored therein almost runs out and the container is empty), the toner containers are replaced with a new one. A knob 303 is provided on an end in the longitudinal direction of the toner container 32 opposite to the container front end cover 34, and the attached toner container 32 can be taken out when an operator pulls the knob 303 during replacement.

A controller 90 may calculate a toner consumption amount based on the image information used by the exposure device 47 and determine that it is necessary to supply toner to the developing device 50Y. Moreover, the controller 90 may detect a decrease in the toner density in the developing device 50Y based on the detection result of the toner density detection sensor 56Y. In these cases, the container rotation driving unit 91Y is rotated under the control of the controller 90 to rotate the container body 33Y of the toner container 32Y and the conveying screw 614Y for a predetermined period so that toner is replenished to the developing device 50Y. Moreover, since toner replenishment is performed by rotating the conveying screw 614Y disposed in the conveying nozzle 611Y, it is possible to accurately calculate the amount of toner supplied from the toner container 32Y by detecting the number of rotations of the conveying screw 614Y. When the accumulated amount of toner supply calculated from the time when the toner container 32Y is attached reaches the amount of toner in the toner container 32Y during attachment, a message requesting the replacement of the toner container 32Y is displayed on a display unit of the copying machine 500 by regarding that toner is not present in the toner container 32Y.

Moreover, even when the toner density detection sensor 56Y detects a decrease in the toner density to execute toner replenishing operation and repeatedly determine whether the toner density has been recovered, recovery of the toner density may not be detected by the toner density detection sensor 56Y. In this case, a message requesting the replacement of the toner container 32Y is displayed on the display unit of the copying machine 500 by regarding that toner is not present in the toner container 32Y.

In the toner replenishing device 60Y of the present embodiment, the amount of toner supplied to the developing device 50Y is controlled based on the number of rotations of the conveying screw 614Y. Thus, the toner having passed through the conveying nozzle 611Y is directly conveyed to the developing device 50Y through the falling path defining portion 64Y without the amount supplied to the developing device 50Y being controlled. A temporarily toner storage unit such as a toner hopper may be provided in such a toner replenishing device 60Y as in the present embodiment in which the conveying nozzle 611Y is inserted to the toner container 32Y. Moreover, the amount of toner supplied to the developing device 50Y may be controlled by controlling the amount of toner conveyed from the temporarily toner storage unit to the developing device 50Y.

Moreover, in the toner replenishing device 60Y of the present embodiment, although the toner supplied into the conveying nozzle 611Y is conveyed by the conveying screw 614Y, a configuration that conveys the toner supplied into the conveying nozzle 611Y is not limited to a screw member. As in JP 2009-276659 A, a configuration that applies conveying force other than the screw member such as a configuration that generates negative pressure in the opening of the conveying nozzle 611Y using a powder pump may be used.

In the configuration where the temporarily toner storage unit is provided, a toner end sensor is provided so as to detect a state where the amount of toner stored in the temporarily toner storage unit reaches a predetermined amount. Moreover, when the toner end sensor detects a toner-end state, the container body 33Y and the conveying screw 614Y are rotated for a predetermined period to replenish toner into the temporarily toner storage unit. Further, when the toner-end state detected by the toner end sensor is not cleared even if such control is repeatedly performed for a predetermined number of times, a message requesting the replacement of the toner container 32Y is displayed on the display unit of the copying machine 500 by regarding that toner is not present in the toner container 32Y. In this manner, in the configuration in which the state where toner is not present in the toner container 32Y is detected based on the toner-end state detected by the toner end sensor, it is not necessary to calculate the accumulated amount of toner supply calculated from the time when the toner container 32Y is attached. However, in the configuration where the temporarily toner storage unit is not provided as in the toner replenishing device 60Y of the present embodiment, it is possible to decrease the size of the toner replenishing device 60Y and to decrease the size of the entire copying machine 500.

Next, the toner containers 32 (Y, M, C, and K) and the toner replenishing devices 60 (Y, M, C, and K) of the present embodiment will be described in further detail. As described above, the toner containers 32 (Y, M, C, and K) and the toner replenishing devices 60 (Y, M, C, and K) have approximately the same configuration except that the colors of toner used are different. Thus, in the following description, the subscripts Y, M, C, and K representing the colors of toner used will be omitted.

Figure 6:
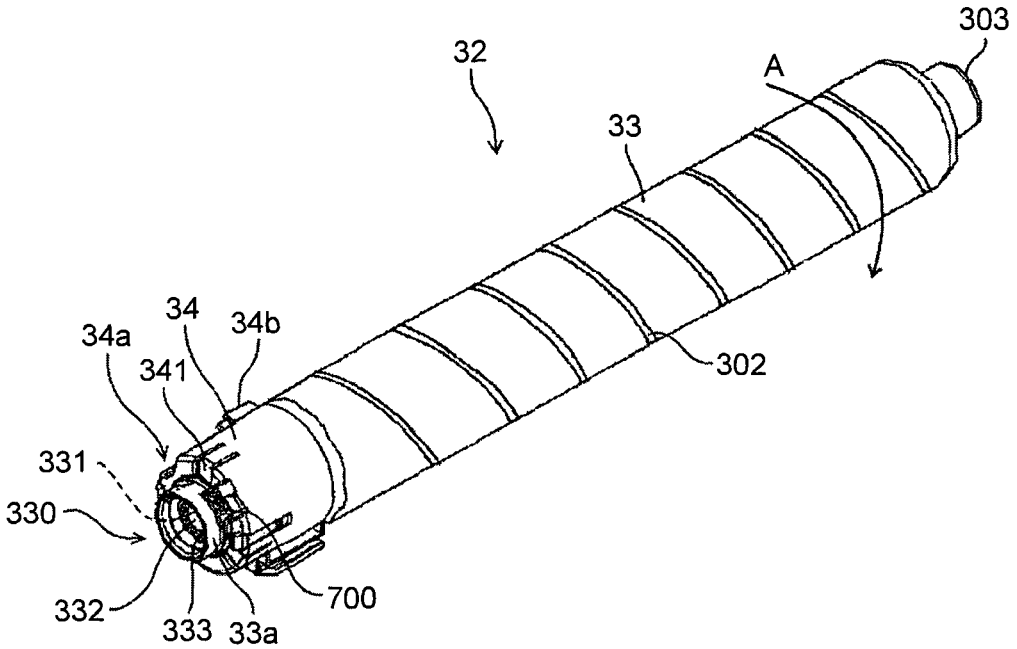
FIG. 6 is a perspective view illustrating a toner container according to the first embodiment.
Figure 7:
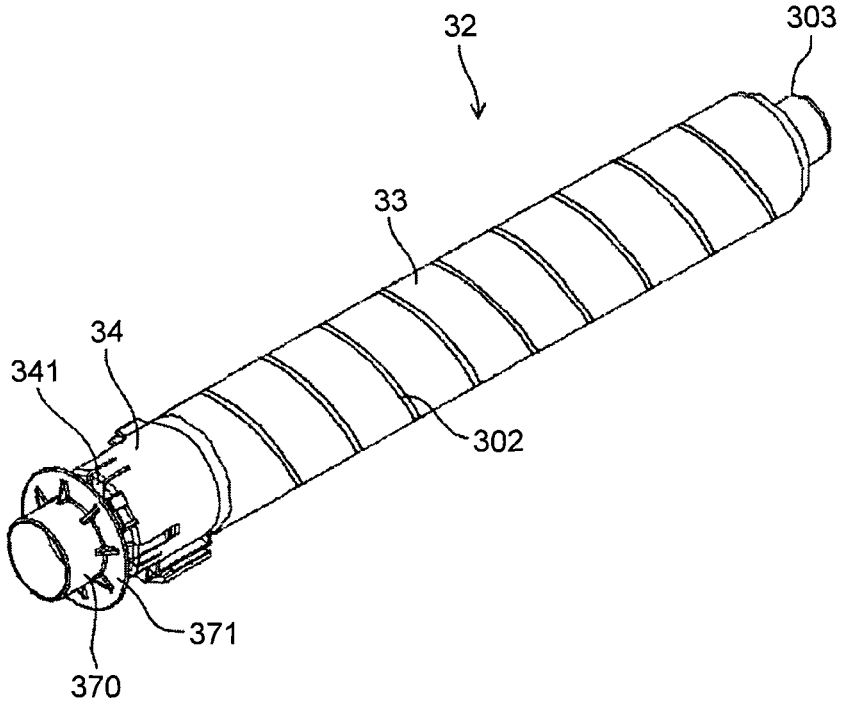
FIG. 7 is a perspective view illustrating the toner container of FIG. 6 during storage.

FIG. 6 is a perspective view illustrating the toner container 32 of the present embodiment. FIG. 7 is a perspective view illustrating the toner container 32 during storage and illustrates a state where a cap (cap member) 370 as a sealing member that seals a front end opening 305 of the toner container 32 illustrated in FIG. 6.

Moreover, FIG. 1 illustrates the toner container 32, in which (a) is an exploded perspective view of the toner container 32, and (b) is a front view of a nozzle receiver (serving as a nozzle reception member) 330 included in the toner container 32 when seen from the other end side. The cap 370 illustrated in FIG. 1(*a*) and FIG. 7 is a member that is detached from the body of the toner container 32 when the toner container 32 is attached to the toner replenishing device 60.

Figure 8:
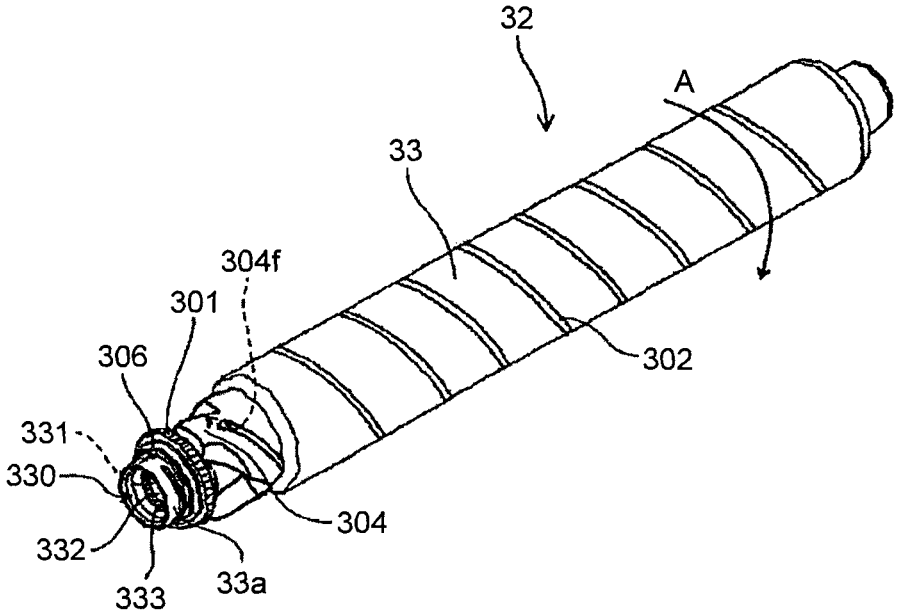
FIG. 8 is a perspective view illustrating the toner container of FIG. 6 in a state where a container front end cover is detached therefrom.

FIG. 8 is a perspective view of the toner container 32 in a state where the container front end cover 34 is detached. As illustrated in FIG. 8, the toner container 32 having the container front end cover 34 detached therefrom includes a container body 33 and the nozzle receiver 330 that includes a nozzle insertion opening (serving as a nozzle inlet) 331.

Figure 9:
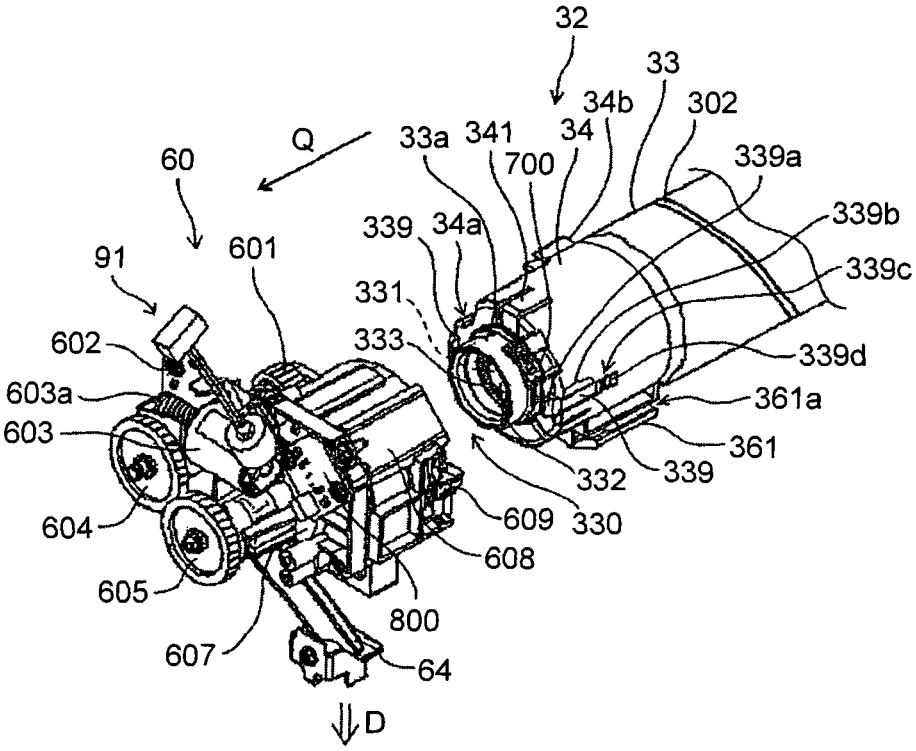
FIG. 9 is a perspective view illustrating a toner container and a toner replenishing device before the toner container is attached thereto.
Figure 10:
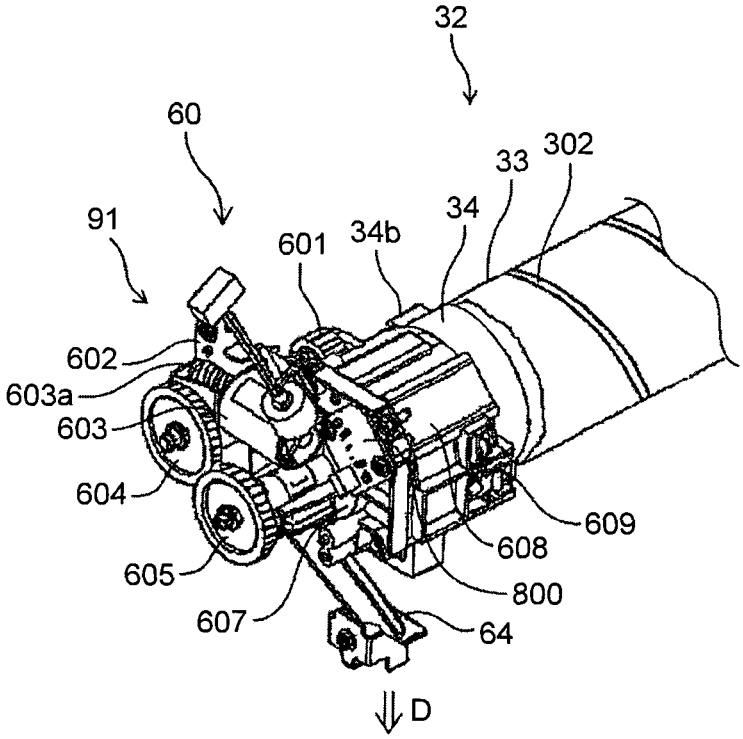
FIG. 10 is a perspective view illustrating a toner container and a toner replenishing device in a state where the toner container is attached thereto.

FIG. 9 is a perspective view illustrating a front end of the toner container 32 and the toner replenishing device 60 before the toner container 32 is attached thereto. FIG. 10 is a perspective view illustrating the front end of the toner container 32 and the toner replenishing device 60 in a state where the toner container 32 is attached thereto.

Figure 11:
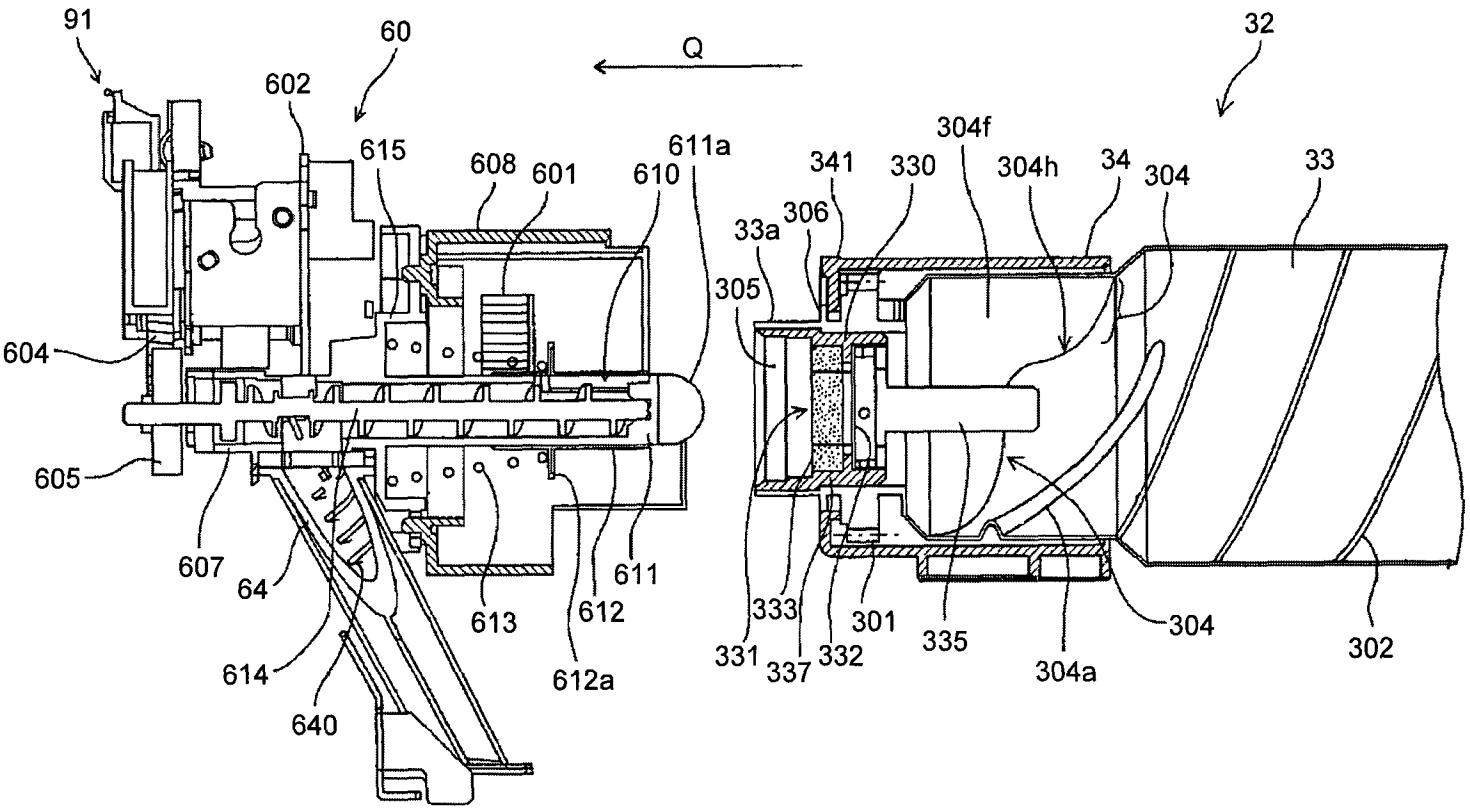
FIG. 11 is a cross-sectional view illustrating a toner container and a toner replenishing device before the toner container is attached thereto.
Figure 12:
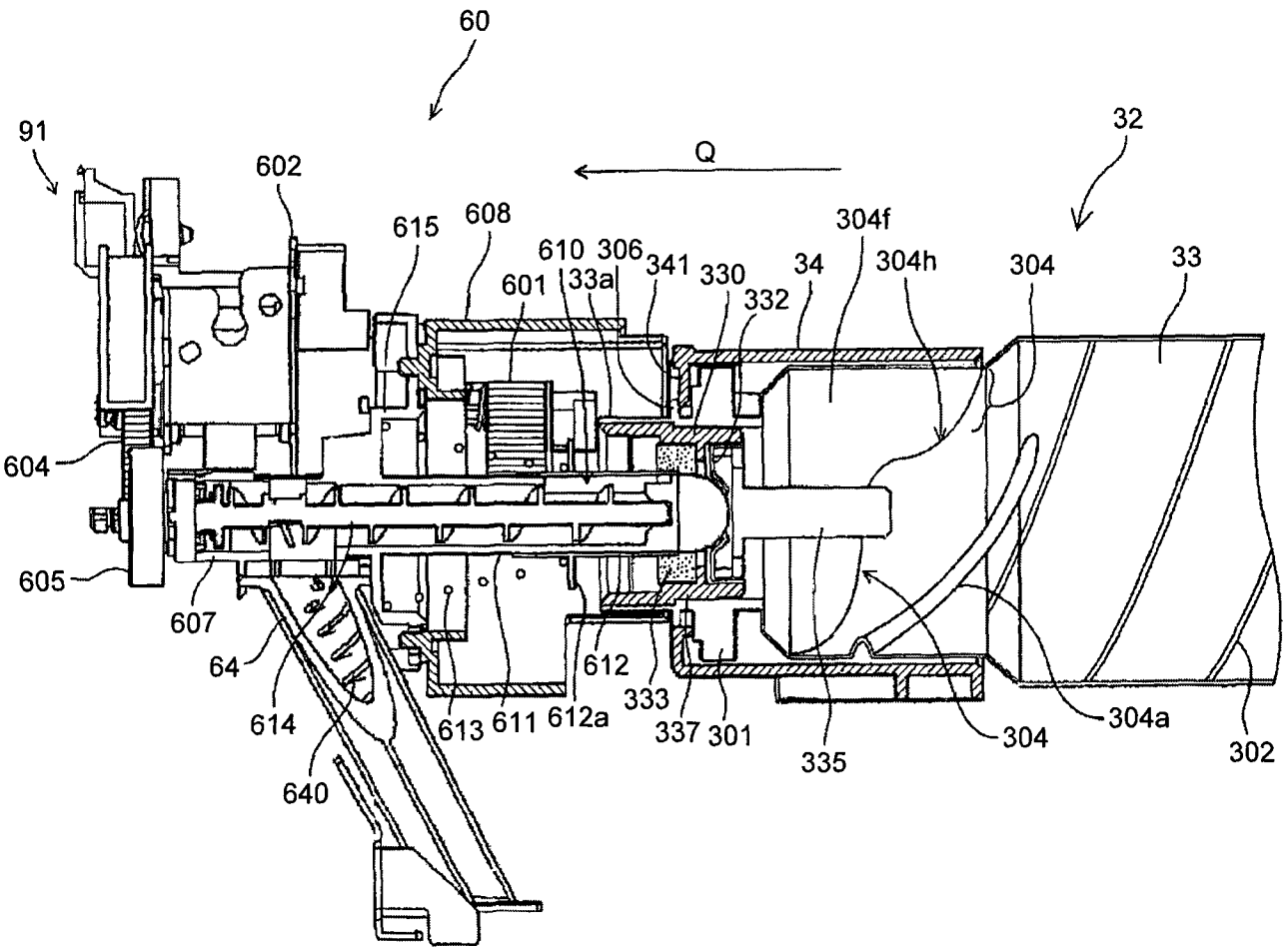
FIG. 12 is a cross-sectional view illustrating a toner container and a toner replenishing device in the process of attaching the toner container thereto.
Figure 13:
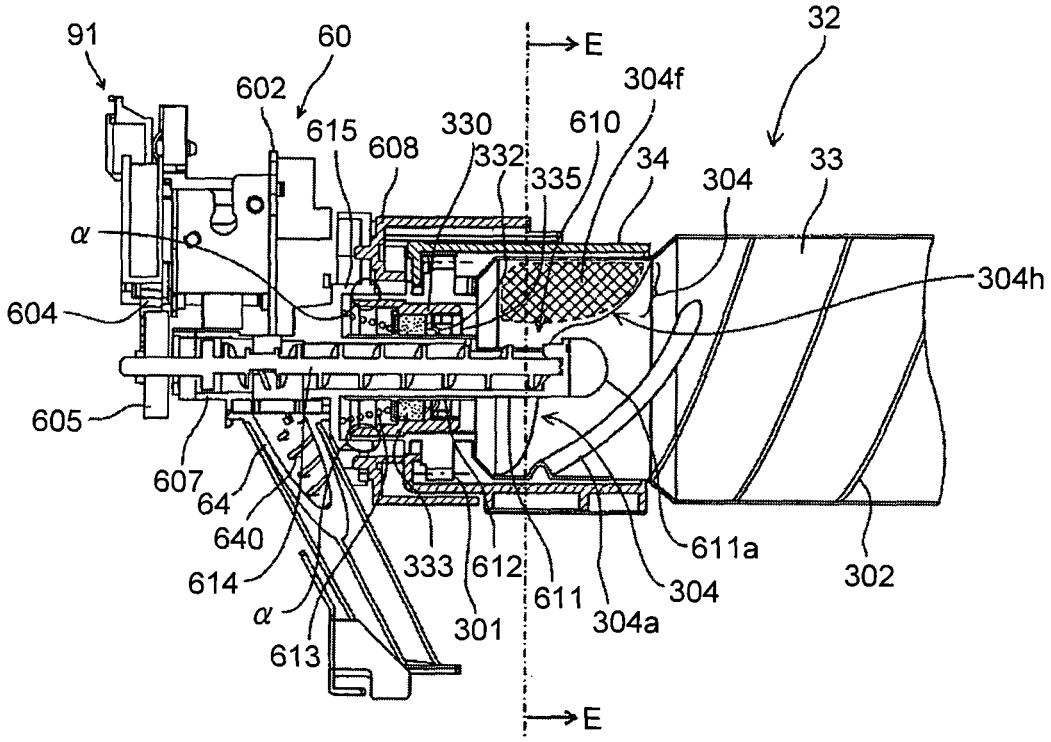
FIG. 13 is a cross-sectional view illustrating a toner container and a toner replenishing device in a state where the toner container is attached thereto.

FIG. 11 is a cross-sectional view illustrating the front end of the toner container 32 and the toner replenishing device 60 before the toner container 32 is attached thereto. FIG. 12 is a cross-sectional view illustrating the front end of the toner container 32 and the toner replenishing device 60 in the process of attaching the toner container 32 thereto. FIG. 13 is a cross-sectional view illustrating the front end of the toner container 32 and the toner replenishing device 60 in a state where the toner container 32 is attached thereto. In FIGS. 11 to 13, a driving motor 603 is not depicted.

The toner replenishing device 60 includes the conveying nozzle 611 that has the conveying screw 614 therein. Moreover, the toner replenishing device 60 includes a nozzle shutter 612. The nozzle shutter 612 blocks a nozzle opening 610 provided in the conveying nozzle 611 in anon-attachment state (the state of FIGS. 9 and 11) before the toner container 32 is attached thereto. Moreover, the nozzle shutter 612 opens the nozzle opening 610 in an attachment state (the state of FIGS. 10 and 13) where the toner container 32 is attached thereto. On the other hand, the nozzle insertion opening 331 in which the conveying nozzle 611 is inserted during attachment is provided at the center of the front end surface of the toner container 32, and an elastic sheet 332 which is a container shutter sheet that blocks the nozzle insertion opening 331 during non-attachment is provided.

The toner container 32 will be described.

Figure 14:
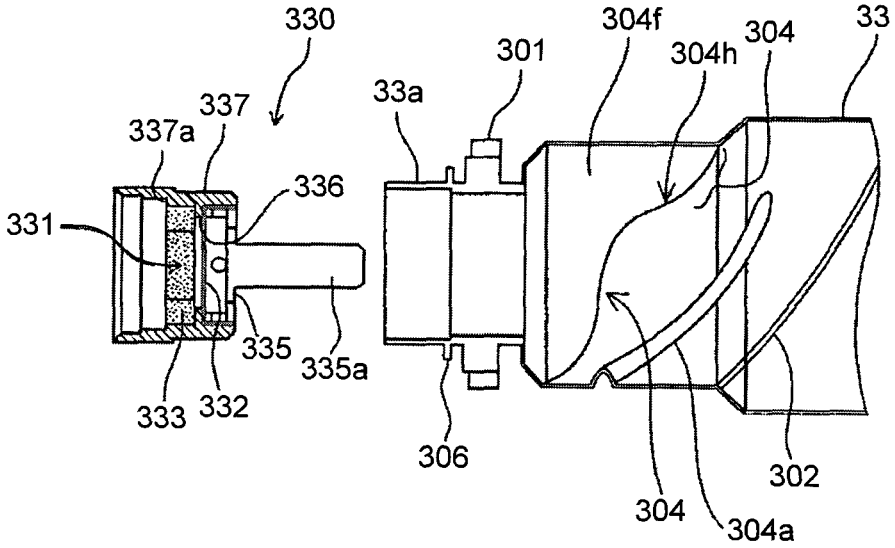
FIG. 14 is a cross-sectional view illustrating a toner container in a state where a nozzle receiver is detached from a container body.
Figure 15:
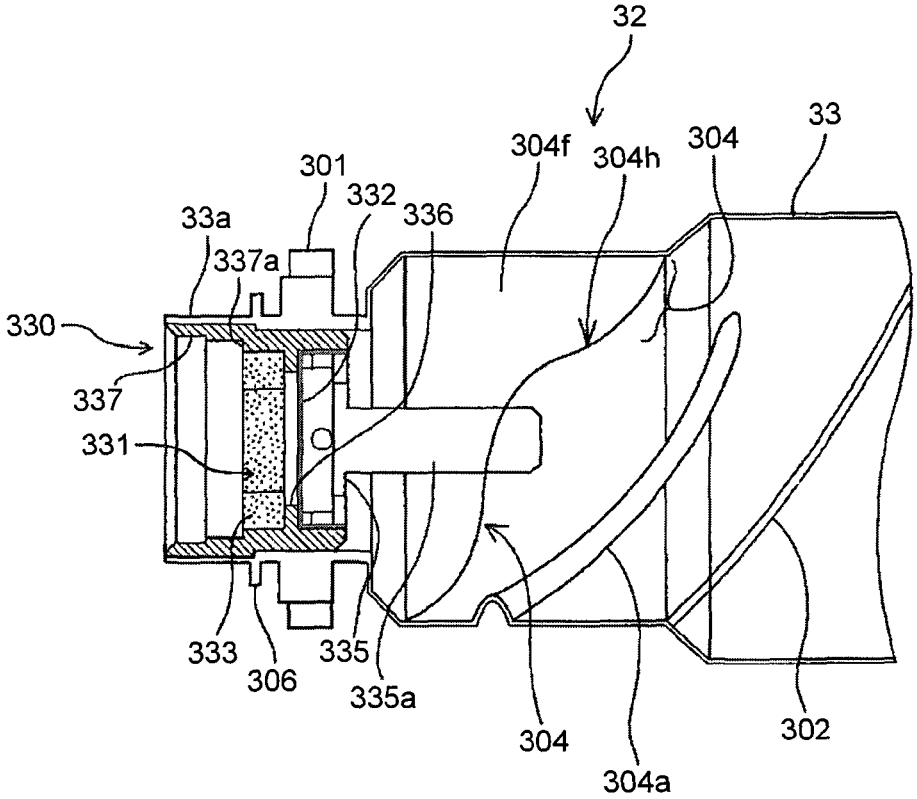
FIG. 15 is a cross-sectional view illustrating a toner container in a state where the nozzle receiver is attached to the container body from the state of FIG. 14.

As illustrated, the toner container 32 mainly includes the container body 33 and the container front end cover 34. FIG. 14 is a cross-sectional view illustrating the toner container 32 in a state where the nozzle receiver 330 is detached from the container body 33. Moreover, FIG. 15 is a cross-sectional view illustrating the toner container 32 (the toner container 32 in a state where the container front end cover 34 is detached therefrom similarly to FIG. 8) in a state where the nozzle receiver 330 is attached to the container body 33 from the state of FIG. 14.

The container body 33 is approximately cylindrical to rotate about a central axis of the cylinder as a rotation axis. Hereinafter, a direction parallel to the rotation axis will be referred to as a "rotation axis direction", and in the rotation axis direction, a front end side during attachment, on which the container front end cover 34 of the toner container 32 is disposed will be referred to as a "front end side". Moreover, a side (the side opposite to the front end side) on which the knob 303 of the toner container 32 is disposed will be referred to as a "rear end side" or "container inner side". The longitudinal direction of the toner container 32 is the rotation axis direction, and in a state where the toner container 32 is attached to the toner replenishing device 60, the rotation axis direction is the horizontal direction. A portion of the container body 33 located closer to the rear end side than the container gear 301 has a larger outer diameter than that located on the front end side, and the spiral projection (serving as a powder conveyor) 302 is provided on the inner circumferential surface thereof. Moreover, when the container body 33 rotates in the direction indicated by arrow A in the figure, conveying force is applied to the toner in the container body 33 by the action of the spiral projection 302 so that the toner is conveyed from one end side (rear end side) to the other end side (front end side) in the rotation axis direction.

A scooping portion 304 is provided on the inner wall on the front end side of the container body 33 so that the toner which has been conveyed toward the front end side by the spiral projection 302 with rotation of the container body 33 in the direction indicated by arrow A in the figure is scooped upward with rotation of the container body 33. The scooping portion 304 includes a convex portion **304*h* and a scooping wall surface 304*f*. The convex portion 304*h* is a portion that protrudes on the inner side of the container body 33 so as to form a ridge line of a mountain toward the center of rotation of the container body 33 while defining a spiral line. The scooping wall surface 304*f* is a wall surface that is on the downstream side when seen from the container rotation direction among the wall surface of the protruding portion that extends from the convex portion 304*h* (the ridge line) to the inner wall of the circumferential surface of the container body 33. Moreover, when the scooping wall surface 304*f* is on the lower side, the toner entering into an inner space facing the scooping portion 304 by the conveying force of the spiral projection 302 is scooped upward by the scooping wall surface 304*f* with rotation of the container body 33. As a result, the toner can be scooped upward further than the inserted conveying nozzle 611**.

Moreover, as illustrated in FIGS. 11 to 13 and other figures, a scooping spiral projection **304*a* provided in a spiral shape is also provided on the inner circumferential surface of the scooping portion 304 so as to convey the toner in a manner similarly to the spiral projection 302**.

The container gear 301 is provided in a portion of the container body 33 located further closer to the front end side than the scooping portion 304. A gear exposing opening **34*a* is provided in the container front end cover 34 so that a portion (the back side in FIG. 6) of the container gear 301 is exposed in a state of being attached to the container body 33. Moreover, when the toner container 32 is attached to the toner replenishing device 60, the container gear 301 exposed from the gear exposing opening 34*a* meshes with a container driving output gear 601 of the toner replenishing device 60**.

A cylindrical container opening **33*a* is provided in a portion of the container body 33 located further closer to the front end side than the container gear 301. Moreover, when an attaching portion 337 of the nozzle receiver 330 is press-fitted into the container opening 33*a*, the nozzle receiver 330 can be attached to the container body 33. A method of attaching the nozzle receiver 330** is not limited to press-fitting, and an adhesive agent or screws may be used.

In the toner container 32, after toner is filled in the container body 33 from the opening of the container opening **33*a*, the nozzle receiver 330 is attached to the container opening 33*a* of the container body 33**.

Moreover, a cover hook stopper 306 is provided on a portion of the container opening **33*a* of the container body 33 closer to the container gear 301. The container front end cover 34 is attached to the toner container 32 (the container body 33) in the state illustrated in FIG. 8 from the front end side (the bottom left side in FIG. 8). As a result, the container body 33 passes through the container front end cover 34 in the rotation axis direction, and a cover claw portion 341 provided on an upper portion of the container front end cover 34 is hooked by the cover hook stopper 306. The cover hook stopper 306 is provided on an entire outer circumferential surface of the container opening 33*a* and interposes the cover claw portion 341 in the rotation axis direction together with the container gear 301 to thereby restrict the movement of the container front end cover 34 in the axial direction. With such a configuration, the container body 33 and the container front end cover 34** are provided so as to be rotatable in relation to each other.

Moreover, the container body 33 is provided according to a biaxial orientation blow molding method (see JP-A Nos. 2003-241496 and 2005-221825, and Japanese Patent No. 4342958). The biaxial orientation blow molding method generally includes two steps of a preform molding step and a stretching blow molding step. In the preform molding step, a test tube-shaped preform is molded according to injection molding using a resin. By this injection molding, the container opening 33*a*, the cover hook stopper 306, and the container gear 301 are formed in a test tube-shaped opening portion. The stretching blow molding step involves heating and softening the preform which has been cooled and separated from a mold after the preform molding step and performing blow molding and stretching the preform.

In the container body 33 of the present embodiment, portion located closer to the rear end side than the container gear 301 is molded by the stretching blow molding step. That is, the scooping portion 304, and the portion where the spiral projection 302 is provided, and the knob 303 are molded by the stretching blow molding step.

In the container body 33, since the container gear 301, the container opening 33*a*, and the respective portions disposed on the front end side than the container gear 301 such as the cover hook stopper 306 have the shapes of the injection-molded preform, these portions can be molded with high accuracy. On the other hand, since the scooping portion 304, the portion where the spiral projection 302 is provided, and the knob 303 are stretch-molded in the stretching blow molding step, these portions are not molded with high accuracy.

Next, the nozzle receiver 330 attached to the container body 33 will be described.

As illustrated in FIGS. 1, 14, and 15, the nozzle receiver 330 includes the attaching portion 337, an elastic sheet 332, a container seal 333 which is a container sealing member, and a sheet stopper 335.

Moreover, the sheet stopper 335 includes a pair of extension portions 335*a*.

The elastic sheet 332 is formed of a thin film sheet made from an elastic member having flexibility. Moreover, in the toner container 32 of the present embodiment, the elastic sheet 332 includes two elastic sheet members of first and second elastic sheets 332*a* and 332*b* so that the sheet members are disposed so as to overlap to form a sheet overlapping portion 332*c*. Moreover, the sheet overlapping portion 332*c* blocks a portion of the elastic sheet 332 which is opened when the conveying nozzle 611 is inserted.

The attaching portion 337 has such a cylindrical shape that the diameter of the inner circumferential surface decreases stepwise toward a container seal attached wall (serving as a seal attached portion) 336 to be described later. As illustrated in FIGS. 14 and 15, the attaching portion 337 has the donut-shaped container seal attached wall 336 in which the diameter of the inner circumferential surface is smaller than the other portion in order to hold the elastic sheet 332 and the container seal 333.

The donut-shaped container seal 333 is disposed so as to make contact with a wall surface which is on the front end side in relation to the container seal attached wall 336. The container seal 333 is attached to the wall surface (first wall surface) on the front end side of the container seal attached wall 336 of the attaching portion 337 by an adhesive agent, a double-sided tape, or the like.

On the other hand, the elastic sheet 332 is attached to the attaching portion 337 in such a manner that a planar surface of the elastic sheet 332 having such a shape that is larger by an overlapping margin than a semi-circle is interposed between a wall surface (second wall surface) on the rear end side of the container seal attached wall 336 and the sheet stopper 335. Specifically, the sheet stopper 335 is press-fitted to the attaching portion 337 so that the elastic sheet 332 is interposed between the inner circumferential surface of a portion of the attaching portion 337 that includes the nozzle insertion opening 331 and the wall surface on the rear end side of the container seal attached wall 336. In this manner, the sheet stopper 335 can be attached to the attaching portion 337, and the elastic sheet 332 that is interposed between the sheet stopper 335 and the attaching portion 337 can be held on the attaching portion 337.

A method of holding the elastic sheet 332 to the attaching portion 337 is not limited to press-fitting, and an adhesive agent may be used.

Moreover, the following method may be used as a method of holding the elastic sheet 332 to the attaching portion 337. That is, a convex portion may be provided on the sheet stopper 335 and a concave portion or a hole may be provided in the attaching portion 337. Moreover, holding may be realized in such a manner that the convex portion of the sheet stopper 335 engages with the concave portion or hole of the attaching portion 337 with the elastic sheet 332 interposed. Further, a concave portion or a hole may be provided in the sheet stopper 335 and a convex portion may be provided on the attaching portion 337.

As illustrated in FIGS. 14 and 15, a plurality of nozzle shutter bumping ribs 337*a* is provided on the inner circumferential surface of a part of the attaching portion 337 in which the container seal 333 is disposed. As illustrated in FIGS. 14 and 15, in a state where the container seal 333 is attached to the attaching portion 337, an end surface on the front end side of the container seal 333 protrudes in the rotation axis direction further than the front end of the nozzle shutter bumping rib 337*a*. As illustrated in FIG. 13, when the toner container 32 is attached to the toner replenishing device 60, a nozzle shutter flange portion (bumping portion) 612*a* of the nozzle shutter 612 close to the toner replenishing device 60 bumps against the front end of the nozzle shutter bumping rib 337*a*. A front end surface of the container seal 333 protrudes further than the front end of the nozzle shutter bumping rib 337*a*. Thus, when the toner container 32 is attached to the toner replenishing device 60, the nozzle shutter flange portion 612*a* makes contact with the container seal 333 and then bumps against the nozzle shutter bumping rib 337*a* while squeezing the container seal 333. In this way, when the toner container 32 is attached to the toner replenishing device 60, the container seal 333 is squeezed by the nozzle shutter flange portion 612*a*. As a result, it is possible to secure air-tightness around the conveying nozzle 611 of the nozzle insertion opening 331 during attachment and to prevent toner leakage.

In the toner container 32, the container seal 333 which is an elastic member defines a front end surface of a portion in which the nozzle insertion opening 331 of the nozzle receiver 330 is open. Moreover, the nozzle shutter flange portion 612*a* which is a bumping portion of the nozzle shutter 612 which is a powder inlet opening and blocking member bumps against the nozzle shutter bumping rib 337*a* in a state where the container seal 333 is squeezed and compressed, described above. As a result, a surface of the nozzle shutter flange portion 612*a* opposite to a nozzle shutter spring receiving surface 612*f* makes close contact with the container seal 333, and a toner leakage preventing function can be improved.

In the toner container 32, a plurality of nozzle shutter bumping ribs 337*a* serving as a bumped portion. And the nozzle shutter flange portion 612*a* serves as a bumping portion. The plurality of nozzle shutter bumping ribs 337*a* and the nozzle shutter flange portion 612*a* bump each other when the container seal 333 is compressed. A back side of the nozzle shutter spring receiving surface 612*f* of the nozzle shutter flange portion 612*a* biased by the nozzle shutter spring 613 bumps against the nozzle shutter bumping rib 337*a*, whereby the position in the rotation axis direction of the nozzle shutter 612 in relation to the toner container 32 is determined. As a result, a positional relation in the rotation axis direction between the nozzle shutter 612 and the front end surface of the container seal 333 and the front end surface of the front end opening 305 (the inner space of a cylindrical attaching portion 337 to be described later, disposed in the container opening 33*a*) is determined.

As illustrated in FIGS. 11 to 13, when the toner container 32 is attached to the toner replenishing device 60, the nozzle shutter 612 as a contacting member and the nozzle shutter spring 613 as a biasing member are accommodated in the front end opening 305 which is a columnar inner space.

Moreover, as will be described later, during attachment of the toner container 32, the nozzle opening. 610 starts opening when the nozzle shutter flange portion 612*a* bumps against the nozzle shutter bumping rib 337*a* and the relative position of the nozzle shutter 612 to the toner container 32 is determined. On the other hand, during detachment of the toner container 32, even when the conveying nozzle 611 starts being removed from the toner container 32, the relative position of the nozzle shutter 612 to the toner container 32 does not change in a state where the nozzle opening 610 is opened. After the nozzle shutter 612 blocks the nozzle opening 610, the nozzle shutter 612 starts being removed from the toner container 32 together with the conveying nozzle 611. In a state where the nozzle shutter flange portion 612*a* bumps against the nozzle shutter bumping rib 337*a*, a portion of the conveying nozzle 611 where the nozzle opening 610 is provided is positioned sufficiently on the inner side of the toner container 32 than an inlet portion of the nozzle insertion opening 331. Since the nozzle opening 610 is opened and closed in the state where it is positioned sufficiently on the inner side of the toner container 32, it is possible to prevent toner leakage to the outside from the nozzle opening 610.

As illustrated in FIGS. 14 and 15, a step is provided in the middle in the rotation axis direction of the outer circumferential surface of the attaching portion 337 of the nozzle receiver 330 so that the outer diameter on the rear end side decreases. Moreover, as illustrated in FIG. 15, the inner circumferential surface of the container opening 33*a* of the container body 33 has a shape that follows the outer circumferential surface of the attaching portion 337, and a step is provided so that the inner diameter on the rear end side decreases. Moreover, the step on the outer circumferential surface of the attaching portion bumps against the entire area in the circumferential direction of the step on the inner circumferential surface of the container opening 33*a*. As a result, an axial tilt (a state where a central axis of the cylindrical attaching portion 337 tilts in relation to the central axis of the cylindrical container opening 33*a*) of the nozzle receiver 330 in relation to the container body 33 is prevented.

Next, the configuration of the container front end cover 34 will be described.

The container front end cover 34 of the toner container 32 is moved so as to slide on the container receiving portion 72 of FIG. 5 when the container front end cover 34 is attached to the toner replenishing device 60. In FIG. 5, with the axial direction of the container body 33 as the longitudinal direction, a groove extending from the insertion opening defining portion 71 to the cap portion 73 is provided immediately below the four toner containers 32. A pair of slide guides 361 is provided on both side surfaces in the lower portion of the container front end cover 34 so as to allow sliding movement in a manner of being fitted to the groove. Specifically, a pair of slide rails is provided on the groove of the container receiving portion 72 so as to protrude from both side surfaces of the groove. The slide guides 361 form a slide groove 361*a* in parallel to the rotation axis of the container body 33 so as to be vertically interposed by the pair of slide rails. Further, the container front end cover 34 includes a container engaged portion 339 that engages with a replenishing device-side engaging member (container engaging member) 609 provided in the set cover 608 when the container front end cover 34 is attached to the toner replenishing device 60.

Moreover, an IC tag (IC chip) 700 which is an information storage device that records data such as a use state of the toner container 32 is provided on the container front end cover 34. Further, a color identifying rib 34*b* that prevents attachment of the toner container 32 to a set cover 608 corresponding to a color different from the color of toner stored in the toner container 32 is provided on the container front end cover 34. As described above, when the slide guide 361 engages with the slide rail of the container receiving portion 72 during attachment, the posture of the container front end cover 34 on the toner replenishing device 60 is determined. Moreover, alignment of the container engaged portion 339 and the replenishing device-side engaging member 609 and alignment of the IC tag 700 to be described later and a body-side connector 800 can be performed smoothly.

Next, the toner replenishing device 60 will be described.

As illustrated in FIGS. 9 and 10, the toner replenishing device 60 includes a nozzle holder 607 that fixes the conveying nozzle 611 to a body frame 602 of the copying machine 500, and the set cover 608 is fixed to the nozzle holder 607. Further, the falling path defining portion 64 that is disposed so as to communicate with the conveying nozzle 611 from the lower side of the conveying nozzle 611 so as to form a falling conveying path of toner is fixed to the nozzle holder 607.

Moreover, as illustrated in FIGS. 11 to 13, an oscillating spring 640 is disposed inside the falling path defining portion 64.

The oscillating spring 640 has one end being engaged with the rotation shaft of the conveying screw 614 to move vertically with rotation of the conveying screw 614. The oscillating spring 640 performs this vertical movement to scrape off the toner that stays and adheres near the inner wall surface of the falling path defining portion 64 which is a tubular member. In order to improve the effect of preventing clogging of the falling path defining portion 64, it is desirable to dispose the oscillating spring 640 near the inner wall surface of the falling path defining portion 64. In the configuration of the present embodiment, since the falling path defining portion 64 is a cylindrical member, the oscillating spring 640 (a spring member of which diameter is slightly smaller than the diameter of the inner wall of the falling path defining portion 64) is an oscillating scraping member. When the cross-sectional shape of around slice of the falling path defining portion 64 is a shape other than a circular shape, the shape of the oscillating scraping member may be adjusted to comply with the cross-sectional shape of the falling path defining portion 64.

Moreover, the container rotation driving unit 91 is fixed to the frame 602. The container rotation driving unit 91 includes the driving motor 603 and the container driving output gear 601 and further includes a worm gear 603*a* that transmits rotational driving force of the driving motor 603 to the rotation shaft of the container driving output gear 601. A power transmission gear 604 is fixed to the rotation shaft of the container driving output gear 601 to mesh with the conveying screw gear 605 fixed to the rotation shaft of the conveying screw 614. With such a configuration, when the driving motor 603 is rotated, the toner container 32 can be rotated by the container driving output gear 601 and the container gear 301. Moreover, when the driving motor 603 is rotated, the conveying screw 614 can be rotated by the power transmission gear 604 and the conveying screw gear 605. That is, by rotation driving the driving motor 603, the toner container 32 as well as the conveying screw 614 can be rotated.

A clutch may be provided in the power transmission path between the driving motor 603 and the container gear 301 and the power transmission path between the driving motor 603 and the conveying screw gear 605. By providing such a clutch, a configuration in which only one of the toner container 32 and the conveying screw 614 is rotated when the driving motor 603 is rotated can be realized.

Next, the conveying nozzle 611 of the toner replenishing device 60 will be described.

Figure 16:
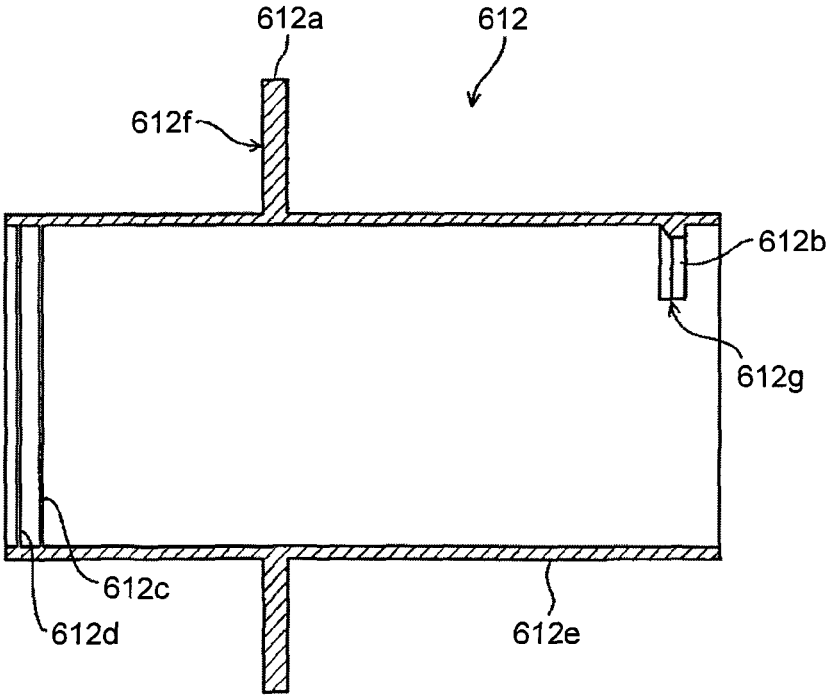
FIG. 16 is a cross-sectional view illustrating a nozzle shutter, common to all embodiments.
Figure 17:
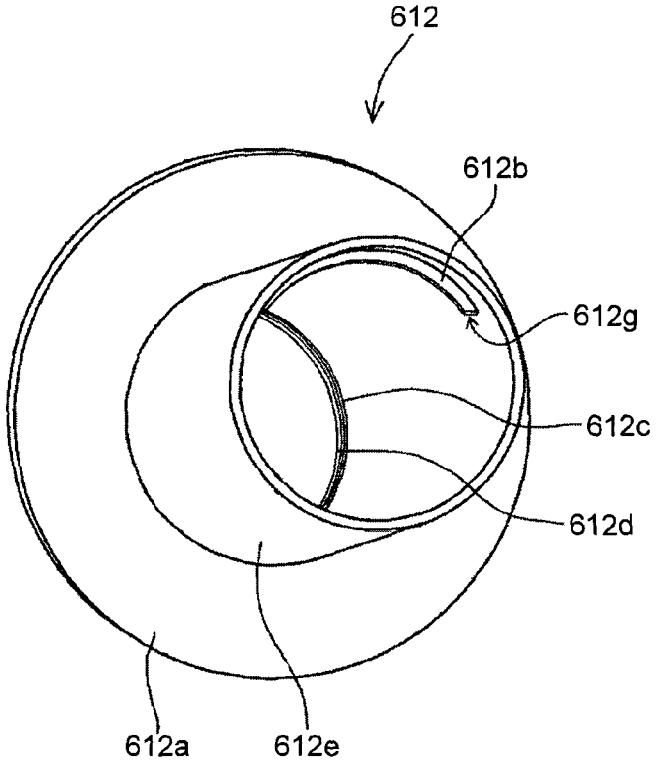
FIG. 17 is a perspective view of the nozzle shutter of FIG. 16 when seen from a front end side of the nozzle.
Figure 18:
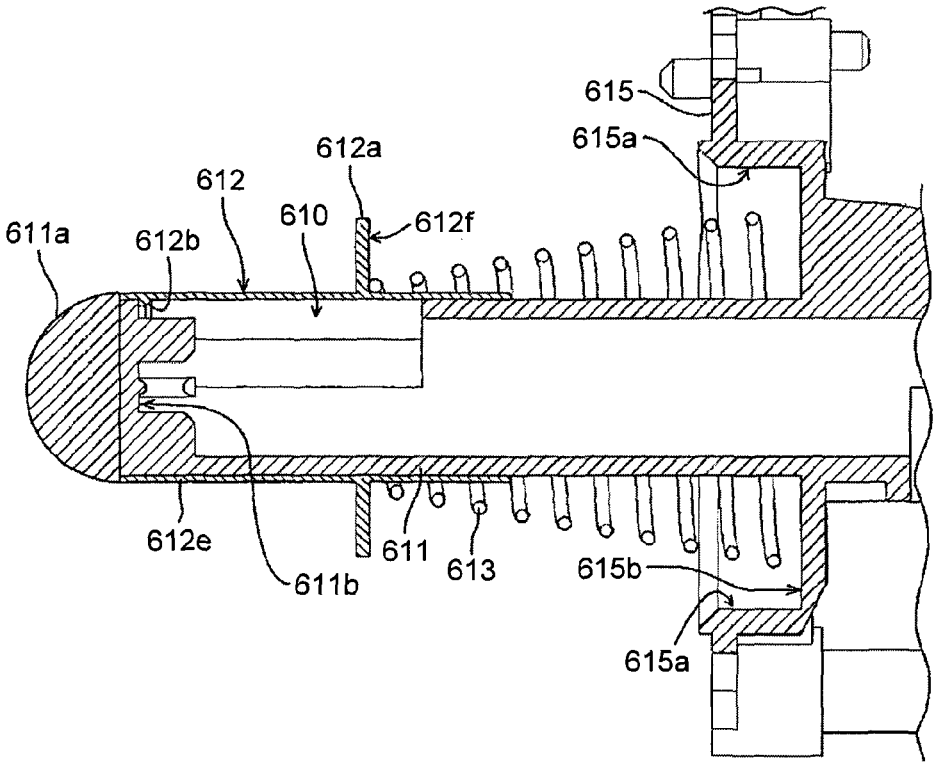
FIG. 18 is a cross-sectional view near a conveying nozzle of a toner replenishing device, common to all embodiments.
Figure 19:
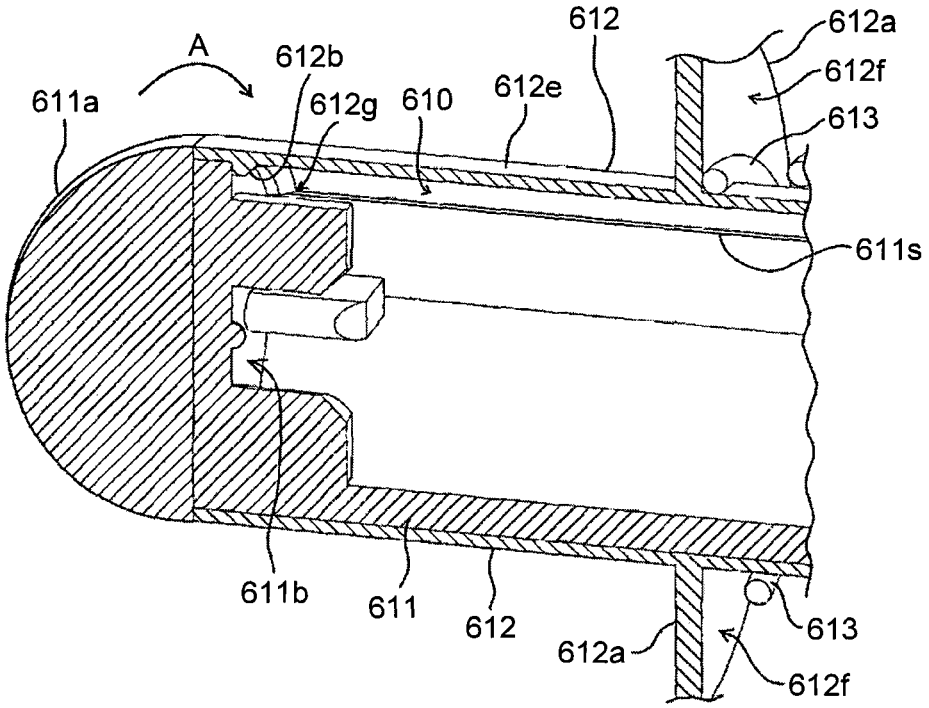
FIG. 19 is a perspective cross-sectional view illustrating near a nozzle opening of the conveying nozzle of FIG. 18.

FIG. 16 is a cross-sectional view illustrating the nozzle shutter 612. Moreover, FIG. 17 is a perspective view illustrating the nozzle shutter 612 when seen from the side (nozzle front end side) on which the toner container 32 is attached. FIG. 18 is a cross-sectional view illustrating the vicinity of the conveying nozzle 611 of the toner replenishing device 60, and FIG. 19 is a perspective cross-sectional view illustrating the vicinity of the nozzle opening 610 of the conveying nozzle 611. In FIGS. 18 and 19, the conveying screw 614 disposed in the conveying nozzle 611 is not depicted. Moreover, the conveying nozzle 611 has a sheet member guide 611*a* to be described later that is disposed in an end that faces the toner container, on the side opposite to the base thereof. The sheet member guide 611*a* will be described later.

A container setting portion 615 is provided in the base of the conveying nozzle 611. And the front end of the container opening 33*a* is fitted to the container setting portion 615 in a state where the toner container 32 is attached to the toner replenishing device 60. The container setting portion 615 has a cylindrical shape and the inner circumferential surface (container-setting-portion inner circumferential surface 615*a*) is fitted to the outer circumferential surface of the cylindrical container opening 33*a* in a slidable state. With this fitting, the position of the toner container 32 in relation to the toner replenishing device 60 in a planar direction orthogonal to the rotation axis of the toner container 32 is determined. Moreover, during rotation of the toner container 32, the cylindrical container opening 33*a* functions as a rotation axis portion and the container setting portion 615 functions as a bearing. In this case, the position at which the container opening 33*a* makes a slidable contact with the container setting portion 615 and the toner container 32 is aligned with respect to the toner replenishing device 60 is indicated by "α" in FIG. 13.

As illustrated in FIG. 16 and other figures, the nozzle shutter 612 includes the nozzle shutter flange portion 612*a* and a nozzle shutter cylinder portion 612*e*. A first shutter inner circumference rib 612*b* is provided on a portion of the inner circumferential surface near the nozzle front end of the nozzle shutter cylinder portion 612*e*. On the other hand, a second shutter inner circumference rib 612*c* and a third shutter inner circumference rib 612*d* are provided on the entire inner circumferential surface near the nozzle base end of the nozzle shutter cylinder portion 612*e*.

The length in the circumferential direction of the inner circumferential surface of the first shutter inner circumference rib 612*b* is set such that the first shutter inner circumference rib 612*b* can be fitted to the nozzle opening 610 in a state where the nozzle shutter 612 is attached to the conveying nozzle 611.

As illustrated in FIGS. 11 and 18, the nozzle base end of the nozzle shutter spring 613 bumps against a container-setting-portion end surface 615*b* which is an end surface of the container setting portion 615. Moreover, the nozzle front end of the nozzle shutter spring 613 bumps against the nozzle shutter spring receiving surface 612*f* of the nozzle shutter flange portion 612*a*. In this case, since the nozzle shutter spring 613 is compressed more than its natural length, the nozzle shutter 612 receives biasing force in the removal direction (the left direction in FIG. 18) from the nozzle front end side. However, the first shutter inner circumference rib 612*b* bumps against an edge, that is, an upper portion of a nozzle-front-end-side inner wall surface 611*b* which is an inner wall surface of the sheet member guide 611*a* of the conveying nozzle 611, on the nozzle front end side of the nozzle opening 610. Due to this, the nozzle shutter 612 is prevented from moving in the removal direction from the conveying nozzle 611 further than the state illustrated in FIGS. 18 and 19. With the bumping of the first shutter inner circumference rib 612*b* and the biasing force of the nozzle shutter spring 613, the position in the rotation axis direction of the nozzle shutter 612 in relation to the conveying nozzle 611 is determined.

A first inner-circumference-rib front end 612*g* which is an end in the circumferential direction of the first shutter inner circumference rib 612*b* has such a shape that it bumps against a nozzle-opening transversal edge 611*s* which is an edge in the transverse direction of the nozzle opening 610. This shape allows the first inner-circumference-rib front end 612*g* to bump against the nozzle-opening transversal edge 611*s* when the nozzle shutter 612 rotates in the direction indicated by arrow A in FIG. 19.

When the toner container 32 rotates, force that allows the nozzle shutter 612 to rotate in the direction indicated by arrow A in FIG. 19 acts on the nozzle shutter 612 of which the outer circumferential surface of the nozzle shutter cylinder portion 612*e* makes contact with the inner circumferential surface of the container seal 333 attached to the toner container 32. In this case, when the nozzle shutter 612 rotates in relation to the conveying nozzle 611 and the first shutter inner circumference rib 612*b* is separated from the nozzle opening 610, the following problem may occur. That is, when the toner replenishing device 60 is detached from the toner container 32, the nozzle shutter 612 may be removed from the conveying nozzle 611 by the biasing force of the nozzle shutter spring 613.

Moreover, depending on the elasticity of the nozzle shutter 612, the first shutter inner circumference rib 612*b* separated from the nozzle opening 610 may tightly fasten the outer circumferential surface of the conveying nozzle 611 to make the nozzle shutter 612 immovable in relation to the conveying nozzle 611. In any case, when the toner container 32 is detached from the toner replenishing device 60, the nozzle opening 610 is open, which can cause toner leakage.

In contrast, in the toner replenishing device 60 of the present embodiment, when the nozzle shutter 612 rotates in the direction indicated by arrow A in FIG. 19, the first inner-circumference-rib front end 612*g* bumps against the nozzle-opening transversal edge 611*s*. As a result, the nozzle shutter 612 is prevented from rotating in relation to the conveying nozzle 611 further from the state illustrated in FIG. 19.

Moreover, the inner diameter of the second and third shutter inner circumference ribs 612*c* and 612*d* is slightly smaller than the outer diameter of the cylindrical conveying nozzle 611. Moreover, the second and third shutter inner circumference ribs 612*c* and 612*d* are elastically deformed so that the nozzle shutter 612 can be attached to the conveying nozzle 611. In a state where the two ribs (612*c* and 612*d*) having a smaller inner diameter than the outer diameter of the conveying nozzle 611, since the inner circumferential surface of the nozzle shutter 612 makes contact with the outer circumferential surface of the conveying nozzle 611, it is possible to enhance air-tightness between the inner circumferential surface of the nozzle shutter 612 and the outer circumferential surface of the conveying nozzle 611. Thus, it is possible to prevent toner leakage between the nozzle shutter 612 and the conveying nozzle 611.

Moreover, the toner replenishing device 60 of the present embodiment uses a conical spring as the nozzle shutter spring 613. A conical spring can allow at least a portion of neighboring coils to overlap when the spring is compressed, and it is possible to shorten the length in the rotation axis direction in the compressed state. Thus, it is possible to decrease the space in the rotation axis direction of the nozzle shutter spring 613 in the compressed state.

Next, the process of attaching the toner container 32 to the toner replenishing device 60 will be described.

First, as illustrated in FIG. 7, the cap 370 is detached from the toner container 32 having the cap 370 attached thereto to create a state illustrated in FIG. 6.

Subsequently, the toner container 32 is moved toward the toner replenishing device 60 as indicated by arrow Q in FIGS. 9 and 11 so that the conveying nozzle 611 is inserted into the nozzle insertion opening 331 and the sheet member guide 611*a* makes contact with the front end-side surface of the elastic sheet 332.

When the toner container 32 is moved further toward the toner replenishing device 60 so that the conveying nozzle 611 is inserted in such a manner to expand the sheet overlapping portion 332*c* positioned at the center of the elastic sheet 332. Specifically, as illustrated in FIG. 12, the sheet member guide 611*a* of the conveying nozzle 611 presses the elastic sheet 332 to elastically deform the elastic sheet 332. With this elastic deformation, the sheet overlapping portion 332*c* of the two elastic sheets 332 is expanded, and the sheet member guide 611*a* of the conveying nozzle 611 passes through a portion of the nozzle insertion opening 331 blocked by the elastic sheet 332. In this case, the nozzle shutter cylinder portion 612*e* of the nozzle shutter 612 located closer to the nozzle front end side than the nozzle shutter flange portion 612*a* is inserted into the nozzle insertion opening 331 together with the conveying nozzle 611.

When the toner container 32 is moved further toward the toner replenishing device 60, the nozzle shutter cylinder portion 612*e* and the conveying nozzle 611 are inserted deeper into the nozzle insertion opening 331. As a result, the surface of the nozzle shutter flange portion 612*a* opposite to the nozzle shutter spring receiving surface 612*f* makes contact with the front end surface of the container seal 333.

When the toner container 32 is moved further toward the toner replenishing device 60 from this state, the toner container 32 bumps into the nozzle shutter bumping rib 337*a* while slightly squeezing the container seal 333. As a result, the relative position in the rotation axis direction of the nozzle shutter 612 to the toner container 32 is attached.

When the toner container 32 is moved further toward the toner replenishing device 60, the conveying nozzle 611 is inserted further into the toner container 32. In this case, the nozzle shutter 612 bumping against the nozzle shutter bumping rib 337*a* is pushed back toward the nozzle base side in relation to the conveying nozzle 611. As a result, the nozzle shutter spring 613 is contracted and the relative position of the nozzle shutter 612 in relation to the conveying nozzle 611 moves toward the nozzle base side. With the movement of the relative position, the nozzle opening 610 covered by the nozzle shutter 612 is exposed inside the container body 33 and the container body 33 and the conveying nozzle 611 communicate with each other.

In the state where the conveying nozzle 611 is inserted into the nozzle insertion opening 331, due to the biasing force of the nozzle shutter spring 613 in the contracted state, force that causes the toner container 32 to be pushed backward (the direction opposite to the arrow Q in the figure) acts on the toner replenishing device 60. However, when the toner container 32 is attached to the toner replenishing device 60, the container engaged portion 339 resists against this force to move the toner container 32 toward the toner replenishing device 60 up to such a position that the container engaged portion 339 engages with the replenishing device-side engaging member 609. As a result, the biasing force of the nozzle shutter spring 613 and the hooking force of the container engaged portion 339 in relation to the replenishing device-side engaging member 609 are applied. Due to the action of the biasing force and the hooking force, the position in the rotation axis direction of the toner container 32 in relation to the toner replenishing device 60 is determined in the state illustrated in FIGS. 10 and 13.

As illustrated in FIG. 9, the container engaged portion 339 for determining the position in the axial direction of the toner container 32 in relation to the toner replenishing device 60 is provided on the outer circumferential surface of the container front end cover 34. When the toner container 32 is attached to the toner replenishing device 60, the replenishing device-side engaging members 609 provided on the set cover 608 engage with the container engaged portions 339.

The container engaged portion 339 includes a guide projection 339*a*, a guide groove 339*b*, a step portion 339*c*, and an engaged opening 339*d*. Two sets of container engaged portions 339 composed of the guide projection 339*a*, the guide groove 339*b*, the step portion 339*c*, and the engaged opening 339*d* are disposed in the container front end cover 34. Specifically, when the toner container 32 is seen from the front side, the container engaged portions 339 are disposed in pair on both sides of the container front end cover 34 with respect to a straight line passing through the nozzle insertion opening 331.

Each guide projection 339*a* is provided on a vertical planar surface that is orthogonal to the longitudinal direction of the toner container 32 on the container front end side of the container front end cover 34 and that passes the center of the rotation axis of the container body 33. The guide projections 339*a* have slope surfaces that make contact with the replenishing device-side engaging members 609 during attachment of the toner container 32 and that are adjoined to the guide grooves 339*b* so that the replenishing device-side engaging members 609 can be guided toward the guide grooves 339*b*. This slope surface has such a shape that a container front end side is on the inner side than the outer circumferential surface of the container front end cover 34 and is provided so as to be adjoined to the guide groove 339*b*. The guide grooves 339*b* are grooves provided on the outer circumferential surface of the container front end cover 34 and are slid surfaces on which the replenishing device-side engaging members 609 slide.

A width of the groove of each guide groove 339*b* in the direction orthogonal to the longitudinal direction is slightly larger than the width in the same direction of the replenishing device-side engaging member 609 and is set such that the replenishing device-side engaging member 609 being guided does not fall off from the guide groove 339*b*.

Moreover, each guide groove 339*b* is provided so as to extend in the longitudinal direction, and the step portion 339*c* having the same height as the outer circumferential surface of the container front end cover 34 is adjoined to an end on the container rear end side thereof. In other words, an approximately 1-mm wide outer circumferential surface of the container front end cover 34 is disposed between each guide groove 339*b* and each engaged opening 339*d*. When each replenishing device-side engaging member 609 climbs over the step portion 339*c* to enter into and engage with (fall into) the engaged openings 339*d*, the toner container 32 is set (latched) to the toner replenishing device 60. This state is the attachment state of the toner container 32.

The engaged openings 339*d* are not limited to through-holes, the engaged openings 339*d* may be bottomed holes having such a depth that the replenishing device-side engaging members 609 can engage therewith. In other words, the engaged openings 339*d* may be concave portions of which the side close to the circumferential surface of the container body 33 is blocked unless the holes do not interrupt the replenishing device-side engaging members 609 from moving to engage with the engaged openings 339*d*.

The toner container 32 has a configuration in which the nozzle insertion opening 331 is positioned at the center of a line that connects the two container engaged portions 339 on an imaginary plane orthogonal to the rotation axis. The following problem may occur unless the nozzle insertion opening 331 is positioned on the line that connects the two container engaged portions 339. That is, the biasing force of the nozzle shutter spring 613 acts on the plurality of nozzle shutter bumping ribs 337*a* arranged at an equal distance from the center of the nozzle insertion opening 331. Due to this biasing force, a moment of force that rotates the toner container 32 about the line with the distance from the line to the center of the nozzle insertion opening 331 as the arm of the moment acts. Due to the action of the moment of this force, the toner container 32 may tilt in relation to the toner replenishing device 60. In this case, the attachment load of the toner container 32 increases and a load is applied to the nozzle receiver 330.

In particular, if the toner container 32 is a new one in which toner is stored sufficiently, when the conveying nozzle 611 protruding in the horizontal direction is pushed from the rear end side of the toner container 32 so as to be inserted therein, a moment of force that rotates the toner container 32 with the weight of toner added acts. As a result, a load may be applied to the nozzle receiver 330 in which the conveying nozzle 611 is inserted, and in a worst case, the nozzle receiver 330 may be deformed or broken.

In contrast, in the toner container 32 of the present embodiment, the center of the nozzle insertion opening 331 is positioned on the line that connects the two container engaged portions 339. Thus, it is possible to prevent the toner container 32 from tilting in relation to the toner replenishing device 60 by the biasing force of the nozzle shutter spring 613 acting at the central position of the nozzle insertion opening 331.

As illustrated in FIG. 13, a configuration in which a circular end surface of the container opening 33*a* which is the front end of the toner container 32 does not make contact with the container-setting-portion end surface 615*b* in a state where the toner container 32 is attached to the toner replenishing device 60 is realized. This is because of the following reasons. A configuration in which the circular end surface of the container opening 33*a* makes contact with the container-setting-portion end surface 615*b* will be taken into consideration. In such a configuration, the circular end surface of the container opening 33*a* may bump against the container-setting-portion end surface 615*b* of the container setting portion 615 before the engaged opening 339*d* of the container engaged portion 339 is engaged to the replenishing device-side engaging member 609. When this bumping occurs, the toner container 32 cannot be moved further toward the toner replenishing device 60, and the positioning in the rotation axis direction of the toner container 32 in relation to the toner replenishing device 60 cannot be realized. To prevent this, a small gap is provided between the circular end surface of the container opening 33*a* and the container-setting-portion end surface 615*b* of the container setting portion 615 in a state where the toner container 32 is attached to the toner replenishing device 60.

Moreover, in a state where the position in the rotation axis direction of the toner container 32 in relation to the toner replenishing device 60 is determined, the outer circumferential surface of the container opening 33*a* is slidably fitted to the container-setting-portion inner circumferential surface 615*a*. Thus, as described above, the position of the toner container 32 in relation to the toner replenishing device 60 in the planar direction orthogonal to the rotation axis is determined. As a result, the attachment of the toner container 32 to the toner replenishing device 60 is completed.

In a state where attachment of the toner container 32 is completed, when the driving motor 603 is rotation driven, the container body 33 of the toner container 32 and the conveying screw 614 in the conveying nozzle 611 rotate.

When the container body 33 rotates, the toner in the container body 33 is conveyed to the front end side of the container body 33 by the spiral projection 302. The toner having reached the scooping portion 304 with the conveying is scooped up to above the nozzle opening 610 by the movement of the scooping portion 304 due to rotation of the container body 33. When the toner scooped up to above the nozzle opening 610 falls into the nozzle opening 610, the toner is supplied into the conveying nozzle 611. The toner supplied into the conveying nozzle 611 is conveyed by the conveying screw 614 and is replenished into the developing device 50 through the falling path defining portion 64.

Here, a configuration in which toner is scooped upward by the scooping portion 304 of the container body 33 and falls into the nozzle opening 610, and the toner is supplied into the conveying nozzle 611 will be described in detail.

First, the problem associated with the time of supplying toner from the toner container 32 to the conveying nozzle 611 will be described. In a state where toner is sufficient in the container body 33, for example, immediately after the toner container 32 is attached to the toner replenishing device 60, an overflowably large amount of toner is continuously supplied to the nozzle opening 610 of the conveying nozzle 611. Thus, the extension portion 335*a* is rotated to cross above the nozzle opening 610 to drop the overflowing toner, and the conveying screw 614 is controlled to rotate intermittently. In this way, it is possible to replenish a desired amount of toner to the developing device 50.

On the other hand, when the amount of toner in the container body 33 decreases with the elapse of use time, the proportion of the amount of toner leaking through a gap between the end on the rotation center side of the scooping wall surface 304*f* and the conveying nozzle 611 to the amount of toner moving from the scooping portion 304 to the nozzle opening 610 increases. As a result, the amount of toner that can be replenished to the developing device 50 decreases. When the amount of toner that can be replenished to the developing device 50 decreases, since the toner density of the developer G in the developing device 50 becomes unstable, the need to replace the toner container 32 arises. In this state, since a large amount of toner remains in the container body 33, a problem that large amount of toner remains in the toner container 32 during replacement occurs.

Figure 30:
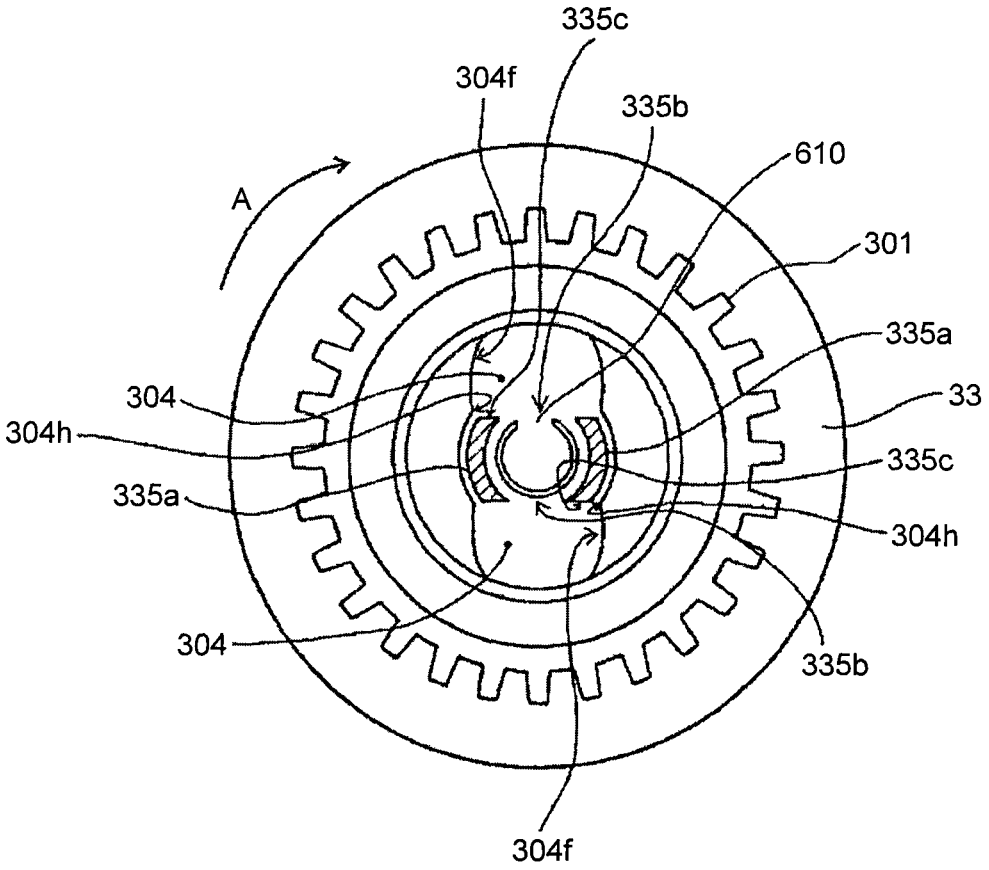
FIG. 30 is a cross-sectional view illustrating a cross-section orthogonal to a rotation shaft at the position of a scooping portion.

FIG. 30 is a cross-sectional view illustrating a cross-section orthogonal to the rotation axis at which the position in the rotation axis direction of the container body 33 attached to the nozzle receiver 330 is at the position of the scooping portion 304.

The present invention includes the following inventions. That is, as illustrated in FIG. 30, in the toner container 32, the outer circumferential surface of the extension portion 335*a* faces the inner wall surface of the container body 33 closer to the upstream side than the convex portion 304*h* in a state where the nozzle receiver 330 is attached to the container body 33. Specifically, an inner wall surface on the upstream side in the rotation direction of the container body 33 among the inner wall surfaces divided by the convex portion 304*h* corresponding to a ridge line of a bulging portion that bulges toward the inner side of the container body 33 faces the outer circumferential surface of the extension portion 335*a*. With this configuration, the following advantages are obtained. That is, the inner wall surface on the downstream side in the rotation direction among the inner wall surfaces divided by the convex portion 304*h* of the container body 33 when seen from the surface orthogonal to the rotation axis is the scooping wall surface 304*f*. With rotation of the container body 33, the scooping wall surface 304*f* can be positioned relatively above an extension-portion opening 335*b* which is a void region where the pair of extension portions 335*a* of the sheet stopper 335 is not present. The nozzle opening 610 is always open upward. Thus, the extension-portion opening 335*b* is also positioned above at the point in time when the scooping portion 304 is positioned above with rotation of the toner container 32, and the toner scooped up by the scooping portion 304 passes through the extension-portion opening 335*b* and is supplied to the nozzle opening 610.

Further, as illustrated in FIG. 30, an extension-portion downstream end surface 335*c* which is an end surface on the downstream side in the rotation direction of the extension portion 335*a* is disposed at a position near the convex portion 304*h* protruding toward the center of rotation of the container body 33. As a result, the toner flowing downward along the scooping wall surface 304*f* falls on the extension-portion downstream end surface 335*c* and is supplied to the nozzle opening 610. In other words, the extension-portion downstream end surface 335*c* has a function of relaying the toner received from the scooping wall surface 304*f* to the nozzle opening 610.

Next, the relaying function of the extension portion 335*a* of the toner container 32 will be described.

Figure 31:
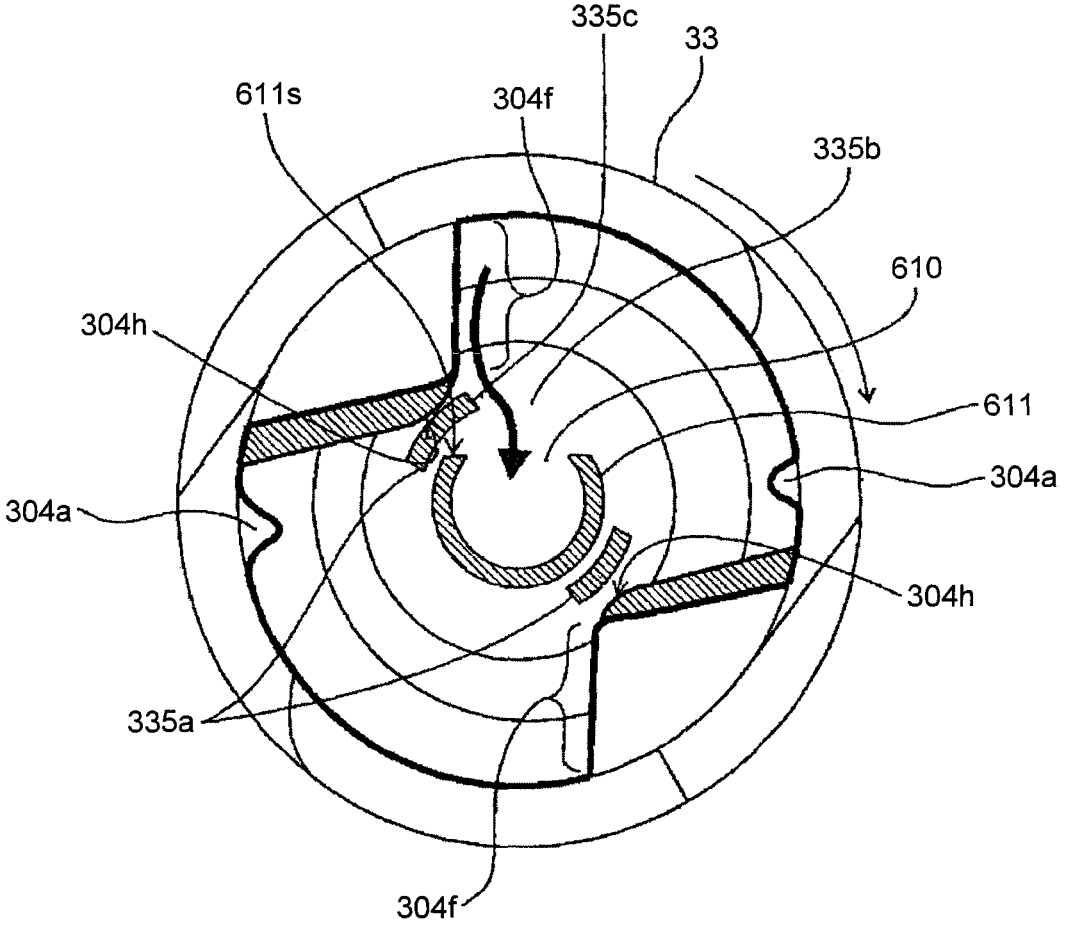
FIG. 31 is a cross-sectional view illustrating a configuration in which an extension portion in an E-E cross-section in FIG. 13 functions as a relaying means.

FIG. 31 is a cross-sectional view illustrating the container body 33 in an E-E cross-section cut at the end surface of the bearing of the conveying screw 614 on the front end side of the conveying nozzle 611 in FIG. 13.

Figure 32:
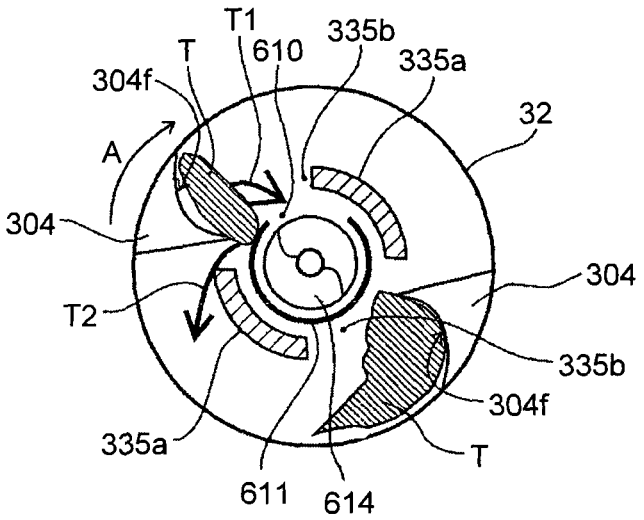
FIG. 32 illustrates cross-sectional views (schematic views) of the E-E cross-section in FIG. 13, in which (a) illustrates a configuration in which the extension portion does not function as the relaying means and (b) illustrates a configuration in which the extension portion functions as the relaying means.
Figure 32:
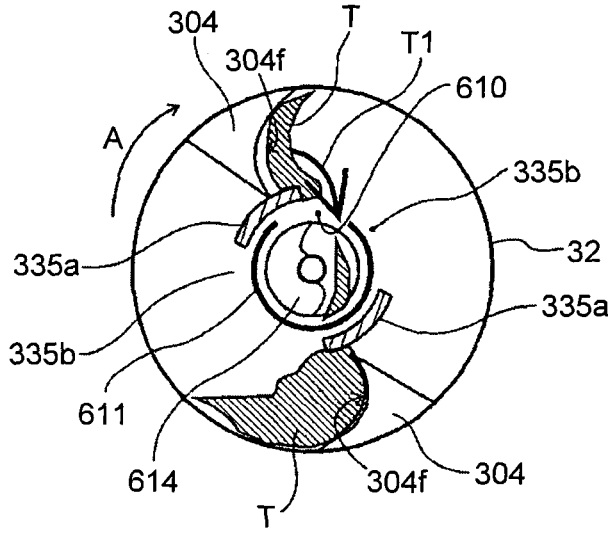

FIG. 32 illustrates the E-E cross-section in FIG. 13. FIG. 32(*a*) is a schematic functional diagram of a comparative example and is a diagram illustrating a configuration in which the extension portion 335*a* does not function as a relaying means. FIG. 32(*b*) is a schematic functional diagram of FIG. 31 and is a diagram illustrating a configuration in which the extension portion 335*a* functions as a relaying means.

First, a conventional problem will be described. As in JP-A No. 2009-276659, in a configuration in which it is possible to control the amount of toner conveyed in a conveying nozzle, toner can be conveyed stably if a sufficient amount of toner is present near the opening of the conveying nozzle. However, when the amount of toner in the toner container decreases, the amount of toner conveyed may decrease and toner may not be conveyed stably. This is because, although it is possible to move toner to the vicinity of the inlet by the spiral projection provided inside the toner container, the toner may slip off before reaching the opening of the conveying nozzle and the amount of toner entering the conveying nozzle decreases. When the amount of toner conveyed decreases and it is impossible to convey toner stably, since the toner density of the developer in the developing device becomes unstable, the need to replace the toner container arises. In this state, since a large amount of toner remains in the container body, a problem that a large amount of toner remains in the toner container during replacement occurs.

In FIG. 13, the conveying nozzle (conveying nozzle) 611 is inserted in the nozzle receiver (nozzle insertion portion) 330 in the container body 33. The nozzle opening (powder inlet) 610 of the conveying nozzle 611 inserted in the nozzle receiver 330 is open, and a state where toner can be conveyed into the toner replenishing device 60 is created.

A portion of the scooping portion 304 overlaps with the nozzle opening 610 in the longitudinal direction of the toner container 32 and another portion corresponds to the inner wall surface of the container body 33 located closer to the rear end side than the nozzle opening 610. Specifically, the scooping portion 304 includes the convex portion 304*h* that corresponds to the ridge line in which the inner wall of the container body 33 bulges in the rotation axis direction and the scooping wall surface 304*f* which is a wall surface on the downstream side in the container rotation direction among the inner wall surfaces divided by the ridge line (see FIG. 31).

As illustrated in FIG. 31, the ridge line of the convex portion 304*h* has a gently-sloping mounting shape because the container body 33 is formed by blow-molding. In FIG. 13 and other figures, the convex portion 304*h* is depicted as a curved line for convenience's sake in order to distinguish the scooping wall surface 304*f*. The scooping wall surface 304*f* is a region depicted by a grid pattern as illustrated in FIG. 13 and includes a pair of slope surfaces that connects the convex portion 304*h* and the inner circumferential surface of the container body 33 in point-symmetry about the rotation axis of the container body 33 as illustrated in FIG. 31. At the position of the E-E cross-section, since the extension direction of the wall surface on the upstream side in the container rotation direction among the inner wall surfaces divided by the ridge line is approximately identical to the cutting direction of the E-E cross-section, the wall surface has such a thickness as illustrated in FIG. 31. The convex portion 304*h* is also at the position where it seems to have its thickness.

In FIG. 31, the nozzle opening 610 that is open upward is disposed in the tubular conveying nozzle 611. The pair of extension portion 335*a* attached to the container body 33 is disposed between the conveying nozzle 611 and the convex portion 304*h* and rotates integrally with the scooping wall surface 304*f* with rotation of the container body 33. At the position (the position on the front end side of the conveying nozzle 611 and on the end surface of the bearing of the conveying screw 614) of the E-E cross-section, the convex portion 304*h* and the extension portion 335*a* face each other. Moreover, the scooping wall surface 304*f*, the extension-portion downstream end surface 335*c* of the extension portion 335*a*, and the nozzle-opening transversal edge 611*s* on the upstream side in the rotation direction of the nozzle opening 610 are disposed when seen from the downstream side in the container rotation direction.

Similarly to the scooping action described with reference to FIG. 30, the toner is also moved as indicated by arrow T1 toward the nozzle opening 610 which is an opening of the conveying nozzle 611 by the scooping portion 304 configurated by the scooping wall surface 304*f* of the container body 33 of FIG. 31. In this case, the outer circumferential surface and the extension-portion downstream end surface 335*c* of the extension portion 335*a* function as a toner relaying portion that relays toner from the scooping portion 304 to the nozzle opening 610.

As illustrated in FIG. 31, the inner diameter of the extension portion 335*a* is larger than the outer diameter of the conveying nozzle 611. Due to this, the conveying nozzle 611 having passed through a region where it makes contact with the container seal 333 is prevented from making contact with the inner circumferential surface of the extension portion 335*a*, and a load is rarely applied when the conveying nozzle 611 is inserted into the container body. Since the container seal 333 having a smaller inner diameter than the outer diameter of the conveying nozzle 611 is provided in the nozzle receiver 330, the toner in the container body 33 is prevented from leaking outside the container body 33 along the outer circumferential surface of the conveying nozzle 611. As a result, it is possible to prevent leakage of toner along a path other than a toner conveying path in which toner is conveyed from the container body 33 toward the developing device 50 through the conveying nozzle 611.

Details of the relaying function will be described with reference to the schematic diagrams of FIG. 32.

FIG. 32(*a*) illustrates the flow of toner inside the container body 33 when the extension portion 335*a* is disposed so as not to have the relaying function. With rotation of the container body 33 in the direction indicated by arrow A in the figure, the toner scooped upward by the scooping wall surface 304*f* along the circumferential direction of the container body 33 flows toward the nozzle opening 610 due to gravity (see arrow T1). However, some toner may leak from the gap between the conveying nozzle 611 and the convex portion 304*h* (the convex portion protruding toward the center of rotation of the scooping wall surface 304*f*) (see arrow T2).

More specifically, the state of FIG. 32(*a*) is a state where the scooping wall surface 304*f* has not come sufficiently up to the upper side and the convex portion 304*h* is near, the 9 o'clock position of a clock. In this case, the upstream-side nozzle-opening transversal edge 611*s*, the convex portion 304*h* of the scooping wall surface 304*f*, and the downstream-side end surface of the extension portion 335*a* are arranged in that order when seen from the downstream side in the rotation direction of the container body 33. In such a state, the end surface of the intermediate extension portion 335*a* is always later than the convex portion 304*h* of the scooping wall surface 304*f* that tries to relay toner and the toner relaying function cannot be obtained. Due to this delay, some toner leaks from the gap provided between the conveying nozzle 611, the convex portion 304*h*, and the extension portion 335*a*. As a result, a problem that the replenishing speed becomes unstable and the amount of toner remaining in the container body 33 during replacement of the toner container 32 increases occurs.

FIG. 32(*b*) illustrates the flow of toner inside the container body 33 having the extension portion 335*a* that functions as a relaying means.

The flow of toner until the toner scooped along the circumferential direction of the container body 33 by the scooping wall surface 304*f* flows toward the nozzle opening 610 due to gravity with rotation of the container body 33 in the direction indicated by arrow A in the figure is the same as the configuration illustrated in FIG. 32(*a*). However, in the configuration illustrated in FIG. 32(*b*), the extension portion 335*a* is disposed so as to block the gap between the conveying nozzle 611 and the convex portion 304*h* (the convex portion protruding toward the center of rotation of the scooping wall surface 304*f*). As a result, the extension-portion downstream end surface 335*c* of the extension portion 335*a* and the convex portion 304*h* of the scooping portion 304 are arranged in that order when seen from the downstream side in the rotation direction of the container body 33.

Due to such an arrangement, the flow of toner as indicated by arrow T2 in FIG. 32(*a*) is suppressed, and the pumped toner enters into the nozzle opening 610 efficiently. Due to this, even when the amount of toner in the container body 33 decreases, the replenishing speed is stable and the amount of toner remaining in the container body 33 during replacement of the toner container 32 can be reduced. Moreover, since the amount of toner remaining in the container body 33 during replacement can be reduced, it is possible to reduce a running cost, improve cost performance, and reduce the amount of wasted toner to reduce an adverse effect on environment.

The force that causes the gap between the conveying nozzle 611 and the convex portion 304*h* to be blocked does not strong enough to allow the extension portion 335*a* and the convex portion 304*h* to make close contact with each other. However, a small gap (approximately 0.3 mm to 1 mm) may be provided between the extension portion 335*a* and the convex portion 304*h* so that toner is present in the convex portion 304*h* on the lower side of FIG. 32(*b*) if the leakage of toner as indicated by arrow T2 can be prevented. This is because a smaller gap may be clogged with toner to play the role of a seal by the operation when a large amount of toner is present at the start of toner replenishment. Moreover, since the scooping wall surface 304*f* is formed by blow-molding which cannot provide higher dimensional accuracy than injection molding, it is difficult to attain perfect close-contact, and it is desirable to have a small gap from the perspective of mass-productivity.

Figure 33:
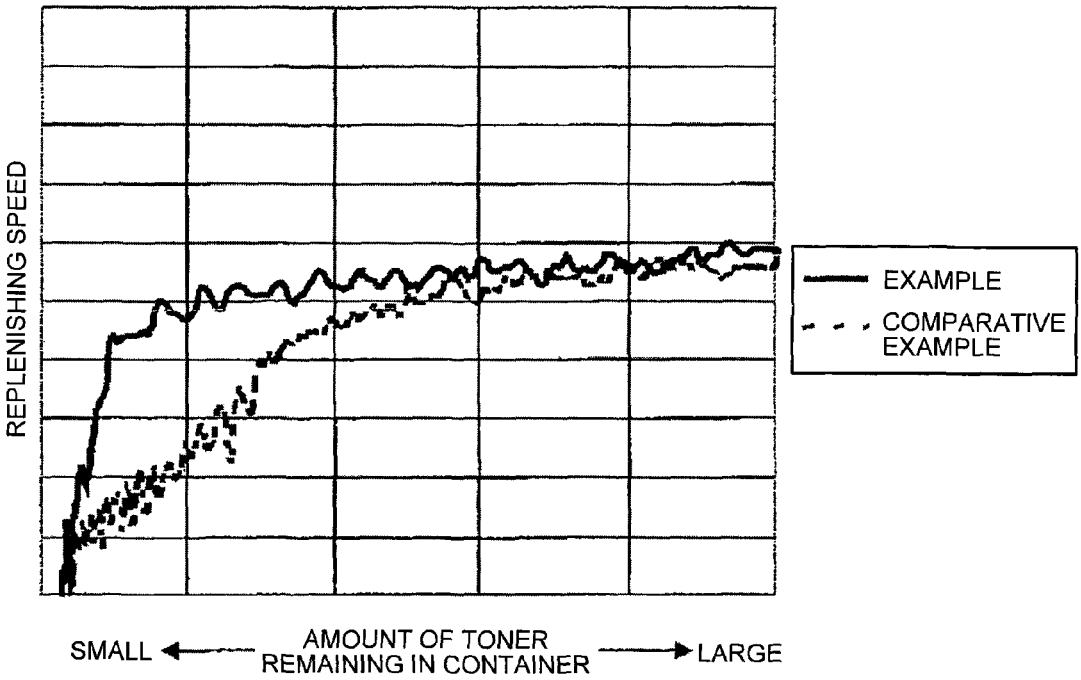
FIG. 33 is a graph illustrating a relation between an amount of toner remaining in the container and a toner replenishing speed according to Example and Comparative Example.

FIG. 33 is a graph illustrating the relation between the amount of toner remaining in a container and the replenishing speed (the amount of toner replenished per unit time) of the example (the configuration illustrated in FIGS. 31 and 32(*b*)) and the comparative example (the configuration illustrated in FIG. 32(*a*)).

It can be understood from FIG. 33 that the example maintains a stable replenishing speed even when the amount of toner remaining in the container decreases whereas the comparative example shows a decrease in the replenishing speed when the amount of toner remaining in the container. This is because in the comparative example without the relaying member, toner passes (slides off) through a gap provided between an end on the center of rotation of the scooping wall surface 304*f* which is a portion of the container body 33 and the conveying nozzle 611. Thus, when the amount of remaining toner is small, a sufficient amount of toner cannot reach the nozzle opening 610, the amount of toner supplied to the nozzle opening 610 cannot be maintained, and the replenishing speed decreases.

The toner container 32 of the example illustrated in FIGS. 13, 31, and 32(*b*) includes the following inventions. That is, two scooping wall surfaces 304*f* are provided in the container body 33, and two relaying members (the extension portions 335*a*) are provided at the positions corresponding to the scooping wall surfaces 304*f*. It is effective to provide the same number of relaying members as the number of scooping portions 304 such that three relaying members are provided when three scooping wall surfaces 304*f* are provided in the container body 33. Similarly, it is also effective to provide the same number of relaying members as the number of scooping portions 304 when four or more scooping portions 304 are provided in the container body 33.

Naturally, some of a plurality of extension portions 335*a* may correspond to the scooping wall surfaces 304*f* as the relaying members. For example, only one of two extension portions 335*a* may be used as the relaying member, and only one scooping wall surface 304*f* may be provided in the container body 33 so as to correspond to the extension portion 335*a*.

Figure 20:
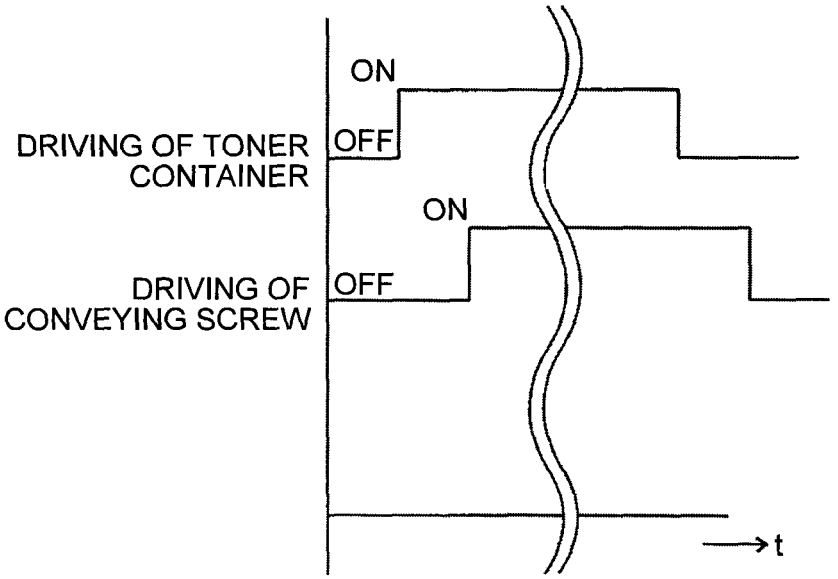
FIG. 20 is a timing chart of a configuration in which a toner container is rotated first and a conveying screw is rotated subsequently.

In the above configuration, a configuration in which the toner container 32 and the conveying screw 614 are rotated simultaneously has been described. As the timings for rotating these components, the toner container 32 may be rotation driven first at the start of toner replenishment and the conveying screw 614 may be rotated subsequently after a predetermined period. Moreover, the toner container 32 may be stopped first at the stopping of toner replenishment and the conveying screw 614 may be stopped subsequently after a predetermined period. FIG. 20 illustrates the timing chart of such a rotation timing configuration.

In the rotation timing configuration illustrated in FIG. 20, the toner container 32 starts rotation driving earlier than the conveying screw 614 at the start of toner replenishment. Thus, the conveying screw 614 can start rotation driving in a state where toner is filled near the nozzle opening 610 of the conveying nozzle 611. Due to this, since the amount of toner conveyed by one rotation of the conveying screw 614 becomes stable from the start of rotation driving of the conveying screw 614, the stability of the amount of toner replenished is improved.

Moreover, in the rotation timing configuration illustrated in FIG. 20, the toner container 32 stops rotation driving before the conveying screw 614 in the conveying nozzle 611 stops rotation driving at the stopping of toner replenishment. Due to such a rotation timing configuration, toner is continuously conveyed by the conveying screw 614 in a state where the supply of new toner to the nozzle opening 610 is stopped, and the conveying screw 614 stops rotating after a predetermined period. Due to this, the toner T present near the nozzle opening 610 of the conveying nozzle 611 when the toner container 32 stops rotation driving can be conveyed toward the falling path defining portion 64 by the conveying screw 614. As a result, the amount of toner T remaining in a state of being carried on the conveying nozzle 611 near the nozzle opening 610 can be reduced. After that, when the toner container 32 is removed from the device body, since the amount of toner on the conveying nozzle 611 is small, the conveying nozzle 611 can be cleaned easily by the elastic sheet 332 and the container seal 333 provided in the nozzle receiver 330. Thus, scattering and falling toner accompanied by attachment and detachment of the toner container 32 to and from the device body can be prevented.

Such a configuration in which the toner container 32 and the conveying screw 614 rotate at different points in time can be easily realized by using independent driving sources for rotation driving the respective components.

Moreover, when the same driving source is use, such a configuration can be realized by providing a clutch. By using the same driving source, the configuration in which the two components rotate at different points in time can be realized at a low cost.

Moreover, it is preferable that even after the toner container 32 stops rotation driving, the conveying screw 614 stops rotation driving after the conveying screw 614 is rotated at least by an amount corresponding to the amount of conveying that corresponding to the width in the longitudinal direction of the nozzle opening 610 of the conveying nozzle 611. By doing so, the toner T present near the nozzle opening 610 of the conveying nozzle 611 can be conveyed to a position closer to the falling path defining portion 64 than the position facing the nozzle opening 610. With such conveying, the toner scattering and falling when the toner container 32 is detached from the toner replenishing device 60 can be prevented more reliably.

Moreover, it is preferable that even after the toner container 32 stops rotation driving, the conveying screw 614 starts rotation driving after the toner container 32 is rotation driven at least by an amount corresponding to such an amount of conveying that the nozzle opening 610 of the conveying nozzle 611 is filled with the toner T. By doing so, the stability of the amount of toner replenished is improved further.

Further, as described above, the position at which the container opening 33*a* makes slidable contact with the container setting portion 615 and the position of the toner container 32 in relation to the toner replenishing device 60 is determined is indicated by "α" in FIG. 13. Here, the position "α" in FIG. 13 is not limited to the configuration where the position has the functions of both a sliding portion and a positioning portion but may have any one of the functions of the sliding portion and the positioning portion.

The toner container 32 of the present embodiment includes the nozzle receiver 330 that is disposed in the opening of the container body 33 so as to provide the nozzle insertion opening 331. The nozzle insertion opening 331 is a portion in which the conveying nozzle 611 having the nozzle opening 610 serving as a powder inlet is inserted.

Moreover, the elastic sheet 332 included in the toner container 32 is attached to the nozzle receiver 330 and is elastically deformed in response to operation of the conveying nozzle 611 being inserted in the nozzle receiver 330 to thereby open the nozzle insertion opening 331. Moreover, the elastic sheet 332 restores its original shape in response to operation of the conveying nozzle 611 being removed from the nozzle receiver 330 to thereby block a portion of the elastic sheet 332 expanded by the conveying nozzle 611. That is, the nozzle receiver 330 includes the elastic sheet 332 as an opening and blocking member that opens and blocks the nozzle insertion opening 331 in response to operation of inserting or pulling the conveying nozzle 611 into or from the nozzle receiver 330. Due to such a configuration, the toner container 32 can maintain a state where the nozzle insertion opening. 331 is blocked until the conveying nozzle 611 is inserted and can prevent leakage or scattering of toner in a state before the toner container 32 is attached to the toner replenishing device 60.

Further, as illustrated in FIGS. 9 and 11, the nozzle insertion opening 331 of the toner container 32 is provided in a portion, that is, a bottom portion of a columnar void portion defined by the cylindrical front end opening 305, closer to the container inner side (the rear end side) than the front end of the front end opening 305. Due to such a configuration, it is possible to suppress toner from adhering to the outer circumferential surface of the container opening 33*a* and adhering to the container-setting-portion inner circumferential surface 615*a*.

If toner adheres to the outer circumferential surface of the container opening 33*a*, when the same toner container 32 is attached to the toner replenishing device 60 again, toner remains between the container opening 33*a* and the container-setting-portion inner circumferential surface 615*a*. Moreover, when toner adheres to the container-setting-portion inner circumferential surface 615*a*, the following problems occur. That is, when a new toner container 32 is attached as well as when the same toner container 32 is attached again, toner remains between the container opening 33*a* and the container-setting-portion inner circumferential surface 615*a*. If toner remains between the container opening 33*a* and the container-setting-portion inner circumferential surface 615*a*, the positioning accuracy decreases when the position of the toner container 32 in relation to the toner replenishing device 60 is determined by the fitting of the container opening 33*a* and the container setting portion 615.

Moreover, in the case of a configuration in which the outer circumferential surface of the container opening 33*a* slides on the inner circumferential surface of the container setting portion 615, the slidability may decrease due to toner and a rotational torque of the toner container 32 may increase. Further, when the outer circumferential surface of the container opening 33*a* continuously slides on the inner circumferential surface of the container setting portion 615 in a state where toner remains therebetween, an aggregate of toner may be caused.

In the toner container 32 of the present embodiment, the front end surface of the container body 33 protrudes in the rotation axis direction further than the front end surface to which the nozzle insertion opening 331 of the nozzle receiver 330 is open. That is, in the toner container 32, the opening position of the nozzle insertion opening 331 is located closer to the container inner side (the rear end side) than the front end of the container opening 33*a* which is the opening position of the container body 33.

As described above, since the opening position of the nozzle insertion opening 331 is located at an inner position than the opening position of the container body 33, it is possible to suppress toner from adhering to the outer circumferential surface of the container opening 33*a*. This is because, when toner leakage occurs when the conveying nozzle 611 is removed from the toner container 32, the toner scattering after having leaked from the nozzle insertion opening 331 can rarely flow around the front end of the front end opening 305. Moreover, since the toner leaking and falling from the nozzle insertion opening 331 is caught on the inner circumferential surface on the lower side of the front end opening 305, it is possible to prevent toner from adhering to the container-setting-portion inner circumferential surface 615*a*. As described above, since the toner leaking from the nozzle insertion opening 331 can be stored in a region surrounded by the inner circumferential surface located closer to the container inner side (the rear end side) than the front end surface of the front end opening 305, it is possible to suppress toner from scattering out of the toner container 32.

As illustrated in FIGS. 11 and 13, in the present embodiment, the container setting portion 615 of the toner replenishing device 60 is away from the opening (the nozzle opening 610 or the nozzle insertion opening 331) where scattering toner is likely to occur before and after the toner container 32 is attached. Moreover, the front end of the front end opening 305 of the toner container 32 is away from the opening (the nozzle opening 610 or the nozzle insertion opening 331) where scattering toner is likely to occur before and after the toner container 32 is attached. Thus, it is possible to prevent toner from leaking from the nozzle insertion opening 331 before the toner container 32 is attached and from contact portions of the container seal 333 and the conveying nozzle 611 in a state where the toner container 32 is attached to the toner replenishing device 60. Further, the container setting portion 615 of the toner replenishing device 60 is away from the nozzle opening 610 when the toner container 32 is attached or detached. Moreover, the front end of the front end opening 305 of the toner container 32 is away from the elastic sheet 332.

As described above, the positioning in a direction orthogonal to the rotation axis, of the toner container 32 in relation to the toner replenishing device 60 is realized by the fitting of the outer circumferential surface of the container opening 33*a* and the container-setting-portion inner circumferential surface 615*a* of the container setting portion 615. That is, the outer circumferential surface of the container opening 33*a* of the container body 33 is a positioning portion that realizes alignment with respect to the toner replenishing device 60 which is a powder conveying device. Thus, when a toner contamination remains on the outer circumferential surface of the container opening 33*a*, the fitting state of the outer circumferential surface with respect to the inner circumferential surface of the container setting portion 615 may change and the positioning accuracy may decrease. In contrast, since the toner container 32 of the present embodiment can suppress toner from reaching the outer circumferential surface of the container opening 33*a*, the positioning accuracy of the toner container 32 in relation to the toner replenishing device 60 is stabilized.

Further, the contact portions of the outer circumferential surface of the container opening 33*a* and the inner circumferential surface of the container setting portion 615 are such a relation that the contact portions slide on each other when the toner container 32 rotates. That is, the outer circumferential surface of the container opening 33*a* of the container body 33 which is a powder storage member is a sliding portion that slides on the toner replenishing device 60 which is a powder conveying device. When toner enters into the sliding portion, sliding load may increase and a rotational torque of the toner container 32 may increase. In contrast, the toner container 32 of the present embodiment can suppress toner from reaching the outer circumferential surface of the container opening 33*a* and suppress toner from entering into the contact portion that makes contact with the inner circumferential surface of the container setting portion 615. Thus, since an increase in the sliding load is suppressed and the slidability is stabilized, it is possible to suppress an increase in the rotational torque of the toner container 32. Moreover, since it is possible to suppress toner from entering into the sliding portion, it is possible to suppress formation of an aggregate of toner, which may be formed when toner is pressed and hardened by the sliding portion.

As described above, in the toner container 32 of the present embodiment, the outer circumferential surface of the container opening 33*a* of the container body 33 serving as a powder storage member is a positioning portion and a sliding portion in relation to the toner replenishing device 60. Moreover, since it is possible to suppress toner from adhering to the outer circumferential surface of the container opening 33*a*, the toner container 32 of the present embodiment provides stable positioning accuracy in relation to the toner replenishing device 60 and provides stable slidability during rotation.

Moreover, as described above, when the toner container 32 is attached to the toner replenishing device 60, the container seal 333 is squeezed by the nozzle shutter flange portion 612*a*. As a result, the nozzle shutter flange portion 612*a* is closely compressed by the container seal 333, and toner leakage can be prevented more reliably. Since the elastic sheet 332 is disposed closer to the inner side (the rear end side) in the longitudinal direction than the opening position, a columnar void portion is provided extending from the front end of the toner container 32 to the front end surfaces of the elastic sheet 332 and the container seal 333.

The nozzle opening 610 of the conveying nozzle 611 is closed by the nozzle shutter 612 in a state where the toner container 32 is not attached to the toner replenishing device 60. Moreover, in a state where the toner container 32 is attached to the toner replenishing device 60, it is necessary to open the nozzle shutter 612 to create a state where toner can be received therein.

In the toner replenishing device 60, a columnar void portion is provided extending from the front end of the front end opening 305 to the front end surfaces of the elastic sheet 332 and the container seal 333. An entire portion or a portion of a withdrawal space of the nozzle shutter 612 when the nozzle shutter 612 is opened is received in the void portion. Moreover, a columnar void portion is provided extending from the front end of the front end opening 305 to the front end surfaces of the elastic sheet 332 and the container seal 333. An entire portion or a portion of the nozzle shutter spring 613 for shutting the nozzle shutter 612 is accommodated in the void portion. Due to such a configuration, an arrangement space of the nozzle shutter 612 and the nozzle shutter spring 613 can be decreased.

As illustrated in FIG. 13, in the present embodiment, in a state where the toner container 32 is attached to the toner replenishing device 60, a withdrawal position of the nozzle shutter 612 is such that a portion closer to the nozzle front end side than the nozzle shutter flange portion 612*a* is positioned inside the container seal 333. A portion closer to the nozzle base side than the nozzle shutter flange portion 612*a* is approximately received in the columnar void portion provided so as to extend from the opening position (the front end) of the front end opening 305 to the front end surface of the container seal 333. Further, the nozzle shutter spring 613 in the compressed state is approximately received in the columnar void portion.

With such a configuration, it is possible to shorten the distance from the opening position of the front end opening 305 which is the frontmost end of the toner container 32 to a toner falling portion (a position at which the falling path defining portion 64 is connected to the conveying nozzle 611) of the toner replenishing device 60. In this way, it is possible to decrease the size of the device body.

As described with reference to FIGS. 16 to 22, the first shutter inner circumference rib 612*b* bumps against an edge, that is, an upper portion of the inner wall surface of the sheet member guide 611*a* of the conveying nozzle 611, on the nozzle front end side of the nozzle opening 610 in a state where the nozzle shutter 612 is closed. As a result, the first shutter inner circumference rib 612*b* performs a function of preventing removal of the nozzle shutter 612. Moreover, the first shutter inner circumference rib 612*b* performs a function of stopping rotation of the nozzle shutter 612 in such a manner that the first inner-circumference-rib front end 612*g* which is an end in the circumferential direction thereof bumps against the nozzle-opening transversal edge 611*s* which is a transversal edge of the nozzle opening 610. The same function of stopping rotation of the nozzle shutter 612 is also achieved in a state where the toner container 32 is attached to the toner replenishing device 60.

Moreover, as described above, the inner diameter of the second and third shutter inner circumference ribs 612*c* and 612*d* is slightly smaller than the outer diameter of the conveying nozzle 611. As an example, when the outer diameter of the conveying nozzle 611 is ϕ15 mm, the inner diameter of the second shutter inner circumference ribs 612*c* and 612*d* may be set to between approximately ϕ4.8 mm and 14.9 mm. In this manner, the second and third shutter inner circumference ribs 612*c* and 612*d* having a columnar shape of which the inner diameter is slightly smaller than the outer diameter of the conveying nozzle 611 are provided on the inner circumferential surface of the nozzle shutter 612. As a result, it is possible to cover the gap between the inner circumferential surface of the nozzle shutter 612 and the outer circumferential surface of the conveying nozzle 611 and to obtain a toner sealing function without a sealing member. Thus, it is possible to obviate the need of a sealing member such as sponge or rubber.

Since it is not necessary to use a sealing member separately from the nozzle shutter 612, it is possible to reduce the cost while preventing toner leakage.

Figure 29:
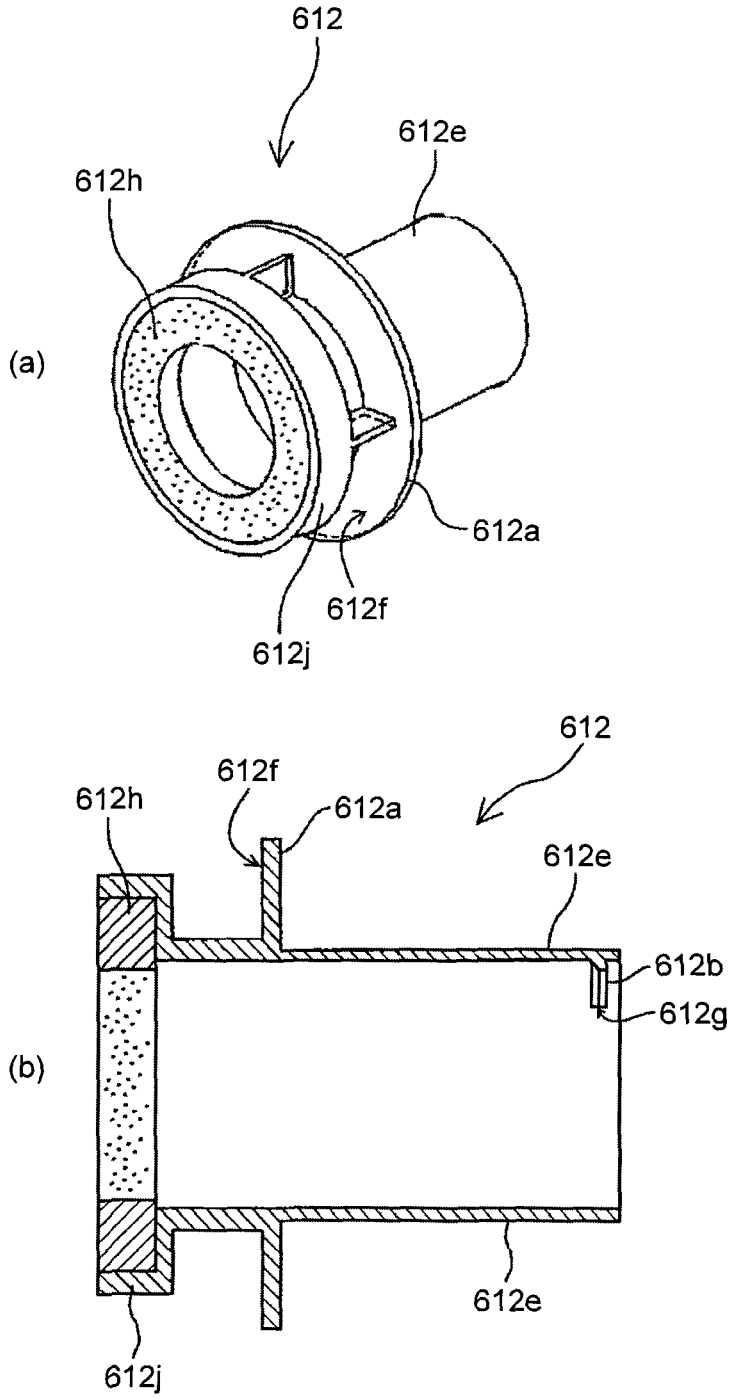
FIG. 29 illustrates a nozzle shutter having a donut-shaped sealing member, in which (a) is a perspective view and (b) is a cross-sectional view.

As a configuration of preventing toner leakage, a donut-shaped sealing member may be disposed instead of the second and third shutter inner circumference ribs 612*c* and 612*d*. However, since the gap between the inner circumferential surface of the nozzle shutter 612 and the outer circumferential surface of the conveying nozzle 611 is very narrow, the donut-shaped sealing member cannot enter into the gap. Thus, when the donut-shaped sealing member is disposed, a donut-shaped nozzle shutter sealing member 612*h* is disposed as illustrated in FIG. 29. In this case, the outer diameter of a nozzle shutter seal receiving portion 612*j* is set to be smaller than the diameter of the nozzle shutter spring 613 so that the nozzle shutter spring 613 makes contact with the nozzle shutter spring receiving surface 612*f*.

When the nozzle shutter 612 is assembled with the conveying nozzle 611, the nozzle shutter 612 needs to have a certain degree of elastic deformability in order to temporarily deform the nozzle shutter 612. This is because, if a material that is too hard to be elastically deformed, the nozzle shutter 612 may be broken without being elastically deformed during assembling. The nozzle shutter 612 is formed of a material having appropriate elasticity, and for example, when the outer shape of the conveying nozzle 611 is a cylindrical shape, the nozzle shutter 612 also has a cylindrical shape having an inner diameter slightly larger than the outer diameter of the conveying nozzle 611. Moreover, the first shutter inner circumference rib 612*b* that is a projection protruding inward is provided in an inner diameter portion of the nozzle shutter 612. By forming the first shutter inner circumference rib 612*b* so as to face the nozzle opening 610 of the conveying nozzle 611, the first shutter inner circumference rib 612*b* can function as a stopper that prevents removal and rotation of the nozzle shutter 612. A portion of the conveying nozzle 611 engaging with the projection of the nozzle shutter 612 is not limited to the nozzle opening 610, and an optional portion of the conveying nozzle 611 may engage with the projection as long as the projection provides the removal and rotation stopping function.

According to experiments of the present inventors, it is preferable that a resin material having a tensile modulus of elasticity of between 500 MPa and 2000 MPa is selected as the material of the nozzle shutter 612.

When the nozzle shutter 612 is assembled with the conveying nozzle 611, the three ribs 612*b* to 612*d* provided on the inner circumferential surface of the nozzle shutter 612 become a resistance when the conveying nozzle 611 is inserted into the nozzle shutter 612. This resistance increase particularly when the first shutter inner circumference rib 612*b* climbs over the sheet member guide 611*a* to enter into the nozzle opening 610.

In this case, if the nozzle shutter 612 is formed of a material having a certain degree of elasticity, the nozzle shutter 612 is deformed and assembling can be performed easily. Further, there is another merit that a sliding load which may increase when the second and third shutter inner circumference ribs 612*c* and 612*d* tightly fasten the conveying nozzle 611 does not increase.

Moreover, if the nozzle shutter 612 is too easily deformed, the removal and rotation stopping function of the first shutter inner circumference rib 612*b* is impaired.

The above merit can be stably obtained by selecting polyethylene or polypropylene as a material having a certain degree of elasticity used for the nozzle shutter 612. Moreover, it is preferable that the thickness of the nozzle shutter cylinder portion 612*e* of the nozzle shutter 612 is between 0.3 mm and 0.5 mm.

Since the nozzle shutter 612 has such material properties and shape as described above, it is possible to decrease the cost of a shutter mechanism that opens and blocks the nozzle opening 610.

Next, the toner container 32 during storage will be described.

The toner container 32 illustrated in FIG. 7 has the following configuration. That is, the toner container 32 is a powder container which stores toner as a powder-like developer therein and in which the cap 370 as a sealing member that seals the nozzle insertion opening 331 serving as a developer discharging opening can be attached to the container opening 33*a*. As described above, the container opening 33*a* is a portion of the container body 33, and as illustrated in FIGS. 6, 9, and 11 and other figures, the container body 33 has the container opening 33*a* provided so as to pass through the container front end cover 34 necessary when attaching the toner container 32 to the toner replenishing device 60. Due to this, the container opening 33*a* of the container body 33 can be exposed from the container front end cover 34. Moreover, since the container opening 33*a* which is a portion of the container body 33 in which toner is stored can be sealed directly by the cap 370, it is possible to improve a sealing effect and to prevent toner leakage more reliably.

In the toner container 32 of the present embodiment, cap flange portion 371 is provided in the cap 370. In a state where the cap 370 is attached to the toner container 32, as illustrated in FIG. 7, the cap flange portion 371 covers the IC tag 700 provided on the container front end cover 34. Due to this, it is possible to prevent external contact or impact on the IC tag 700 during storage of the toner container 32 and to protect the IC tag 700.

Moreover, in the toner container 32 of the present embodiment, the cap flange portion 371 of the cap 370 is larger than the outer diameter of the container front end cover 34 and the container body 33. Due to this, it is possible to prevent damage of the toner container 32 during falling and to protect the toner container 32.

Further, since the container opening 33*a* which is a portion of the container body 33 is sealed directly by the cap 370, the sealing effect is satisfactory as compared to a configuration in which the container opening 33*a* is sealed by a member (for example, the container front end cover 34) separate from the container body 33. Moreover, it is also possible to seal the container body 33 as long as the container opening 33*a* is sealed directly. Moreover, if the container body 33 can be sealed, it is possible to prevent air or moisture from entering into the container body 33 and to reduce the amount of material for packaging the toner container 32 during storage.

When the toner container 32 is used (the toner container 32 is attached to the toner replenishing device 60), the cap 370 is removed. An optional method such as a screw method or a hook method may be used as a method of attaching the cap 370 to the toner container 32 is not particularly limited as long as the cap 370 can be attached. In this case, an attached portion of the toner container 32 such as a screw thread of the screw method or a hook portion of the hook method is provided on the outer circumferential surface of the container opening 33*a* exposed from the container front end cover 34. In the toner container 32 of the present embodiment, a screw thread is provided on the outer circumferential surface of the container opening 33*a*, and a screw method is employed as a method of attaching the cap 370 to the toner container 32.

Moreover, in the case of a configuration in which the toner container 32 is sealed by the cap 370, the degree of adhesion between the container opening 33*a* of the toner container 32 and the cap 370 may be enhanced using a packing material or the like. By enhancing the degree of adhesion, it is possible to prevent air or moisture from entering into the container body 33.

Here, the problems of the conventional toner container in which the space (the container body) in which toner is stored cannot be sealed directly by a sealing member will be described.

In recent years, with a decrease in the fixing temperature and the toner particle size, the toner used in an image forming apparatus tends to deteriorate in heat resistance performance. For example, when the toner is exposed to a high temperature environment during transportation, the toner aggregates, and in a worst case, the toner is solidified, and it is impossible to supply the toner from a toner container to the image forming apparatus. It is known that the aggregation and solidification of toner occurs remarkably easily when humidity increases at the same temperature environment. Toner containers are supplied to users in various routes, and it is difficult to manage the environments of the supply routes. For example, although toner containers are transported via land, airline, and sea, it is difficult to manage the temperature and humidity of such environments.

Although a method that uses a container for controlling a transportation environment may be used as a countermeasure against such a problem, it is impossible to deal with all transportation routes and this incurs a lot of cost. With regard to such a problem, since the toner container 32 of the present embodiment can seal the container opening 33*a* which is a portion of the container body 33 directly by the cap 370, it is possible to improve the sealing effect and to prevent toner leakage more reliably. Further, since the sealing effect is improved, the toner container 32 during storage is rarely affected by the external environment.

Moreover, since the toner container 32 can be attached to the toner replenishing device 60 when the cap 370 is removed, it is possible to provide the toner container 32 that is easy to use.

Further, since the cap 370 has such a shape that protects the IC tag 700 and the toner container 32, it is possible to reduce a cushioning material and an individual packing box for packing the toner container 32 and to reduce the size of the package. Thus, it is possible to reduce an environmental load by reducing the materials used.

Moreover, after the toner container 32 which is a powder container is supplied to users, the toner container 32 is usually handled by users. Since there is no particular method of regulating the way the toner container is handled, the toner container 32 may sometimes be handled violently. Thus, a sufficient countermeasure against vibration and dropping needs to be taken so that toner leakage does not occur even when the toner container 32 is handled violently.

To prevent toner leakage, it is necessary to prevent leakage from the nozzle insertion opening 331. Moreover, to prevent this leakage, it is necessary to prevent a gap from being provided in the elastic sheet 332 that covers the nozzle insertion opening 331 formed by the container seal 333 and the container seal attached wall 336.

Next, characteristic features of the toner container 32 of the present invention illustrated in the first embodiment will be described.

Example 1

A toner container 32 according to Example 1 of the present embodiment has a plurality of elastic sheets 332 which is disposed so as to overlap at least partially. More specifically, at least two of the plurality of elastic sheets are disposed so as to overlap at least partially over the entire area of the nozzle insertion opening 331 in a diametric direction of the nozzle insertion opening 331 which is a nozzle insertion opening of the nozzle receiver 330. Further, it is preferable that the two elastic sheets are disposed so as to overlap at least partially over the entire area of the front end opening 305 in the diametric direction of the front end opening 305.

Figure 21:
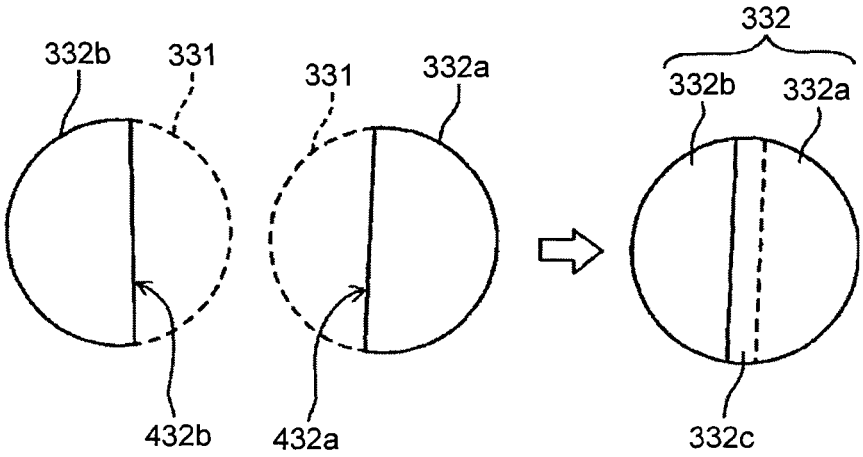
FIG. 21 is a diagram illustrating an elastic sheet according to Example 1 of the first embodiment.
Figure 22:
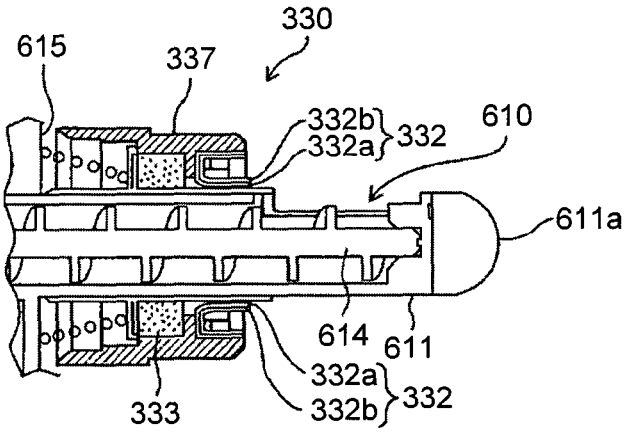
FIG. 22 is an enlarged cross-sectional view of a nozzle receiver and a conveying nozzle in a state where the toner container of the first embodiment is attached to the toner replenishing device.
Figure 23:
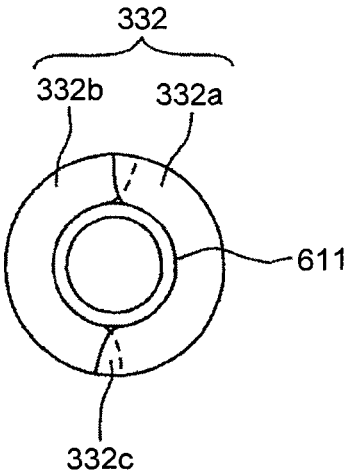
FIG. 23 is a front view when an elastic sheet according to Example 1 of the first embodiment seen from a front end side in a state where the toner container is attached to the toner replenishing device.

FIG. 21 is a diagram illustrating the elastic sheet 332 included in the toner container 32 of Example 1, and FIG. 22 is an enlarged cross-sectional view of the nozzle receiver 330 and the conveying nozzle 611 in a state where the toner container 32 is attached to the toner replenishing device 60 illustrated in FIG. 13. Moreover, FIG. 23 is a front view of the elastic sheet 332 in the state of FIG. 22 when seen from the front end side.

As illustrated in FIG. 1, the toner container 32 includes the container body 33, the nozzle receiver 330, the container seal 333, and the elastic sheet 332.

The container body 33 is a powder storage member that stores toner therein, and the nozzle receiver 330 includes the nozzle insertion opening 331 provided in an opening on the other end side of the container body 33. Moreover, the container seal 333 formed from an elastic body is a member that defines the vicinity of the other end of the nozzle insertion opening 331 and is a member that seals the space between the nozzle receiver 330 and the conveying nozzle 611.

Moreover, the elastic sheet 332 is a member that opens and blocks the nozzle insertion opening 331 and is formed of a thin film sheet made from an elastic member having flexibility. Examples of an elastic material used for the elastic sheet 332 include silicone rubber, urethane rubber; fluorine rubber, ethylene propylene diene monomer (EPDM) rubber, and natural rubber, and other elastic materials having flexibility can be also used. Moreover, in order to improve slidability of the elastic sheet 332 sliding on the sheet member guide 611*a*, the surface of the elastic sheet 332 may be coated with talc or the like, or components for securing slidability may be added in advance to the elastic material.

As illustrated in FIGS. 1 and 21, the elastic sheet 332 includes two elastic sheet members of the first and second elastic sheets 332*a* and 332*b* so that the sheet members are disposed so as to overlap at the sheet overlapping portion 332*c*. Moreover, the sheet overlapping portion 332*c* blocks a portion of the elastic sheet 332 which is opened when the conveying nozzle 611 is inserted. Moreover, as illustrated in FIG. 21, the first and second elastic sheets 332*a* and 332*b* have planar surfaces having such a shape that is larger by an overlapping margin than a semi-circle, which overlap each other at the central portion of the nozzle insertion opening 331.

The first and second elastic sheets 332*a* and 332*b* are assembled so that small tension is applied in a state where the sheets are expanded to a length slightly larger than their natural length.

Although the toner container 32 of Example 1 uses two elastic sheets 332, three or more elastic sheets may be used in order to prevent toner leakage more reliably.

Moreover, in the toner container 32, two elastic sheets 332 are "surface" overlapped at the sheet overlapping portion 332*c* to block a portion of the elastic sheet 332 in which the conveying nozzle 611 is expanded to be open, and an air-tight state is created by the sheet overlapping portion 332*c*.

In the toner container (powder container) of JP 07-261492 A, a slit is provided in a radial form (like the asterisk symbol) in one elastic sheet member. Here, a portion of the elastic sheet member expanded by the powder conveying nozzle will be referred to as a "slit portion".

In such a configuration, in relation to the insertion direction of the powder conveying nozzle, the slit portion does not overlap with other neighboring slit portions, and only end surfaces in the direction orthogonal to the insertion direction of the powder conveying nozzle make contact with each other. Such a structure that no slit portion overlaps in the insertion direction of the powder conveying nozzle will be referred to as a "line" blocking structure for the convenience's sake.

In this "line" blocking structure, when elastic deformation occurs in the elastic sheet member due to vibration or impact, such a gap that powder can pass through is easily provided in the slit portion. When such a gap that powder can pass through is provided, a state where powder can leak is created. Moreover, in the conventional elastic sheet member in which the slit portion having such a "line" blocking structure is provided, if small tension is applied, the slit portion will be open and tension cannot be applied. Thus, when the toner container 32 is detached from the toner replenishing device 60, the force that blocks the slit portion is small and powder may leak.

On the other hand, in the toner container 32 according to Example 1 of the present embodiment, the plurality of elastic sheets 332 is disposed so as to overlap at the sheet overlapping portion 332*c* in which the elastic sheets overlap at least partially in the insertion direction of the powder conveying nozzle. Moreover, the sheet overlapping portion 332*c* which is a portion where the plurality of elastic sheets 332 overlap blocks the portion of the elastic sheet 332 expanded by the conveying nozzle 611 with a "surface" having a certain area. Such a structure that the sheet overlapping portion 332*c* is provided in the insertion direction of the conveying nozzle 611 will be referred to as a "surface" blocking structure for the convenience's sake.

Due to this, even when elastic deformation occurs in the elastic sheet 332 due to vibration or impact, the "surface" blocking structure makes such a gap that powder can pass through a portion of the elastic sheet member, through which the powder, conveying nozzle passes, difficult to be provided as compared to the "line" blocking structure.

Moreover, Example 1 has a structure in which the sheet overlapping portion 332*c* in which the plurality of elastic sheets 332 overlap at least partially in relation to the insertion direction of the conveying nozzle 611 is provided. Moreover, the "surface" blocking structure includes such a structure that a plurality of elastic sheets overlap at least partially in the direction orthogonal to the insertion direction of the powder conveying nozzle. More specifically, an example of such a structure is that the elastic sheets are disposed so as to be bent toward the downstream side in the insertion direction of the conveying nozzle 611 and the bent portions make contact with each other to form an overlapping portion so that overlapping portion is provided in the insertion direction of the conveying nozzle 611.

Such a structure in which the bent portions make contact with each other to form the overlapping portion makes such a gap that powder can pass through difficult to be provided as compared to the "line" blocking structure. However, such a gap that powder can pass through can be provided easily as compared to a structure having the sheet overlapping portion 332*c* in which the plurality of elastic sheets 332 overlap at least partially in the insertion direction of the conveying nozzle 611. Here, a free end 432 of the elastic sheet 332 in FIG. 21 is a portion that is not interposed by the attaching portion 337 and the sheet stopper 335 among the portions that form the end surfaces of the elastic sheet 332.

In the toner container 32 having a plurality of elastic sheets 332, when the conveying nozzle 611 is removed after being inserted therein, the plurality of elastic sheets 332 restores to their original positions by their elastic force so as to restore the sheet overlapping portion 332*c*. In a configuration with no sheet overlapping portion 332*c*, when the powder conveying nozzle is removed after the free end 432 of the elastic sheet 332 is displaced due to the powder conveying nozzle inserted into the elastic sheet 332, such restoring force that the free end 432 restores following the held end acts on the free end 432. Here, when the elastic sheets are assembled in advance so that tension is applied, the action of the free end restoring following the held end is facilitated.

In the elastic sheet 332 according to Example 1 of the present embodiment, the first and second elastic sheets 332*a* and 332*b* are assembled so that small tension is applied in a state where the sheets are expanded to a length slightly larger than their natural length. Due to this, even if the conveying nozzle 611 is removed when the toner container 32 is detached from the toner replenishing device 60, the first and second elastic sheets 332*a* and 332*b* can be sealed again by their restoring force so as to overlap partially. Thus, it is possible to suppress leakage of powder (toner) better than the powder container having the conventional elastic sheet member in which a slit is provided in one elastic sheet member.

On the other hand, the following problems occur in the structure in which the elastic sheets are disposed so as to be bent toward the downstream side in the insertion direction of the conveying nozzle 611. That is, in order to increase restoring force that restores the overlapping portion again, it is necessary to assemble the elastic sheets so that tension is applied in advance in two directions of the insertion direction of the conveying nozzle 611 and the direction orthogonal to the insertion direction of the conveying nozzle 611. However, when tension is applied in the direction orthogonal to the insertion direction of the conveying nozzle 611, the portions that are bent toward the downstream side in the insertion direction of the conveying nozzle 611 are opened similarly to the "line" blocking structure. Thus, the area of the overlapping portion decreases if the restoring force is increased.

That is, in the structure in which the elastic sheets are disposed so as to be bent toward the downstream side in the insertion direction of the conveying nozzle 611, there is a tradeoff relation between increasing the restoring force and maintaining the area of the overlapping portion. Thus, when the elastic sheets are assembled so that tension is applied in advance thereto, a gap that powder can pass through is likely to be provided.

In contrast, the structure that includes the sheet overlapping portion 332*c* in which the plurality of elastic sheets 332 overlap at least partially in the insertion direction of the conveying nozzle 611 has the following advantages. That is, when elastic sheets are assembled so that tension is applied in advance thereto, both increasing the restoring force and maintaining the area of the overlapping portion can be realized.

When the toner container 32 is attached to the toner replenishing device 60, the conveying nozzle 611 is inserted in such a manner to expand the sheet overlapping portion 332*c* of the elastic sheet 332 as illustrated in FIGS. 22 and 23. Since the elastic sheet 332 is an elastic material having flexibility, when the conveying nozzle 611 is inserted, the elastic sheet 332 is elastically deformed so that the sheet overlapping portion 332*c* is expanded.

On the other hand, when the toner container 32 is detached from the toner replenishing device 60, the conveying nozzle 611 is removed in such a manner that the elastic sheet 332 scrapes off the contamination on the outer circumferential surface of the conveying nozzle 611. This is because the elastic sheet 332 elastically deformed with insertion of the conveying nozzle 611 makes contact with the surface of the conveying nozzle 611 due to contacting pressure of the restoring force.

Since the elastic sheet 332 has flexibility, after the conveying nozzle 611 is removed, the two elastic sheets 332 form the sheet overlapping portion 332*c* again at the central portion. When the sheet overlapping portion 332*c* is restored at the central portion, an air-tight state is created again.

As illustrated in FIGS. 11 to 13 and 22 and other figures, the sheet member guide 611*a* having a hemispherical shape of which the diameter is approximately the same as the diameter of the conveying nozzle 611 is provided in an end on the side (the side opposite to the base side) in the axial direction of the conveying nozzle 611 facing the toner container. By using such a round sheet member guide 611*a*, when the conveying nozzle 611 expands the overlapping portion at the center of the elastic sheet 332, since force can be applied gradually, it is possible to expand the elastic sheet 332 smoothly.

Moreover, an ideal shape of the sheet member guide 611*a* may be selected by taking the slidability in relation to the elastic sheet 332 and elasticity of the elastic sheet 332 into consideration.

The surface of the sheet member guide 611*a* may be coated so that toner can rarely adhere to the surface. Since the sheet member guide 611*a* is a portion that makes direct contact with the toner inside the toner container 32, during replacement of the toner container 32, the sheet member guide 611*a* may be exposed with the toner adhering thereto, and the toner may fall into the toner container receiving portion 70 or the like to contaminate the copying machine 500. However, since the surface of the sheet member guide 611*a* is processed in advance so that toner can rarely adhere, it is possible to prevent this.

In the toner container 32, the nozzle insertion opening 331 is sealed by the "surface" overlapping of the sheet overlapping portion 332*c*. Thus, when vibration or impact is applied to the toner container 32 so that the elastic sheet 332 is elastically deformed, a gap that toner can pass through is rarely provided. In this manner, since it is possible to suppress formation of the gap that the toner can pass through, it is possible to suppress leakage of toner from the toner container 32 in a state where the toner container 32 is not attached to the toner replenishing device 60. Thus, even when the toner container 32 is handled violently during transportation or the like, it is possible to suppress the occurrence of toner leakage from the toner container 32. Therefore, it is possible to suppress the occurrence of toner leakage resulting from vibration or dropping during transportation of the toner container 32.

Moreover, since the nozzle insertion opening 331 which is a nozzle insertion opening is opened and blocked by elastic deformation of the elastic sheet 332, it is possible to simplify the configuration of opening and blocking the nozzle insertion opening as compared to the toner container of JP 2009-276659 A and to reduce the cost of the toner container 32.

Moreover, as described above, tension is applied to the elastic sheet 332, and the adhesion (air-tightness) of the two elastic sheets 332 in the overlapping portion is improved.

Thus, it is possible to prevent toner leakage more effectively, and satisfactory characteristics against vibration and impact are obtained.

The toner container 32 according to Example 1 of the present embodiment can suppress leakage of toner resulting from vibration or dropping during transportation of the toner container 32. In the toner replenishing device 60 including such toner container 32, it is possible to suppress leakage of toner when the toner container 32 is replaced. Thus, it is possible to suppress the occurrence of contamination inside the device and contamination outside the device resulting from the leakage of toner.

Moreover, in the copying machine 500 including such a toner replenishing device 60, it is possible to suppress the occurrence of contamination inside the device and contamination outside the device when the toner container 32 is replaced.

As illustrated in FIG. 21, the first elastic sheet 332*a* blocks a portion of the nozzle insertion opening 331 and the other portion (the portion depicted by a broken line in FIG. 21) is an opening. Similarly, the second elastic sheet 332*b* blocks a portion of the nozzle insertion opening 331 and the other portion (the portion depicted by a broken line in FIG. 21) is an opening. Moreover, the opening of the first elastic sheet 332*a* is disposed so as be covered by the second elastic sheet 332*b*, and the opening of the second elastic sheet 332*b* is disposed so as to be covered by the first elastic sheet 332*a*. That is, the first and second elastic sheets 332*a* and 332*b* are disposed so that the positions of the openings are shifted from each other.

In such an arrangement, when the conveying nozzle 611 enters, as illustrated in FIGS. 22 and 23, the two elastic sheets 332 are elastically deformed so that the conveying nozzle 611 enters so as to pass through the respective openings. In this case, the elastically deformed elastic sheets 332 make close contact with the outer circumferential surface of the conveying nozzle 611, the sealing property in the state where the conveying nozzle 611 is inserted is satisfactory.

Moreover, in a state where the conveying nozzle 611 is not inserted, the plurality of elastic sheets 332 is disposed so as to overlap so that the insertion openings are shifted from each other, and the other elastic sheet 332 overlaps with a portion that serves as a boundary line between the elastic sheet and the opening to configurate the sheet overlapping portion 332*c*. In this manner, since the portion that serves as the boundary line between the elastic sheet and the opening forms the sheet overlapping portion 332*c* and the elastic sheets 332 are in close contact, it is possible to prevent the occurrence of toner leakage due to vibration during transportation.

Moreover, the toner container 32 according to Example 1 of the present embodiment rotates to supply toner to the nozzle opening 610 of the conveying nozzle 611, and during this rotation, the outer circumferential surface of the conveying nozzle 611 slide on the elastic sheet 332.

Thus, in a portion of the elastic sheet 332 making contact with the outer circumferential surface of the conveying nozzle 611, force (friction force) that causes the portion to remain at the contact position may occur and force that causes the portion to be pulled in the circumferential direction may be applied.

In such a case, the force that causes the portion to be pulled in the circumferential direction can be distributed to the two elastic sheets 332 as compared to the conventional elastic sheet member having the slit portion. Since the amount of deformation of the respective elastic sheets 332 is small, it is possible to prevent the occurrence of toner leakage even during rotation of the toner container 32.

In a toner container of such a type that the toner container itself does not rotate and includes a rotating conveying member, the elastic sheet 332 of Example 1 can be similarly used.

In the configuration illustrated in FIG. 21, the first and second elastic sheets 332*a* and 332*b* are arranged so that the free ends 432 (432*a* and 432*b*) are disposed in a reverse positional relation in the diametric direction of the front end opening 305. In other words, one free end 432 overlaps from the outer side with the surface portion of the other elastic sheet and the other free end 432 overlaps from the inner side with the surface portion of one elastic sheet. Moreover, in the insertion direction of the conveying nozzle 611, both elastic sheets 332 overlap over the entire area in the diametric direction of the front end opening 305, and this overlapping portion is the sheet overlapping portion 332*c*. In this manner, when the conveying nozzle 611 is inserted, portions of the respective elastic sheets 332 closer to the free ends 432 are displaced in a direction away from the center of the front end opening 305. Moreover, when the conveying nozzle 611 is removed, the free ends 432 of the respective elastic sheets 332 are displaced in a direction toward the center of the front end opening 305. After the conveying nozzle 611 is completely removed, the free ends 342 form the overlapping portion 332*c* in the insertion direction of the conveying nozzle 611.

Example 2

Next, an elastic sheet 332 according to Example 2, disposed in the toner container 32 of the first embodiment will be described.

Figure 24:
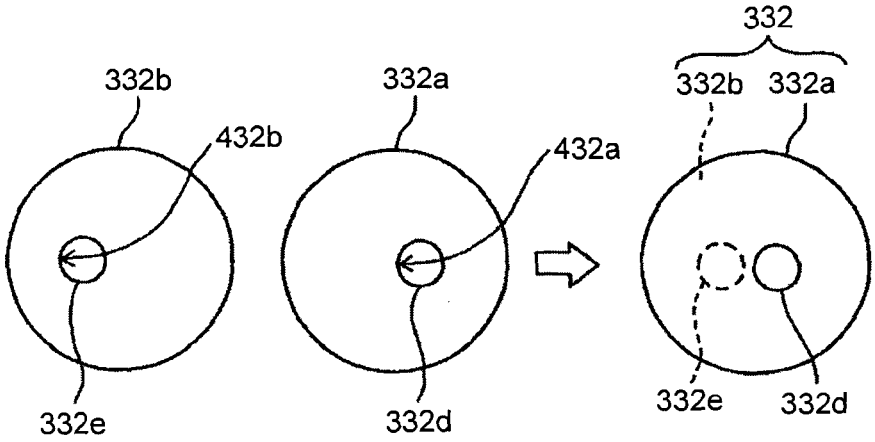
FIG. 24 is a diagram illustrating an elastic sheet according to Example 2 of the first embodiment.

FIG. 24 is a diagram illustrating an elastic sheet 332 of Example 2. In Example 2, first and second elastic sheets 332*a* and 332*b* that configurate the elastic sheet 332 have a shape that covers the entire nozzle insertion opening 331, and first and second round through-holes 332*d* and 332*e* are provided in a portion thereof. That is, Example 2 has a configuration in which two elastic sheets 332 having a round hole-shaped opening overlap with each other.

In Example 2, the first and second elastic sheets 332*a* and 332*b* in which the first and second round through-holes 332*d* and 332*e* which are openings for inserting the conveying nozzle 611 are provided at positions deviated from the center of the nozzle insertion opening 331 disposed approximately at the center of the front end opening 305 are arranged so as to overlap with each other. In the overlapping state, the first and second elastic sheets 332*a* and 332*b* are disposed so that the first and second round through-holes 332*d* and 332*e* are shifted from the center of the nozzle insertion opening 331. Since the round holes are shifted from each other, the other elastic sheet 332 can seal the round hole provided in one elastic sheet 332. Moreover, the two elastic sheets 332 overlap and make close contact with the surrounding of the round hole. Due to such a configuration, similarly to the configuration illustrated in FIG. 21, both elastic sheets 332 overlap over the entire area in the diametric direction of the front end opening 305 in the insertion direction of the conveying nozzle 611, and the overlapping portion functions as the sheet overlapping portion 332*c*. Thus, it is possible to suppress toner leakage in a state where the conveying nozzle 611 is not inserted.

In the elastic sheet 332 of Example 2, when the conveying nozzle 611 is inserted, the first and second round through-holes 332*d* and 332*e* are displaced in the direction toward the nozzle insertion opening 331. Moreover, the diameter of the first and second round through-holes 332*d* and 332*e* in the state where the conveying nozzle 611 is not inserted is set to be smaller than the diameter of the conveying nozzle 611.

Thus, the first and second round through-holes 332*d* and 332*e* are elastically deformed so as to be expanded with insertion of the conveying nozzle 611.

Here, since the diameter of the first and second round through-holes 332*d* and 332*e* is set to be smaller than the diameter of the conveying nozzle 611, the restoring force of the two elastic sheet 332 in the state where the conveying nozzle 611 is inserted acts in such a way of tightly fasten the surrounding of the conveying nozzle 611. Thus, when the toner container 32 is detached from the toner replenishing device 60 (when the conveying nozzle 611 is removed), the conveying nozzle 611 is removed such that the contamination on the outer circumferential surface of the conveying nozzle 611 is scraped off by the elastic sheet 332, and the scraping-off effect is improved further.

In Example 2, although the opening provided in the elastic sheet 332 is a round hole, the shape of the opening is not limited to the round hole shape. Other opening shapes such as a rectangular shape, a triangular shape, or an elliptical shape may be used as long as the elastic sheets 332 are elastically deformed so that the conveying nozzle 611 can pass therethrough.

In Example 2 illustrated in FIG. 24, the edges of the first and second round through-holes 332*d* and 332*e* function as the free ends 432 (432*a* and 432*b*) of the first and second elastic sheets 332*a* and 332*b*. In other words, one free end 432 overlaps from the outer side with the surface portion of the other elastic sheet and the other free end 432 overlaps from the inner side with the surface portion of one elastic sheet. Moreover, in the insertion direction of the conveying nozzle 611, both elastic sheets 332 overlap over the entire area in the diametric direction of the front end opening 305, and this overlapping portion is the sheet overlapping portion 332*c*.

Example 3

Next, an elastic sheet 332 according to Example 3, disposed in the toner container 32 of the first embodiment will be described.

Figure 25:
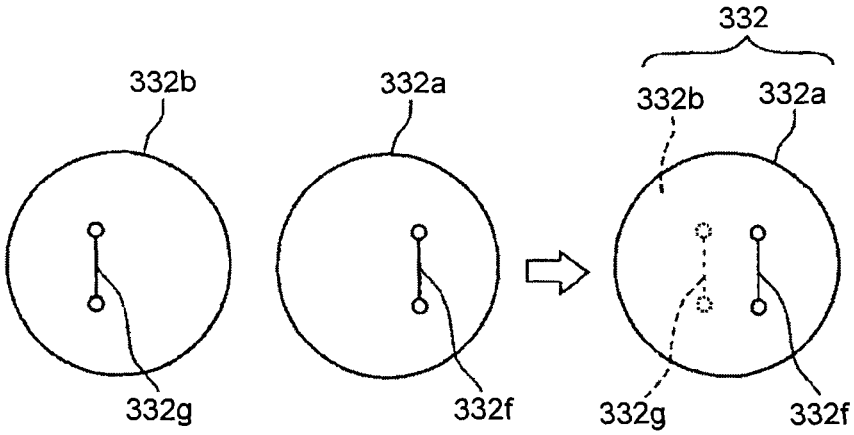
FIG. 25 is a diagram illustrating an elastic sheet according to Example 3 of the first embodiment.
Figure 26:
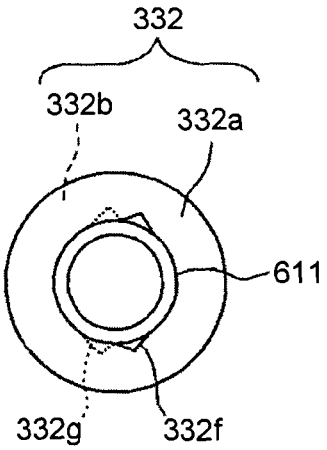
FIG. 26 is a front view when the elastic sheet of FIG. 25 is seen from a front end side in a state where the toner container is attached to the toner replenishing device.

FIG. 25 is a diagram illustrating the elastic sheet 332 of Example 3, and FIG. 26 is a front view of the elastic sheet 332 of Example 3 in a state where the toner container 32 is attached to the toner replenishing device 60 when seen from the front end side.

In Example 3, first and second elastic sheets 332*a* and 332*b* that form the elastic sheet 332 have a shape that covers the entire nozzle insertion opening 331, and first and second slits 332*f* and 332*g* are provided in a portion thereof. That is, Example 3 has a configuration in which two elastic sheets 332 having a slit-shaped opening overlap with each other.

In Example 3, the first and second elastic sheets 332*a* and 332*b* in which the first and second slits 332*f* and 332*g* which are openings for inserting the conveying nozzle 611 are provided at positions deviated from the center of the nozzle insertion opening 331 disposed approximately at the center of the front end opening 305 are arranged so as to overlap with each other. In the overlapping state, the first and second elastic sheets 332*a* and 332*b* are disposed so that the first and second slits 332*f* and 332*g* are shifted from the center of the nozzle insertion opening 331. Since the slits are shifted from each other, the other elastic sheet 332 can seal the slit provided in one elastic sheet 332. Moreover, the two elastic sheets 332 overlap and make close contact with the surrounding of the slit. Due to such a configuration, similarly to the configuration illustrated in FIGS. 21 and 24, both elastic sheets 332 overlap over the entire area in the diametric direction of the front end opening 305 in the insertion direction of the conveying nozzle 611, and the overlapping portion functions as the sheet overlapping portion 332*c*. Thus, it is possible to suppress toner leakage in a state where the conveying nozzle 611 is not inserted.

In the elastic sheet 332 of Example 3, when the conveying nozzle 611 is inserted, as illustrated in FIG. 26, the first and second slits 332*f* and 332*g* are displaced in the direction toward the nozzle insertion opening 331.

As illustrated in FIG. 25, a small-diameter round hole is provided at both ends of the first and second slits 332*f* and 332*g*. As in the configuration disclosed in JP-A No. 07-261492, if only a slit is provided in an elastic sheet member, when the conveying nozzle 611 is inserted to expand the slit, the ends of the slit may be torn and the elastic sheet member may be torn. On the other hand, as in Example 3, when a small-diameter round hole is provided at both ends of the slit, it is possible to suppress the ends of the slit from being torn when the conveying nozzle 611 is inserted and to suppress the elastic sheet 332 which is an elastic sheet member to be torn.

Moreover, when a slit is provided in an elastic sheet member and a small-diameter round hole is provided at both ends of the slit, if the elastic sheet member is only one sheet as in JP 07-261492 A, toner may leak from the small-diameter round holes. On the other hand, in Example 3, two elastic sheets 332 are arranged so as to overlap, and a portion where one slit is provided is sealed by the other elastic sheet 332. Thus, even when a small-diameter round hole is provided at both ends of the slit, it is possible to suppress the occurrence of toner leakage.

Moreover, since the configuration of Example 3 where slits are provided can decrease the opening area as compared to the configuration of Example 2 where round holes are provided, it is possible to suppress the occurrence of toner leakage better than Example 2.

In the case of a configuration where a plurality of elastic sheets 332 having a slit provided therein is arranged so as to overlap, the slits may cross and overlap with each other. In a state where slits are blocked, toner cannot pass through the slit portion. Moreover, in the case of a configuration where slits cross each other, even when elastic deformation occurs to cause a gap in the slit portion of one elastic sheet 332 such that toner can pass through the gap, if the slit of the other elastic sheet 332 is blocked, it is possible to prevent passing of toner.

Moreover, since the plurality of elastic sheets 332 overlap with each other, the vibration and impact energy can be distributed to the plurality of elastic sheets 332. In this case, elastic deformation that causes such a gap in the slit portion of one elastic sheet 332 so that toner can pass through the gap may rarely occur.

From these reasons, it is possible to suppress toner from leaking from the toner container 32 as compared to the configuration disclosed in JP 07-261492 A in which only one elastic sheet member having a slit provided therein is provided.

In Example 3 illustrated in FIG. 25, the first and second slits 332*f* and 332*g* function as the free ends 432 (432*a* and 432*b*) of the first and second elastic sheets 332*a* and 332*b*. In other words, one free end 432 overlaps from the outer side with the surface portion of the other elastic sheet and the other free end 432 overlaps from the inner side with the surface portion of one elastic sheet. Moreover, in the insertion direction of the conveying nozzle 611, both elastic sheets 332 overlap over the entire area in the diametric direction of the front end opening 305, and this overlapping portion is the sheet overlapping portion 332*c*.

Example 4

Next, an elastic sheet 332 according to Example 4, disposed in the toner container 32 of the first embodiment will be described.

Figure 27:
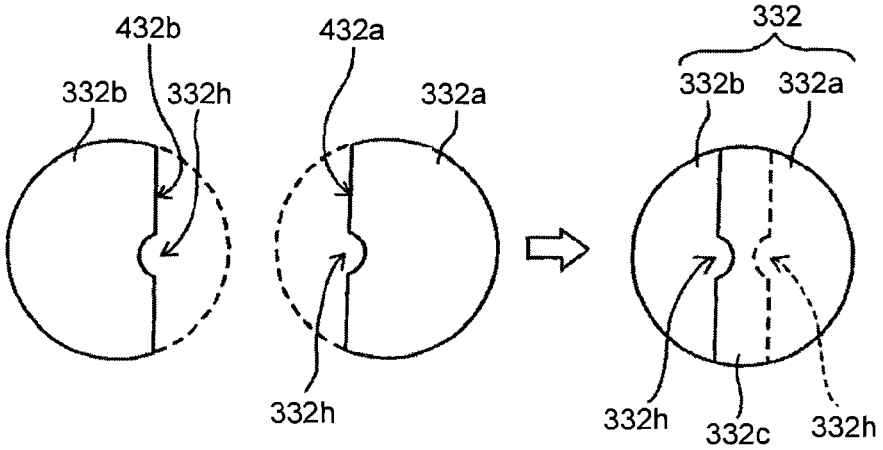
FIG. 27 is a diagram illustrating an elastic sheet according to Example 4 of the first embodiment.

FIG. 27 is a diagram illustrating the elastic sheet 332 of Example 4. In Example 4, a semi-circular notch 332*h* is provided in an edge portion of an opening near the center of the elastic sheet 332 of Example 1 described with reference to FIGS. 1 and 21 and other figures. The other configuration except that a notch is provided is the same as Example 1, and the same configuration will not be described.

In the elastic sheet 332 of Example 4, since a notch is provided, when the conveying nozzle 611 is inserted, the notch makes contact with the hemi-spherical sheet member guide 611*a*, and the two elastic sheets 332 can be smoothly elastically deformed. As a result, the conveying nozzle 611 can be smoothly inserted in the toner container 32.

In Example 4 illustrated in FIG. 27, the first and second elastic sheets 332*a* and 332*b* are arranged so that the free ends 432 (432*a* and 432*b*) which are edges where the semi-circular notches 332*h* are provided are disposed in a reverse positional relation. Further, one free end 432 overlaps with the surface portion of the other elastic sheet, and similarly, the other free end 432 overlaps with the surface portion of one elastic sheet. Moreover, in the portion between one free end 432 and the other free end 432, both elastic sheets 332 overlap in the insertion direction of the conveying nozzle 611 and this overlapping portion is the sheet overlapping portion 332*c*. Due to this, the free end 432 that is displaced with insertion of the conveying nozzle 611 overlaps with the other elastic sheet 332 in the insertion direction of the conveying nozzle 611 before the conveying nozzle 611 is inserted.

Second Embodiment

Hereinafter, a second embodiment of the present invention will be described with reference to the drawings. In the second embodiment, the same members or members having the same functions as those of the first embodiment will be denoted by the same reference numerals, and the description thereof may sometimes be omitted. As for the configuration which is not described, the configuration described in the first embodiment can be suitably used.

Hereinafter, the elastic sheet 332 disposed in the toner container 32 of the second embodiment will be described.

Figure 34:
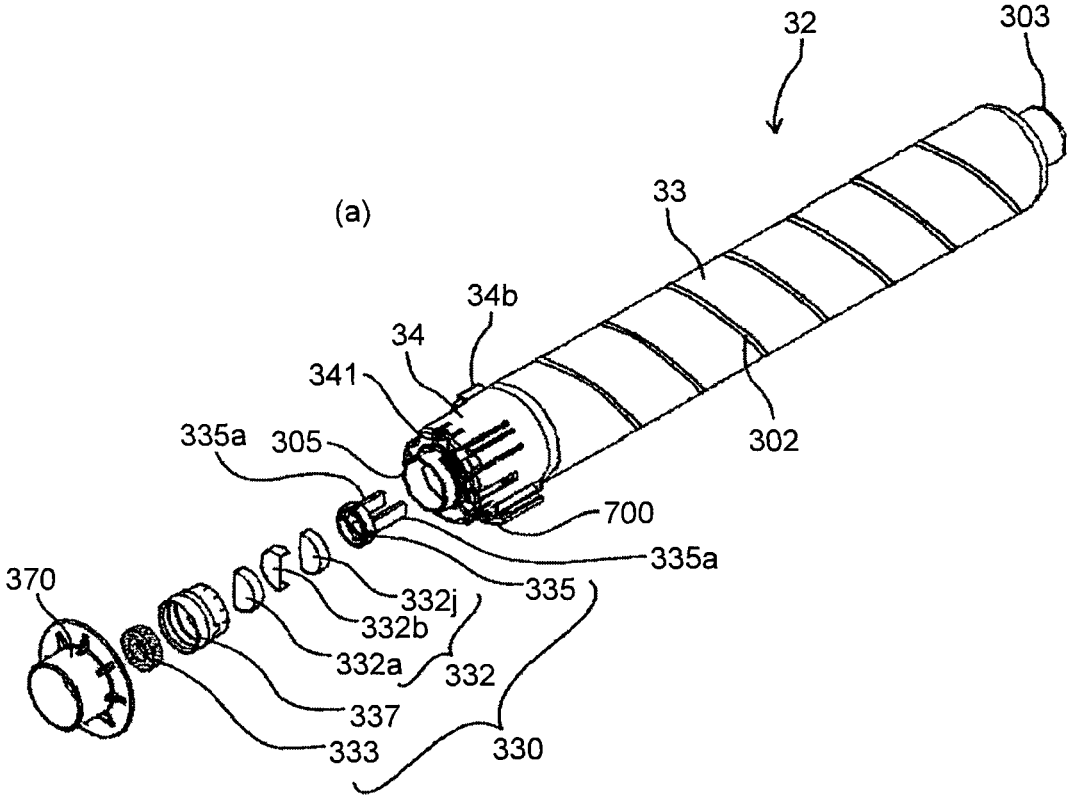
FIG. 34 illustrates the toner container according to the second embodiment, in which (a) is an exploded perspective view of the toner container and (b) is a front view of a nozzle receiver when seen from the other end side.
Figure 34:
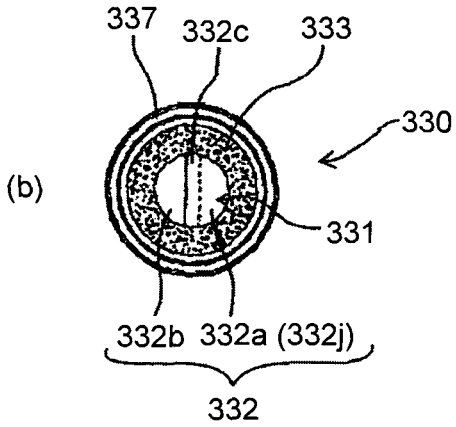

FIG. 34 illustrates the toner container 32 of the second embodiment, in which (a) is an exploded perspective view of the toner container 32 of the second embodiment (illustrating the state where the container front end cover 34 is attached), and (b) is a front view of the nozzle receiver 330 included in the toner container 32 of the second embodiment when seen from the other end side. As illustrated in FIG. 34, in the second embodiment, the elastic sheet 332 includes first, second, and third elastic sheets 332*a*, 332*b*, and 332*j* so that the sheets are disposed on the inner side in the longitudinal direction from the nozzle insertion opening 331 so as to overlap with each other.

The toner container 32 of the second embodiment stores toner therein similarly to the toner container 32 of the first embodiment. Three elastic sheets 332 (332*a*, 332*b*, and 332*j*) formed of a thin-film elastic material and the container seal 333 are provided in the nozzle insertion opening 331, and a cap 370 which is a sealing member is provided in the container opening 33*a* which is on a developer discharge side.

FIG. 34 illustrates an example of three elastic sheets 332 according to the second embodiment. The first, second, and third elastic sheets 332*a*, 332*b*, and 332*j* are assembled so that small tension is applied in a state where the sheets are expanded to a length slightly larger than their natural length.

Since three elastic sheets 332 are superimposed, it is possible to improve the sealing property further than the two-sheet configuration and to prevent the occurrence of toner leakage more reliably.

In the example illustrated in FIG. 34, the sheet overlapping portion 332*c* is provided at the center of the nozzle insertion opening 331 and an air-tight state is created by the sheet overlapping portion 332*c*. When the toner container 32 is attached to the toner replenishing device 60, the hemi-spherical sheet member guide 611*a* at the front end of the conveying nozzle 611 is inserted so as to expand the central sheet overlapping portion 332*c*. In this case, since the elastic sheet 332 is an elastic body, the elastic sheet 332 is elastically deformed so as to avoid the conveying nozzle 611 and the conveying nozzle 611 is inserted without any problem.

When the toner container 32 is detached from the toner replenishing device 60 (when the conveying nozzle 611 is removed), the conveying nozzle 611 is removed in such a manner that the elastic sheet 332 scrapes off the contamination on the outer circumferential surface of the conveying nozzle 611. When the toner container 32 is detached from the toner replenishing device 60, the sheet overlapping portion 332*c* is provided again by the restoring force of the three elastic sheets 332. Since the elastic sheet 332 is an elastic body, when the sheet overlapping portion 332*c* is provided, the air-tight state is created again.

In the second embodiment, the sheet overlapping portion 332*c* with which the front end of the conveying nozzle 611 makes contact when the conveying nozzle 611 is inserted in the nozzle insertion opening 331 is provided in various shapes so that operability, durability, toner sealing property, and the like are satisfied, details of which will be described later.

When the conveying nozzle 611 enters into the toner container 32 of the second embodiment, portions of the respective elastic sheets 332 closer to the free end 432 are displaced in a direction away from the center of the front end opening 305, and the conveying nozzle 611 is inserted into the toner container 32. Since the free ends 432 of the elastic sheets 332 make close contact with the outer shape of the conveying nozzle 611, the sealing property is improved. Further, since three elastic sheets 332 are superimposed to provide the strength (closing force) of the sheet overlapping portion 332*c*, it is possible to prevent the occurrence of toner leakage due to vibration during transportation more effectively.

Hereinafter, specific examples of the arrangement of three elastic sheets 332 of the second embodiment will be described with reference to FIGS. 35 to 39. In the configuration illustrated in FIGS. 35 to 39, the first, second, and third elastic sheets 332*a*, 332*b*, and 332*j* are arranged in that order from the elastic sheet 332 located on the outermost side when three elastic sheets 332 are arranged in the toner container 32. Moreover, in the configuration illustrated in FIGS. 35 to 39, an "arrangement angle" and an "overlapping amount" of the elastic sheets 332 are set based on the linear free end 432 of the innermost elastic sheet 332*j* when three elastic sheets 332 are superimposed. As another method, the reference position of the X and Y axes orthogonal to the insertion direction of the conveying nozzle 611 may be provided in the attaching portion 337 that holds the elastic sheet 332, and the "arrangement angle" and the "overlapping amount" may be set based on this reference position.

Example 1

Figure 35:
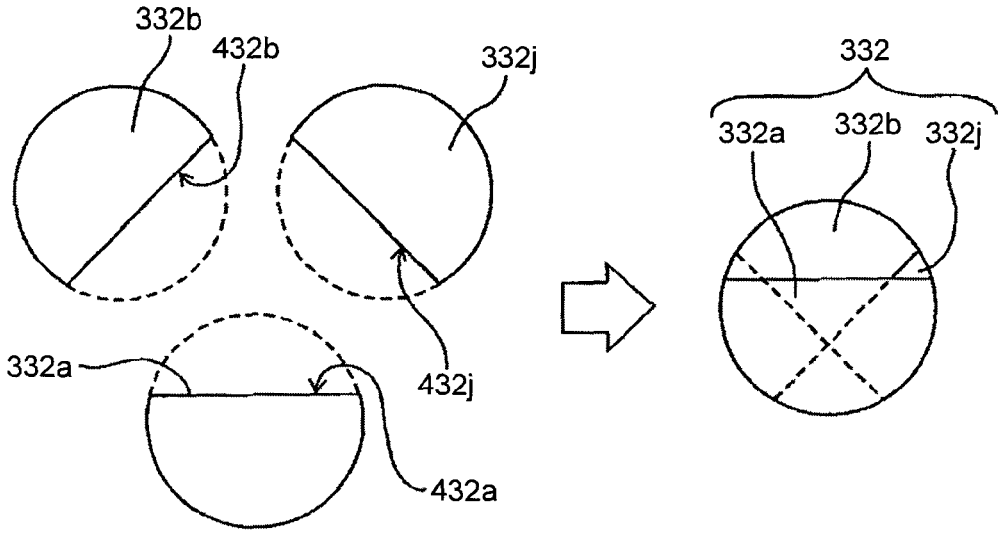
FIG. 35 is a diagram illustrating an arrangement of three elastic sheets according to Example 1 of the second embodiment.

FIG. 35 is a diagram illustrating arrangement of three elastic sheets 332 of Example 1 of the second embodiment.

In Example 1 illustrated in FIG. 35, three elastic sheets 332 illustrated in FIG. 21 are superimposed so that the three elastic sheets 332 are at an angle of approximately 120°. Specifically, the second elastic sheet 332*b* is arranged so that the linear free end 432*b* of the second elastic sheet 332*b* is disposed at a position rotated by 120° in the counter-clockwise direction in FIG. 35 about the linear free end 432*j* of the third elastic sheet 332*j*. Moreover, the first elastic sheet 332*a* is arranged so that the linear free end 432*a* of the first elastic sheet 332*a* is disposed at a position rotated by 120° in the clockwise direction in FIG. 35 about the linear free end 432*j* of the third elastic sheet 332*j*.

As illustrated in FIG. 35, although each of the three elastic sheets 332 is arranged so as to partially have an opening in relation to the front end opening 305, since the three elastic sheets 332 are arranged so that the positions of the openings are different, the elastic sheets cover the entire nozzle insertion opening 331.

As illustrated in FIG. 35, by superimposing the elastic sheets 332 having the same shape at an arrangement angle of approximately 120°, it is possible to arrange three elastic sheets 332 in a well-balanced manner. Moreover, when the toner container 32 is detached from the toner replenishing device 60, it is possible to further improve the scraping-off effect when the conveying nozzle 611 is removed in such a manner that the elastic sheet 332 scrapes off the contamination on the outer circumferential surface of the conveying nozzle 611 and to further suppress toner scattering. Moreover, since three elastic sheets 332 having the same shape are used, it is possible to decrease the cost.

In Example 1 illustrated in FIG. 35, the free end 432*j* of the elastic sheet 332*j* is partially covered by the elastic sheet 332*b* and is also partially covered by the elastic sheet 332*a*. In this manner, in the insertion direction of the conveying nozzle 611, the elastic sheets 332 overlap over the entire area in the diametric direction of the front end opening 305, and this overlapping portion is the sheet overlapping portion 332*c*.

Example 2

Figure 36:
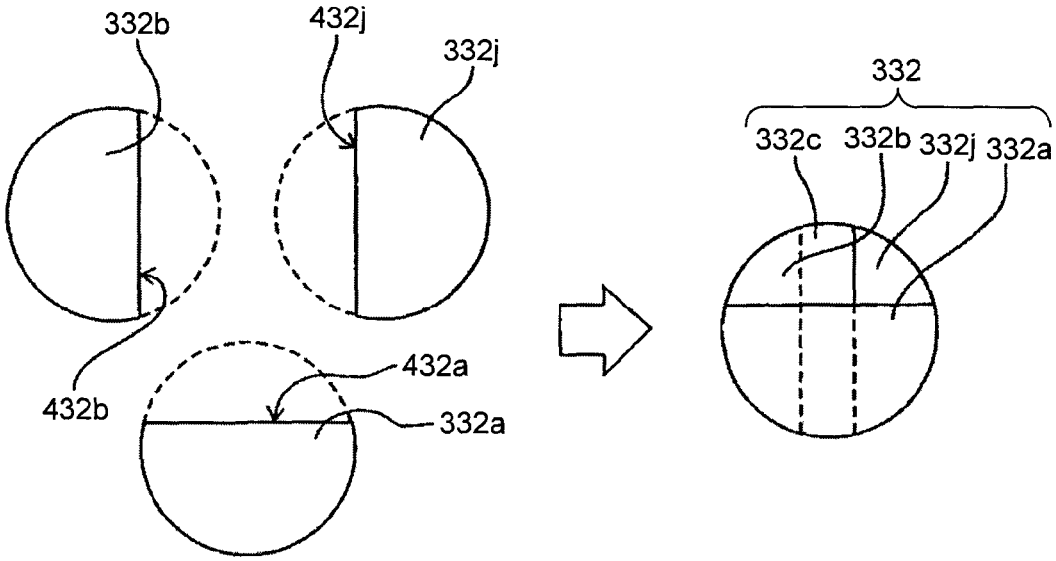
FIG. 36 is a diagram illustrating an arrangement of three elastic sheets according to Example 2 of the second embodiment.

FIG. 36 is a diagram illustrating the arrangement of three elastic sheets 332 of Example 2 of the second embodiment.

In Example 2 illustrated in FIG. 36, similarly to Example 1 illustrated in FIG. 35, although each of the three elastic sheets 332 is arranged so as to partially have an opening in relation to the front end opening 305, since the three elastic sheets 332 are arranged so that the positions of the openings are different, the elastic sheets cover the entire nozzle insertion opening 331.

As a specific superimposing method, the second elastic sheet 332*b* is arranged so that the linear free end 432*b* of the second elastic sheet 332*b* is disposed at a position rotated by 180° in the counter-clockwise direction in FIG. 36 about the linear free end 432*j* of the third elastic sheet 332*j*. Moreover, the first elastic sheet 332*a* is arranged so that the linear free end 432*a* of the first elastic sheet 332*a* is disposed at a position rotated by 90° in the clockwise direction in FIG. 36 about the linear free end 432*j* of the third elastic sheet 332*j*.

In this manner, the first, second, and third elastic sheets 332*a*, 332*b*, and 332*j* are arranged at positions rotated by 90°.

In Example 2 illustrated in FIG. 36, one elastic sheet 332 (the first elastic sheet 332*a*) is rotated by 90° to provide strength (closing force) of the sheet overlapping portion 332*c*. More specifically, similarly to the configuration illustrated in FIG. 21, the second and third elastic sheets 332*b* and 332*j* overlap in the diametric direction of the front end opening 305 to form the overlapping portion 332*c*. For example, it is assumed that an impact is applied to the toner container 32 and the pressure of toner stored therein is applied to the overlapping portion 332*c*. In this case, the free ends 432*b* and 432*j* of the second and third elastic sheets 332*b* and 332*j* try to move in a direction (the left-right direction in FIG. 36) orthogonal to the direction (the up-down direction in FIG. 36) along which the overlapping portion 332*c* is provided. However, since the restoring force of the elastic sheet 332*a* having the free end 432*a* disposed in parallel to the orthogonal direction (the left-right direction in FIG. 36) acts to reinforce the overlapping portion 332*c*, it is possible to improve the strength (closing force) of the sheet overlapping portion 332*c* and to further prevent the toner leakage from the container opening 33*a* due to vibration during transportation.

Example 3

Figure 37:
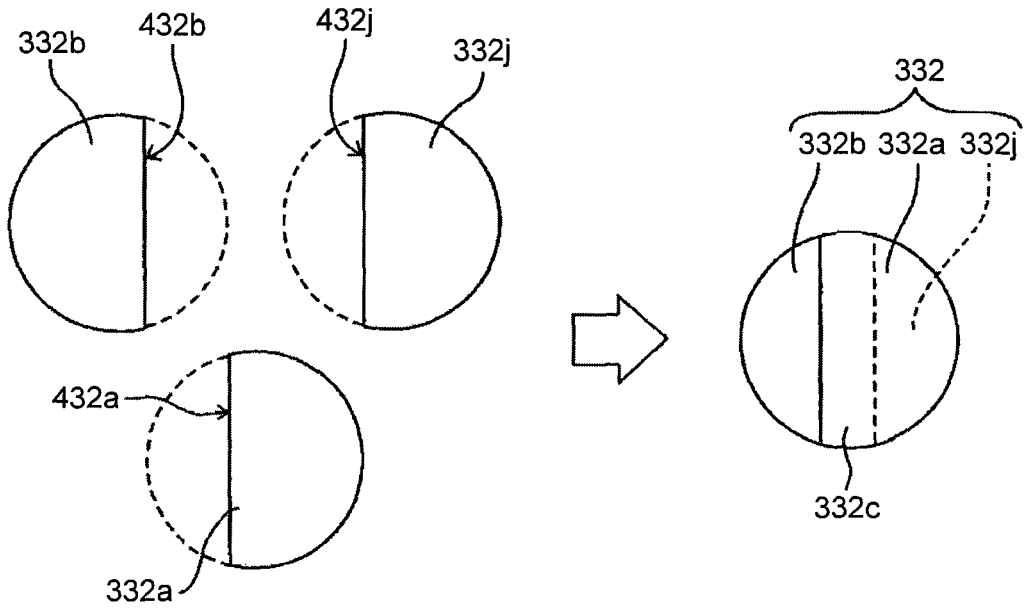
FIG. 37 is a diagram illustrating an arrangement of three elastic sheets according to Example 3 of the second embodiment.

FIG. 37 is a diagram illustrating arrangement of three elastic sheets 332 of Example 3 of the second embodiment.

In Example 3 illustrated in FIG. 37, similarly to Examples 1 and 2 illustrated in FIGS. 35 and 36, although each of the three elastic sheets 332 is arranged so as to partially have an opening in relation to the front end opening 305, since the three elastic sheets 332 are arranged so that the positions of the openings are different, the elastic sheets cover the entire nozzle insertion opening 331.

In Example 3 illustrated in FIG. 37, the first and second elastic sheets 332*a* and 332*b* cover the entire nozzle insertion opening 331. Further, the first and third elastic sheets 332*a* and 332*j* cover the same position and overlap with the second elastic sheet 332*b* at the same position. Specifically, the second elastic sheet 332*b* is arranged so that the linear free end 432*b* of the second elastic sheet 332*b* is disposed at a position rotated by 180° in the counter-clockwise direction in FIG. 37 about the linear free end 432*j* of the third elastic sheet 332*j*. Moreover, the first elastic sheet 332*a* is arranged so that the linear free end 432*j* of the third elastic sheet 332*j* overlaps with the linear free end 432*a* of the first elastic sheet 332*a*.

In Example 3 illustrated in FIG. 37, three elastic sheets 332 are sequentially superimposed to provide the strength (closing force) of the sheet overlapping portion 332*c*. With this configuration, it is possible to further improve the strength (closing force) of the sheet overlapping portion 332*c* as compared to the configuration illustrated in FIG. 21 and to further prevent the toner leakage from the container opening 33*a* due to vibration during transportation.

Example 4

Figure 38:
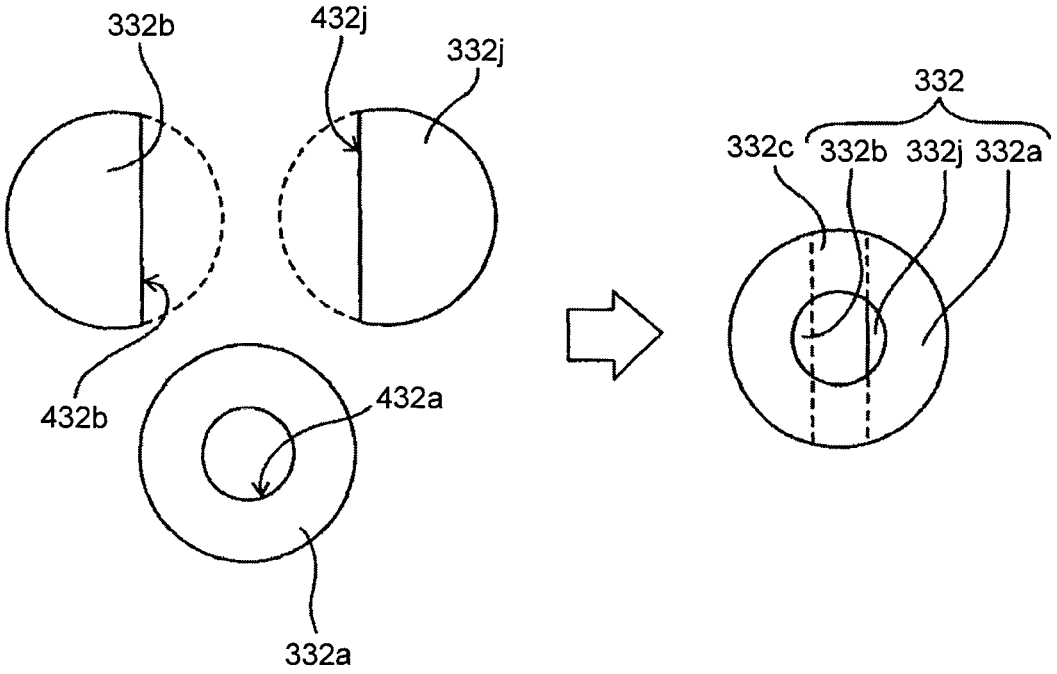
FIG. 38 is a diagram illustrating an arrangement of three elastic sheets according to Example 4 of the second embodiment.

FIG. 38 is a diagram illustrating arrangement of three elastic sheets 332 of Example 4 of the second embodiment.

In Example 4 illustrated in FIG. 38, three elastic sheets are arranged so as to be superimposed such that elastic sheets having the same shape are used as the second and third elastic sheets 332*b* and 332*j* and an elastic sheet having a different shape from the second and third elastic sheets 332*b* and 332*j* is used as the first elastic sheet 332*a*. Although each of the second and third elastic sheets 332*b* and 332*j* having the same shape is arranged so as to partially have an opening in relation to the front end opening 305, since the elastic sheets are arranged so that the positions of the openings are different, the superimposed two elastic sheets cover the entire nozzle insertion opening 331. Specifically, the second elastic sheet 332*b* is arranged so that the linear free end 432*b* of the second elastic sheet 332*b* is disposed at a position rotated by 180° in the counter-clockwise direction in FIG. 38 about the linear free end 432*j* of the third elastic sheet 332*j*.

Moreover, the first elastic sheet 332*a* has a donut shape that covers portions other than the center of the nozzle insertion opening 331.

By using the two second and third elastic sheets 332*b* and 332*j* that cover the entire nozzle insertion opening 331 and the first elastic sheet 332*a* having a donut shape, the strength (closing force) of the sheet overlapping portion 332*c* is provided. By improving the strength (closing force) of the sheet overlapping portion 332*c*, it is possible to further prevent the toner leakage from the container opening 33*a* due to vibration during transportation.

Example 5

Figure 39:
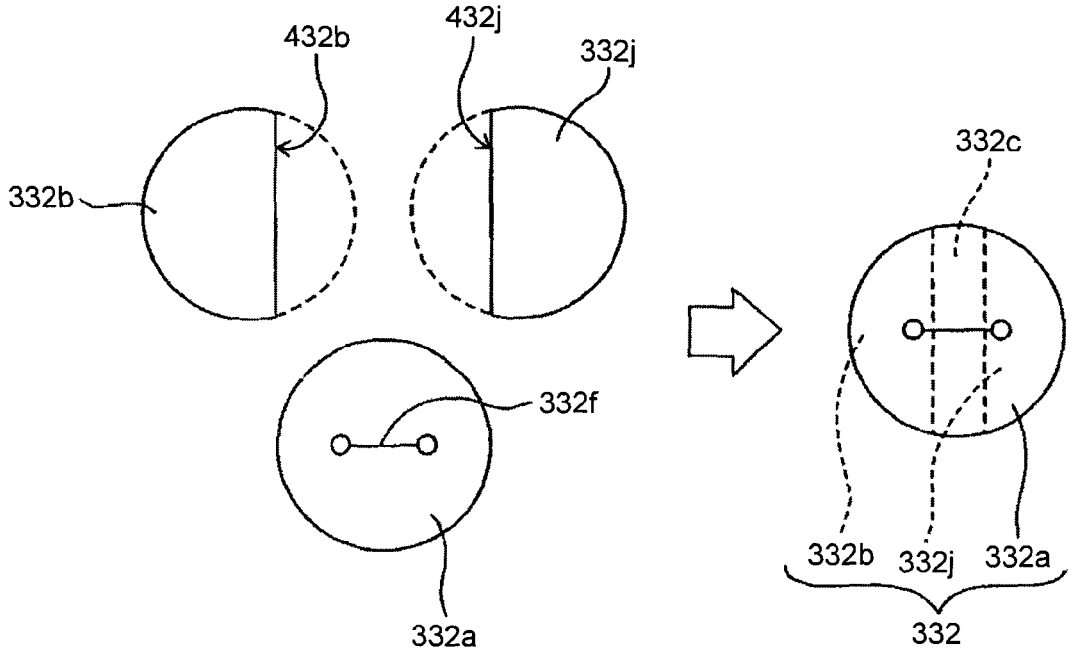
FIG. 39 is a diagram illustrating an arrangement of three elastic sheets according to Example 5 of the second embodiment.

FIG. 39 is a diagram illustrating arrangement of three elastic sheets 332 of Example 5 of the second embodiment.

In Example 5 illustrated in FIG. 39, similarly to the configuration illustrated in FIG. 38, three elastic sheets are arranged so as to be superimposed such that elastic sheets having the same shape are used as the second and third elastic sheets 332*b* and 332*j* and an elastic sheet having a different shape from the second and third elastic sheets 332*b* and 332*j* is used as the first elastic sheet 332*a*. Although each of the second and third elastic sheets 332*b* and 332*j* having the same shape is arranged so as to partially have an opening in relation to the front end opening 305, since the elastic sheets are arranged so that the positions of the openings are different, the superimposed two elastic sheets cover the entire nozzle insertion opening 331. Specifically, the second elastic sheet 332*b* is arranged so that the linear free end 432*b* of the second elastic sheet 332*b* is disposed at a position rotated by 180° in the counter-clockwise direction in FIG. 39 about the linear free end 432*j* of the third elastic sheet 332*j*.

Moreover, the first elastic sheet 332*a* has a shape that covers the entire area of the nozzle insertion opening 331 and has a first slit 332*f* at the center of the nozzle insertion opening 331.

By using the two second and third elastic sheets 332*b* and 332*j* that cover the entire nozzle insertion opening 331 and the first elastic sheet 332*a* having a slit, the strength (closing force) of the sheet overlapping portion 332*c* is provided. By improving the strength (closing force) of the sheet overlapping portion 332*c*, it is possible to further prevent the toner leakage from the container opening 33*a* due to vibration during transportation. When forming the slit, a round hole may be provided at both ends of the slit in order to prevent tearing of the elastic sheet 332.

In the second embodiment illustrated in FIGS. 35 to 39, the first, second, and third elastic sheets 332*a*, 332*b*, and 332*j* have different free ends 432 (432*a*, 432*b*, and 432*j*). Moreover, a certain free end 432 overlaps with the surface portion of at least one of the other two elastic sheets 332. At least two elastic sheets 332 overlap in the insertion direction of the conveying nozzle 611 in a portion between at least two free ends 432 of the three free ends 432, and this overlapping portion configurates the sheet overlapping portion 332*c*. Due to this, the free end 432 that is displaced with insertion of the conveying nozzle 611 overlaps with the other elastic sheet 332 in the insertion direction of the conveying nozzle 611 before the conveying nozzle 611 is inserted.

Figure 40:
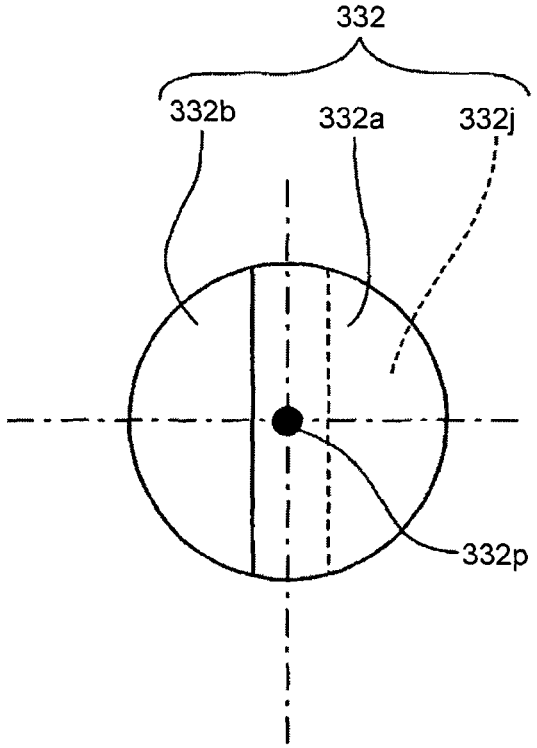
FIG. 40 is a diagram illustrating a contact position between an elastic sheet and a front end of a conveying nozzle, common to all embodiments.

FIG. 40 is a diagram illustrating a nozzle contact position 332*p* in Example 3 illustrated in FIG. 37, at which the first elastic sheet 332*a* disposed on the outermost side first makes contact with the front end of the conveying nozzle 611. As illustrated in FIG. 40, approximately the central position of the circular cross-section of the nozzle insertion opening 331 is the nozzle contact position 332*p*. The same is true for the configuration described in other embodiments and examples without being limited to Example 3 of the second embodiment of FIG. 37.

When the toner container 32 is attached to the toner replenishing device 60 and attachment is completed, the elastic sheets 332 are expanded by the front end of the conveying nozzle and are displaced by the diameter of the conveying nozzle. In this case, since the conveying nozzle 611 comes at the nozzle contact position 332*p* which is approximately the center of the circular cross-section of the nozzle insertion opening 331, when the plurality of elastic sheets 332 has the same shape, the amount of displacement of the elastic sheets 332 is the same.

Example 6

Figure 28:
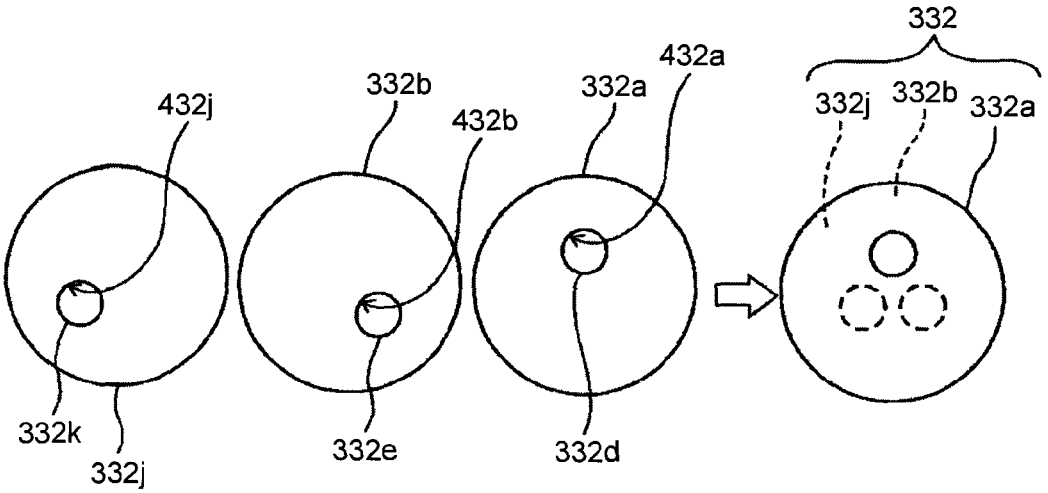
FIG. 28 is a diagram of an elastic sheet according to Example 6 of a second embodiment.

FIG. 28 is a diagram illustrating arrangement of three elastic sheets 332 of Example 6 of the second embodiment. In Example 6 illustrated in FIG. 28, another elastic sheet 332 having a round hole-shaped opening is added to Example 2 of the first embodiment in which two elastic sheets 332 having a round hole-shaped opening are superimposed. That is, a third elastic sheet 332*j* that has a shape that covers the entire nozzle insertion opening 331 and has a third round through-hole 332*k* provided in a portion thereof is added to Example 2 of the first embodiment. The other configuration except that the third elastic sheet 332*j* is added is the same as Example 2 of the first embodiment, and the same configuration will not be described.

As in the second embodiment, by using three elastic sheets, it is possible to improve the sealing property and to prevent the occurrence of toner leakage more reliably as compared to the configuration of the first embodiment that uses two elastic sheets 332.

The superimposing methods of FIGS. 35 to 39 in the second embodiment were compared as to the occurrence of the leakage of toner stored in the toner container 32 when the toner container 32 was placed with the elastic sheet 332 on the lower side in the gravity direction. The comparison result showed that the superimposing method of Example 2 illustrated in FIG. 36 was best in making toner difficult to leak.

This is considered to be attributable to the fact that, when the load of toner is applied to the three superimposed elastic sheets 332, the first elastic sheet 332*a* functions to press the second and third elastic sheets 332*b* and 332*j* that try to be open leftward and rightward in the figure.

When this function is taken into consideration, a belt-shaped or string-shaped first elastic sheet 332*a* may be used so that the belt-shaped or string-shaped elastic sheet 332*a* is disposed in the direction along which the second and third elastic sheets 332*b* and 332*j* try to be open due to the load of toner. In other words, the belt-shaped or string-shaped first elastic sheet 332*a* may be disposed so as to extend along the direction orthogonal to the direction of the free end 432 of the second or third elastic sheet 332*b* and 332*j*. Here, the free end 432 of the elastic sheet 332 is a portion which is not interposed between the attaching portion 337 and the sheet stopper 335.

Moreover, the same effect can be obtained by applying tension to the first elastic sheet 332*a* in the direction along which the second and third elastic sheets 332*b* and 332*j* try to be opened due to the load of toner.

Moreover, as illustrated in FIG. 13, the elastic sheet 332 is disposed at the same position (within the range of a gear width) as the container gear 301 in the insertion direction (the rotation axis direction of the toner container 32) of the conveying nozzle 611 which is a powder conveying nozzle. This provides the following advantages.

As described above, three superimposed elastic sheets 332 are arranged so that the first elastic sheet 332*a* functions to press the second and third elastic sheets 332*b* and 332*j* that try to be opened leftward and rightward in the figure when the load of toner is applied. With this arrangement, even when the toner container 32 is placed so that the elastic sheet 332 faces the lower side in the gravity direction during transportation, toner can rarely leak.

However, when the first elastic sheet 332*a* is disposed in this manner, the reactive force of the restoring force is not cancelled when the conveying nozzle 611 is inserted so that the first elastic sheet 332*a* is displaced. This will be described in more detail using the directions illustrated in FIG. 36. Since the conveying nozzle 611 is inserted at the center, the restoring force of the second elastic sheet 332*b* is generated in the rightward direction in the figure (that is, the direction in which the free end 432 returns to the original position), and thus, the reactive force of the restoring force is generated in the leftward direction. Similarly, since the restoring force of the third elastic sheet 332*j* is generated in the leftward direction in the figure (that is, the direction in which the free end 432 returns to the original position), the reactive force of the restoring force is generated in the rightward direction in the figure. Moreover, since the restoring force of the first elastic sheet 332*a* is generated in the upward direction in the figure, that is, in the direction in which the free end 432 returns to the original position, the reactive force of the restoring force is generated in the downward direction in the figure. The reactive force of the restoring force of these first to third elastic sheets 332*a* to 332*j* acts on the toner container 32.

Here, although the reactive force of the restoring force of the second and third elastic sheets 332*b* and 332*j* is generated in an opposite direction and is cancelled, the reactive force of the restoring force of the first elastic sheet 332*a* is not cancelled but acts on the toner container 32.

If the elastic sheet 332 is at a different position (outside the range of a gear width) from the container gear 301 in the insertion direction (the rotation axis direction of the toner container 32) of the conveying nozzle 611, the following problem occurs.

That is, the reactive force of the restoring force of the first elastic sheet 332*a* and the meshing force of the container driving output gear 601 which is a body-side gear that the container gear 301 receives with power transmission act on different positions in the insertion direction of the conveying nozzle 611. This is not desirable because the force acts in a direction in which the toner container 32 is tilted in relation to the insertion direction (the rotation axis direction of the toner container 32) of the conveying nozzle 611.

When the toner container 32 rotates in a state of being tilted in relation to the conveying nozzle 611, the sliding resistance between the outer circumferential surface of the container opening 33*a* and the container-setting-portion inner circumferential surface 615*a*, for example, increases, and it is necessary to change with a motor that can output a large torque. Further, a portion of the toner container 32 close to the knob 303 may bump against the toner container receiving portion 70 of the printer unit 100 to generate noise.

In contrast, in any Example of the second embodiment, as illustrated in FIG. 13, the elastic sheet 332 is positioned at the same position (within the range of a gear width) of the container gear 301 in the insertion direction (the rotation axis direction of the toner container 32) of the conveying nozzle 611. Due to this, the reactive force of the restoring force of the first elastic sheet 332*a* and the meshing force of the container driving output gear 601 that the container gear 301 receives with power transmission act on the same position in the insertion direction (the rotation axis direction of the toner container 32) of the conveying nozzle 611. Thus, such an action that tilts the toner container 32 does not occur.

Third Embodiment

Hereinafter, a third embodiment of the present invention will be described with reference to the drawings. In the third embodiment, as for the configuration other than the toner container as a powder container, the configuration described in the first embodiment can be suitably used. Moreover, as for the method of superimposing the elastic sheets of the toner container, the configuration described in the first and second embodiments can be suitably used.

Hereinafter, a toner container 1032 according to the third embodiment of the present invention will be described with reference to FIG. 41.

Figure 41:
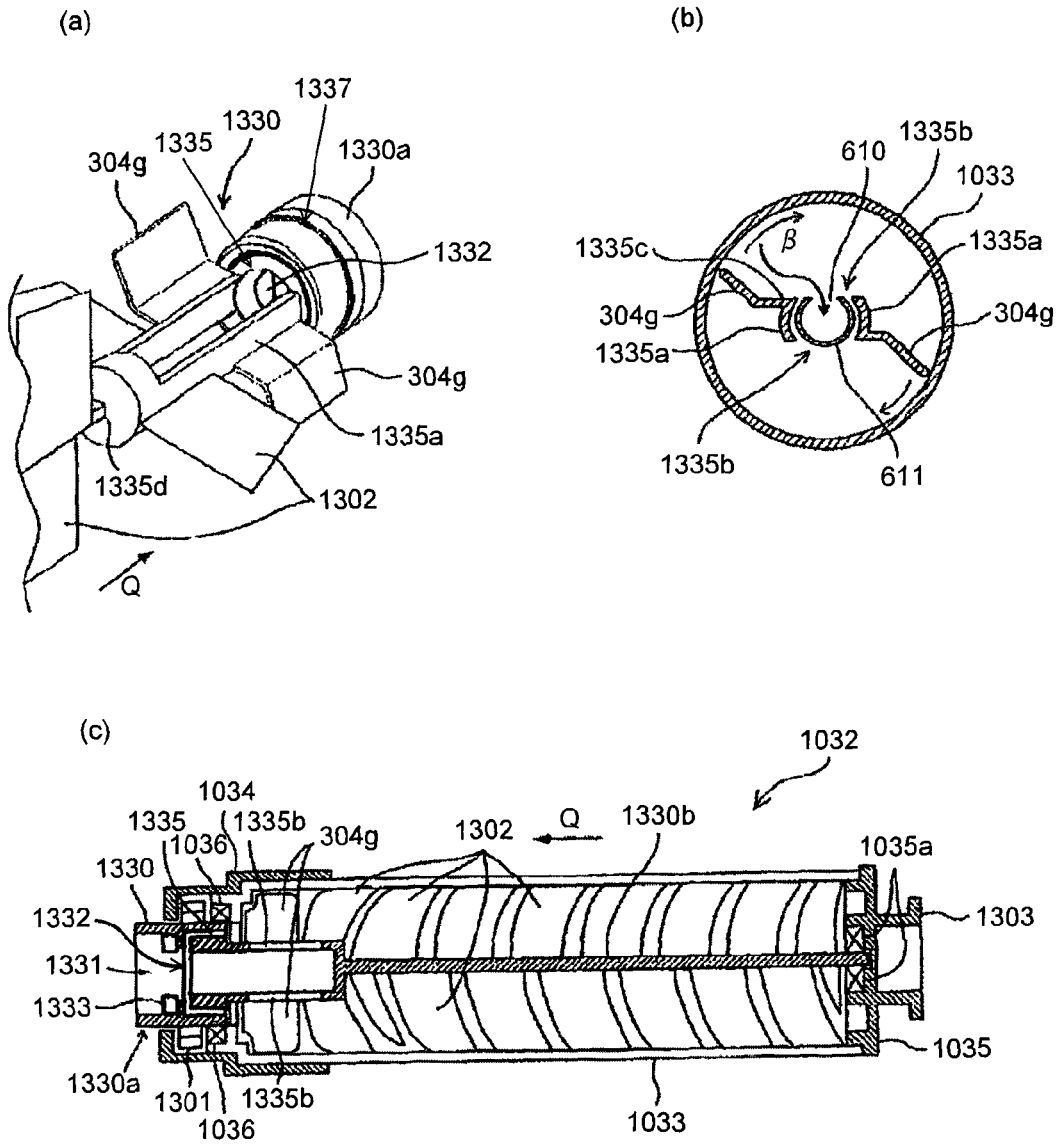
FIG. 41 illustrates a toner container according to a third embodiment, in which (a) is a perspective view of a nozzle receiver having scooping ribs integrated therewith, (b) is a cross-sectional view illustrating a positional relation between the nozzle receiver of (a) and a conveying nozzle, and (c) is a cross-sectional view illustrating a side part of the toner container having the nozzle receiver of (a) mounted thereon.

As the toner container 1032 illustrated in FIG. 41, a configuration will be taken into consideration, in which the container body 33 is provided as a cylindrical member formed of a resin (this container body will be referred to as a container body 1033 for the convenience's sake to distinguish from the container body described in the previous embodiments) though the component cost increases as compared to the toner container 32 illustrated in FIG. 1 and other figures, and a scooping function is provided in a portion of the conveying member.

FIG. 41(*a*) is a perspective view of a member in which a scooping rib 304*g* corresponding to the scooping wall surface 304*f* is integrated with the nozzle receiver 330 (will be referred to as a nozzle receiver 1330). FIG. 41(*b*) is a cross-sectional view illustrating a relation between the nozzle receiver 1330 of FIG. 41(*a*) disposed inside the container body 1033 and the conveying nozzle 611. FIG. 41(*c*) is a side cross-sectional view illustrating the entire toner container 1032 on which the nozzle receiver 1330 illustrated in FIG. 41(*a*) is mounted.

The nozzle receiver 1330 illustrated in FIG. 41 includes the scooping rib 304*g* as described above and is integrated with a conveying blade held portion 1330*b* to which a conveying blade 1302 formed of a flexible material such as a resin film is attached. The conveying blade 1302 and the conveying blade held portion 1330*b* correspond to a rotating conveyor.

Moreover, similarly to the previous embodiments, the nozzle receiver 1330 illustrated in FIG. 41 includes an attaching portion 1337 of the nozzle receiver 1330, an elastic sheet 1332, a container seal 1333 which is a container sealing member, a nozzle insertion opening 1331, and a sheet stopper 1335.

The sheet stopper 1335 includes a pair of extension portions 1335*a* and a portion on the container rear end side of the extension portion 1335*a* is connected to the conveying blade held portion 1330*b*. The elastic sheet 1332 is formed of a thin film sheet formed from an elastic material having flexibility and is superimposed in the superimposing method described in the previous embodiments. Moreover, in the toner container 1032 of the present embodiment, the elastic sheet 1332 includes two elastic sheet members of first and second elastic sheets 1332*a* and 1332*b* so that the sheet members are disposed so as to overlap to configurate a sheet overlapping portion 1332*c*. Moreover, the sheet overlapping portion 1332*c* blocks a portion of the elastic sheet 1332 which is opened when the conveying nozzle 611 is expanded.

The attaching portion 1337 has such a cylindrical shape that the diameter of the inner circumferential surface decreases stepwise toward a container seal attached wall (serving as a seal attached portion) 1336 to be described later. As illustrated in FIG. 41(*a*), the attaching portion 1337 has the donut-shaped container seal attached wall 1336 in which the diameter of the inner circumferential surface is smaller than the other portion in order to hold the elastic sheet 1332 and the container seal 1333.

The donut-shaped container seal 1333 is disposed so as to make contact with a wall surface which is on the front end side in relation to the container seal attached wall 1336. The container seal 1333 is attached to the wall surface (first wall surface) on the front end side of the container seal attached wall 1336 of the attaching portion 1337 by an adhesive agent, a double-sided tape, or the like.

Further, in the configuration illustrated in FIG. 41, the nozzle receiver 1330 has an outer circumferential surface 1330*a* that is slidably fitted to the container-setting-portion inner circumferential surface 615*a* on the body side of the copying machine 500. The nozzle receiver 1330 is attached to a container gear 1301 as a separate member so that power can be transmitted.

In this manner, the configuration of allowing toner present in the scooping inner wall surface, the relaying portion, and an extension-portion opening 1335*b* to flow into the nozzle opening 610 can be integrated.

Next, the details of the toner container 1032 including the scooping rib 304*g* will be described.

As illustrated in FIG. 41(*c*), the toner container 1032 includes a container front end cover 1034, a container body 1033, a bottom lid 1035, and a nozzle receiver 1330. The container front end cover 1034 is disposed on the front end side in the direction of attaching the toner container 1032 to the body of the copying machine 500, and the container body 1033 has an approximately cylindrical shape. The bottom lid 1035 is disposed on the rear end side in the attachment direction of the toner container 1032, and the nozzle receiver 1330 is rotatably held in the approximately cylindrical container body 1033.

A gear exposing opening 1034*a* (the same opening as the gear exposing opening 34*a*) for exposing the container gear 1301 attached to the nozzle receiver 1330 is provided in the container front end cover 1034. The approximately cylindrical container body 1033 rotatably holds the nozzle receiver 1330, and the container front end cover 1034 and the bottom lid 1035 are attached (by a well-known method such as welding or an adhesive agent). The bottom lid 1035 has a rear-end-side bearing 1035*a* that supports one end of the conveying blade held portion 1330*b* and has a knob 1303 for allowing a user to grasp when attaching the toner container 1032 to the body of the copying machine 500.

Next, a method of assembling the container front end cover 1034, the bottom lid 1035, and the nozzle receiver 1330 into the container body 1033 will be described.

First, the nozzle receiver 1330 is inserted into the container body 1033 from the container rear end side so as to be aligned with respect to a front-end-side bearing 1036 located on the front end side of the container body 1033 so that the nozzle receiver 1330 is rotatably supported. Subsequently, the rear-end-side bearing 1035*a* provided in the bottom lid 1035 is aligned so as to rotatably support one end of the conveying blade held portion 1330*b* of the nozzle receiver 1330, and the bottom lid 1035 is attached to the container body 1033. After that, the container gear 1301 is attached to the nozzle receiver 1330 from the container front end side. After the container gear 1301 is attached, the container front end cover 1034 is attached to the container body 1033 in such a manner to cover the container gear 1301 from the container front end side.

As for the fixing of the container body 1033 and the container front end cover 1034, the fixing of the container body 1033 and the bottom lid 1035, and the fixing of the nozzle receiver 1330 and the container gear 1301, a well-known method (for example, welding, an adhesive agent, or the like) can be used appropriately.

Next, a configuration of conveying toner from the toner container 1032 to the nozzle opening 610 will be described.

The scooping rib 304*g* protrudes from an end 1335*c* on the downstream side in the rotation direction of the shutter side surface supporting portion 1335*a* up to the vicinity of the inner circumferential surface of the container body 1033 so that the rib surfaces are connected. Although the rib surface is bent halfway to have a shape close to a curved surface, the rib surface is not limited to this configuration depending on the affinity to toner, and a simply planar rib without any bent portion may be used. Due to such a configuration, it is not necessary to form a bulging portion on the container body 1033. Further, since the scooping rib 304*g* is erected integrally from the extension-portion opening 1335*b*, the same relaying function as described in the previous embodiment can be obtained. That is, when the nozzle receiver 1330 rotates when the toner container 1032 is attached to the body of an image forming apparatus, the conveying blade rotates and the toner stored in the toner container 1032 is conveyed from the rear end side toward the front end side where the nozzle receiver 1330 is disposed. Moreover, the scooping rib 304*g* receives the toner conveyed by the conveying blade 1302 and scoops the toner from the lower side to the upper side with rotation, and the toner can be flowed into the nozzle opening 610 using the rib surface as a sliding bed.

Fourth Embodiment

Hereinafter, a fourth embodiment of the present invention will be described with reference to the drawings. In the fourth embodiment, the same members or members having the same functions as those of the first, second, and third embodiments will be denoted by the same reference numerals, and the description thereof may sometimes be omitted. In the fourth embodiment, as for the configuration other than the toner container as the powder container, the configuration described in the first embodiment can be suitably used. As for the method of superimposing the elastic sheets of the toner container, the configuration described in the first and second embodiments can be suitably used. Moreover, the toner container described in the third embodiment can be used as the powder container.

Example 1

Next, characteristic features of the toner container 32 according to Example 1 of the fourth embodiment will be described.

Figure 42:
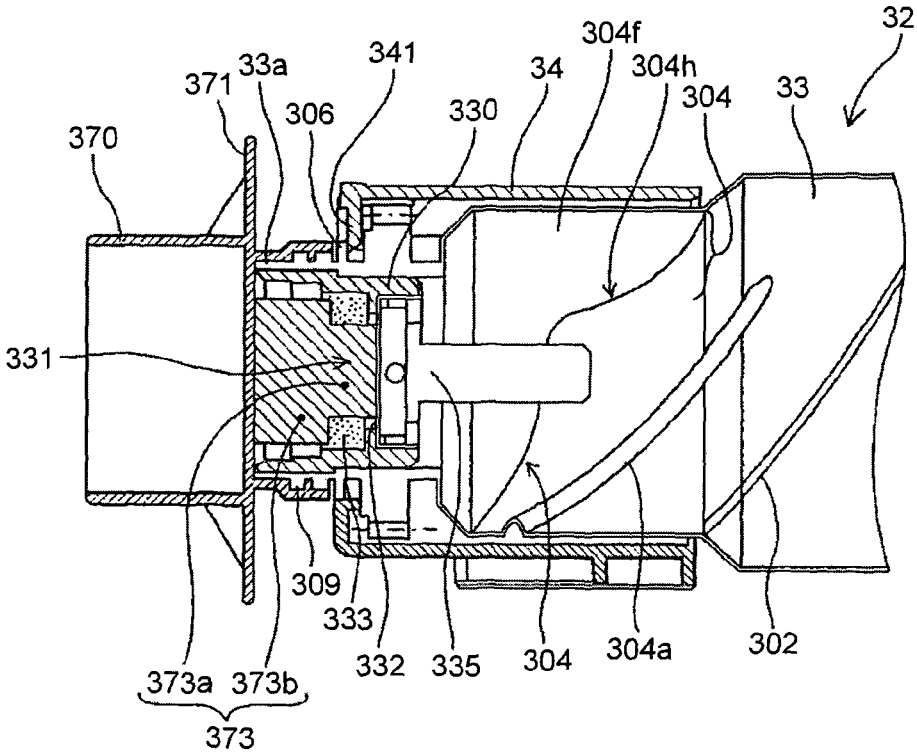
FIG. 42 is a cross-sectional view illustrating the vicinity of a front end of a toner container having a cap member attached thereto according to Example 1 of a fourth embodiment.

As illustrated in FIG. 42, the toner container 32 includes a container body 33 as a container body, a nozzle receiver 330 as a nozzle insertion portion, and a cap 370 as a sealing member. Moreover, the nozzle receiver 330 includes an attaching portion 337 of the nozzle receiver 330, a container seal 333, an elastic sheet 332, and a sheet stopper 335. Moreover, the cap 370 includes a columnar member 373 that makes contact with the elastic sheet 332 in a state of being attached to the container body 33. The columnar member 373 serves as a contact portion.

The container body 33 is a powder storage member that forms a container body that stores toner which is powder therein, and the nozzle receiver 330 includes the nozzle insertion opening 331 provided in an opening on the other end side of the container body 33. Moreover, the container seal 333 formed from an elastic body is a member that defines the vicinity of the other end of the nozzle insertion opening 331 and is a member that seals the space between the nozzle receiver 330 and the conveying nozzle 611.

Moreover, the elastic sheet 332 is an opening blocking member that blocks the nozzle insertion opening 331, and the cap 370 is a sealing member that seals an opening on the other end side that serves as a powder discharge side, of the container body 33. The columnar member 373 has such a shape that two columns of which the imaginary lines passing the center are identical and the radii from the imaginary circular lines of the cross-sections are different are stacked. The columnar member 373 includes a contact portion of which the front end makes contact with the elastic sheet 332 to suppress elastic deformation of the elastic sheet 332 resulting from vibration.

Here, a side of the cap 370 making contact with the elastic sheet 332 in a state of being attached to the container body 33 will be referred to as a one end side and a side opposite to one end side and facing the outer side will be referred to as the other end side.

Since the columnar member 373 is in contact with the elastic sheet 332, even when vibration or impact is applied to the toner container 32 so that vibration or impact is transmitted to the elastic sheet 332, it is possible to suppress elastic deformation resulting from the vibration or impact. By suppressing elastic deformation, it is possible to suppress a gap from being provided in a portion of the nozzle insertion opening 331 blocked by the elastic sheet 332 resulting from vibration or impact. Since the formation of a gap can be suppressed, it is possible to suppress toner stored in the container body 33 from reaching a space between the cap 370 and the elastic sheet 332 in a state where the cap 370 is attached. Due to this, it is possible to suppress the leakage of toner when the cap 370 is detached from the toner container 32.

As an elastic deformation of the elastic sheet 332, the portion expanded by the conveying nozzle 611 may be displaced toward the outside (the front end side) in relation to the container body 33 and may be displaced toward the inside (the rear end side) of the container body 33. In the elastic deformation where the portion expanded by the conveying nozzle 611 is displaced toward the outside (the front end side), the columnar member 373 of the cap 370 makes contact with the elastic sheet 332 from the outer side, whereby the elastic sheet 332 that tries to be elastically deformed bumps against the columnar member 373. Thus, elastic deformation can be suppressed. On the other hand, in the elastic deformation where the expanded portion is displaced toward the inside (the rear end side) of the container body 33, since the portion is displaced away from the columnar member 373, it is not possible to suppress the elastic deformation by contact. However, the energy that elastically deforms the elastic sheet 332 with vibration or impact is also transmitted and distributed to the columnar member 373 that makes contact with the elastic sheet 332. Moreover, after the elastic sheet 332 is displaced toward the inner side, since the elastic sheet 332 may return to the outer side due to the restoring force, it is possible to decrease the amount of displacement of the elastic sheet 332 during elastic deformation as compared to the configuration where the columnar member 373 is not provided. Moreover, when the amount of displacement of the elastic sheet 332 is decreased, even if a gap is provided due to vibration or impact, the size of the gap is small as compared to the configuration where the columnar member 373 is not provided. Thus, it is possible to suppress toner stored in the container body 33 from reaching the space between the cap 370 and the elastic sheet 332.

Depending on a contact state of the elastic sheet 332 and the columnar member 373, a gap through which powder such as toner leaks may be provided in the elastic sheet 332. Thus, it is necessary to appropriately set the shape, the size, and the like of the columnar member 373 and the elastic sheet 332 so that the columnar member 373 as a contact portion and the elastic sheet 332 as an opening blocking member are in a reliable contact state.

Specifically, as illustrated in FIG. 42, the configuration of the nozzle receiver or the like that holds the elastic sheet 332 or the shape and size or the like of the columnar member 373 may be adjusted so that the entire surface of the columnar member 373 makes contact with the elastic sheet 332.

In the present embodiment, the elastic sheet 332 is made up of two elastic sheet members similarly to the configuration described in the first embodiment, and the two elastic sheet members are partially superimposed to configurate a nozzle insertion opening that can receive the conveying nozzle 611 therein. Moreover, the elastic sheet 332 functions as an opening blocking member that blocks the nozzle insertion opening. Since the overlapping portion of the two elastic sheet members makes contact with the columnar member 373, such a gap through which powder such as toner can leak will be rarely provided.

The overlapping portions of the two elastic sheet members are elastically deformed, whereby the nozzle insertion opening is provided.

Moreover, the position of the elastic sheet 332 with which the columnar member 373 makes contact is a portion in which the elastic sheet 332 is elastically deformed due to vibration or impact and a gap through which toner in the container body 33 can pass can be provided. In an end portion (the portion near the fixed portion) of the elastic sheet 332 in the direction orthogonal to the insertion direction of the conveying nozzle 611, strong interposing force is applied by the sheet stopper 335 of the nozzle receiver 330 and the attaching portion 337, and thus, the end portion is rarely elastically deformed by vibration or impact. Thus, if the columnar member 373 makes contact with this portion only, the effect of suppressing formation of a gap resulting from vibration or impact is small.

In Example 1 of the present embodiment, the front end of the columnar member 373 makes contact with the overlapping portion of the two elastic sheets 332. In this portion, the overlapping portion disappears when the elastic sheet 332 is elastically deformed due to vibration or impact, and a gap through which toner can pass can be provided. By allowing the columnar member 373 to make contact with such a portion, it is possible to suppress a gap through which toner can pass from being provided in the elastic sheet 332.

In the configuration of JP 07-261492 A in which a slit is provided in a sheet-shaped opening blocking member and a powder conveying nozzle is inserted by expanding the slit, the same effect can be obtained by allowing a contact portion to make contact with this slit. This is because, as described above, elastic deformation can be suppressed in the case where the opening blocking member is displaced toward the outside in relation to the container body and the case where the opening blocking member is displaced toward the container body.

In the toner container 32 according to Example 1 of the present embodiment, it is possible to suppress toner in the container body 33 from reaching the space between the cap 370 and the elastic sheet 332 due to vibration or impact. Thus, when the cap 370 is detached from the toner container 32, since no toner adheres to the outer surface of the elastic sheet 332, it is possible to prevent toner from falling or scattering. Therefore, it is possible to suppress the occurrence of toner leakage resulting from vibration or dropping during transportation of the toner container 32.

In the toner container 32 illustrated in FIG. 42, the columnar member 373 and the cap 370 are formed of different materials, and the other end side (the left side in FIG. 42) of the columnar member 373 is attached to the cap 370 using an adhesive agent or the like. Further, as illustrated in FIG. 1, in a state where the cap 370 is attached to the toner container 32, the end surface on one end side (the right side in FIG. 42) of the columnar member 373 makes contact with the front end surface of the elastic sheet 332.

The columnar member 373 has such a shape that two columns having different diameters are stacked in a direction from the other end side to one end side and includes a base-end-side columnar portion 373*b* having a larger diameter and a front-end-side columnar portion 373*a* having a smaller diameter. The diameter of the front-end-side columnar portion 373*a* is smaller than the diameter of the donut-shaped inner circumferential surface of the container seal 333. Moreover, the diameter of the base-end-side columnar portion 373*b* is larger than the diameter of the donut-shaped inner circumferential surface of the container seal 333 and is smaller than the outer diameter (the diameter of the outer circumferential surface) of the container seal 333.

Due to such a configuration, in a state where the cap 370 is attached to the toner container 32, the end surface on one end side of the front-end-side columnar portion 373*a* makes contact with the elastic sheet 332. Further, the end surface (an end surface that forms a step in relation to the front-end-side columnar portion 373*a*) on one end side of the base-end-side columnar portion 373*b* makes contact with the end surface on the other end side of the container seal 333. When the base-end-side columnar portion 373*b* of the columnar member 373 makes contact with the end surface on the other end side of the container seal 333, the other end of the nozzle insertion opening 331 defined by the container seal 333 can be sealed by the end surface of the base-end-side columnar portion 373*b*. Due to this, it is possible to directly seal the nozzle insertion opening 331 and to prevent a gap from being provided in the elastic sheet 332 due to vibration or impact. Moreover, even if a gap is provided in the elastic sheet 332, it is possible to prevent the occurrence of toner leakage.

As described above, in the toner container 32 illustrated in FIG. 42, the columnar member 373 is formed of a member different from the cap 370. Thus, the cap 370 can be formed of a different material from the columnar member 373 in such a manner that the cap 370 is formed of an inexpensive resin such as a polystyrene resin and the columnar member 373 is formed of a highly flexible material such as rubber or sponge. When the columnar member 373 is formed of a highly flexible material, the adhesion during contact between the columnar member 373 and the end surface on the other end side of the elastic sheet 332 and the container seal 333 is improved. Thus, it is possible to prevent the toner leakage resulting from impact due to vibration or dropping more effectively.

Moreover, since the cap 370 itself can be formed of an inexpensive resin such as polystyrene resin different from the material of the columnar member 373, it is possible to decrease the cost while maintaining the toner leakage preventing function of the columnar member 373.

As described above, the elastic sheet 332 made up of two elastic sheet members is formed of an elastic material (for example, rubber material such as silicone rubber) having flexibility and is assembled in a state of being slightly expanded to be longer than its natural length, in other words, small tension is applied. In the present embodiment, it is preferable that the columnar member 373 makes contact with the elastic sheet 332 so as to slightly enter therein. Specifically, it is preferable that the columnar member 373 makes contact with the elastic sheet 332 so that the elastic sheet 332 is slightly displaced inward further than the state where the columnar member 373 is not in contact therewith. By realizing such contact, tension is applied to the elastic sheet 332, and the adhesion (air-tightness) of the two elastic sheets 332 in the overlapping portion is improved. Thus, it is possible to prevent toner leakage more effectively, and satisfactory characteristics against vibration and impact are obtained.

The cap 370 of the present embodiment can be similarly applied to the configuration that uses three elastic sheet members in the third embodiment.

In the configuration disclosed in JP 07-261492 A, the opening blocking member corresponds to a configuration in which a slit is provided in one elastic sheet member. In such a configuration, when a contact portion such as the columnar member 373 makes contact with the elastic sheet member, the elastic sheet member is displaced slightly toward the inner side in the rotation axis direction, which acts to open the slit, and toner can easily leak.

On the other hand, in the toner container 32 according to Example 1 of the present embodiment, the opening blocking member is arranged so as to overlap with the two elastic sheets 332. Due to such an arrangement, when the conveying nozzle 611 is inserted, the two elastic sheets 332 are expanded so that the overlap is removed, and the conveying nozzle 611 can be inserted. During storage, the two elastic sheets 332 forms an overlapping portion, and the columnar member 373 makes contact with the overlapping portion to cause the elastic sheet 332 to be displaced slightly inward. However, since this contact does not remove the overlap, a gap through which toner can leak is not provided.

Further, when the columnar member 373 makes contact with the elastic sheet 332 to elastically deform the elastic sheet 332, elastic force acts from the elastic sheet 332 in such a manner that the columnar member 373 is pushed back. Due to this, it is possible to enhance the adhesion in the overlapping portion of the two elastic sheet members and to prevent leakage of toner more reliably.

In the toner container 32 according to Example 1 of the present embodiment, since the two elastic sheet members maintain the overlapping portion even when the cap 370 is detached, it is possible to suppress toner leakage. In the toner replenishing device 60 including such a toner container 32, it is possible to suppress leakage of toner when the cap 370 of a new toner container 32 is detached when the toner container 32 is replaced. Thus, it is possible to suppress the occurrence of contamination inside the device and contamination outside the device resulting from the leakage of toner.

Moreover, in the copying machine 500 including such a toner replenishing device 60, it is possible to suppress the occurrence of contamination inside the device and contamination outside the device when the toner container 32 is replaced.

Example 2

Next, the configuration according to Example 2 of the toner container 32 in which a contact portion is provided in a sealing member such as the cap 370 of the fourth embodiment will be described.

Figure 43:
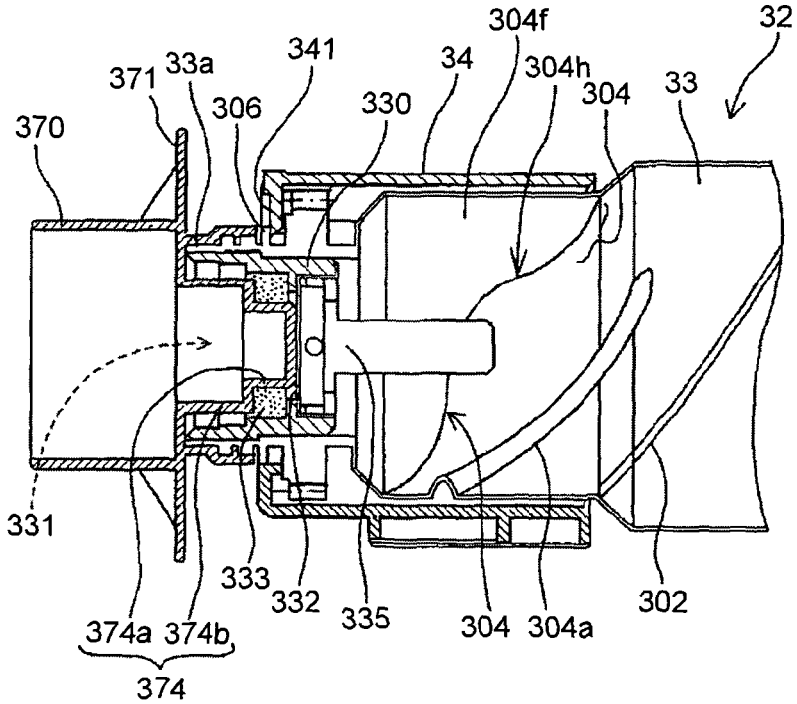
FIG. 43 is a cross-sectional view illustrating a toner container according to Example 2 of the fourth embodiment.

FIG. 43 is a cross-sectional view illustrating the toner container 32 of Example 2.

The toner container 32 of Example 2 is different from the toner container 32 of FIG. 42 that includes the columnar member 373 formed of a different member from the cap 370 in that a columnar portion 374 formed integrally with the cap 370 is provided as a contact portion.

The toner container 32 of Example 2 includes the columnar portion 374 that makes contact with the elastic sheet 332. Thus, similarly to the toner container 32 illustrated in FIG. 42, it is possible to suppress toner stored in the container body 33 from reaching a space between the cap 370 and the elastic sheet 332 in a state where the cap 370 is attached. Due to this, it is possible to suppress the leakage of toner when the cap 370 is detached from the toner container 32.

The columnar portion 374 has such a shape that two columns having different diameters are stacked in a direction from the other end side to one end side and includes a base-end-side columnar portion 374*b* having larger diameter and a front-end-side columnar portion 374*a* having a smaller diameter. The diameter of the front-end-side columnar portion 374*a* is smaller than the diameter of the donut-shaped inner circumferential surface of the container seal 333. Moreover, the diameter of the base-end-side columnar portion 374*b* is larger than the diameter of the donut-shaped inner circumferential surface of the container seal 333 and is smaller than the outer diameter (the diameter of the outer circumferential surface) of the container seal 333.

Due to such a configuration, in a state where the cap 370 is attached to the toner container 32, the end surface on one end side of the front-end-side columnar portion 374*a* makes contact with the elastic sheet 332. Further, the end surface (an end surface that forms a step in relation to the front-end-side columnar portion 374*a*) on one end side of the base-end-side columnar portion 374*b* makes contact with the end surface on the other end side of the container seal 333. When the base-end-side columnar portion 374*b* of the columnar portion 374 makes contact with the end surface on the other end side of the container seal 333, the other end of the nozzle insertion opening 331 defined by the container seal 333 can be sealed by the end surface of the base-end-side columnar portion 374*b*. Due to this, it is possible to directly seal the nozzle insertion opening 331 and to prevent a gap from being provided in the elastic sheet 332 due to vibration or impact. Moreover, even if a gap is provided in the elastic sheet 332, it is possible to prevent the occurrence of toner leakage. In this manner, in the toner container 32 of Example 2 of the first embodiment, it is possible to suppress the occurrence of toner leakage resulting from vibration or dropping during transportation of the toner container 32. Moreover, since the columnar portion 374 can be formed (molded) integrally with a portion of the cap 370, it is possible to reduce the cost.

Moreover, similarly to the columnar member 373 of the toner container 32 according to Example 1 illustrated in FIG. 42, it is preferable that the columnar portion 374 of the cap 370 of Example 2 makes contact with the elastic sheet 332 so as to slightly enter therein. Specifically, it is preferable that the columnar portion 374 makes contact with the elastic sheet 332 so that the elastic sheet 332 is slightly displaced inward when the columnar portion 374 makes contact therewith. By realizing such contact, tension is applied to the elastic sheet 332, and the adhesion (air-tightness) of the two elastic sheets 332 in the overlapping portion is improved. Thus, it is possible to prevent toner leakage more effectively, and satisfactory characteristics against vibration and impact are obtained.

In this way, the toner container 32 of Example 2 can provide the same advantages as the toner container 32 according to Example 1 of FIG. 42.

Example 3

Next, the configuration according to Example 3 of the toner container 32 in which a contact portion is provided in a sealing member such as the cap 370 of the fourth embodiment will be described.

Figure 44:
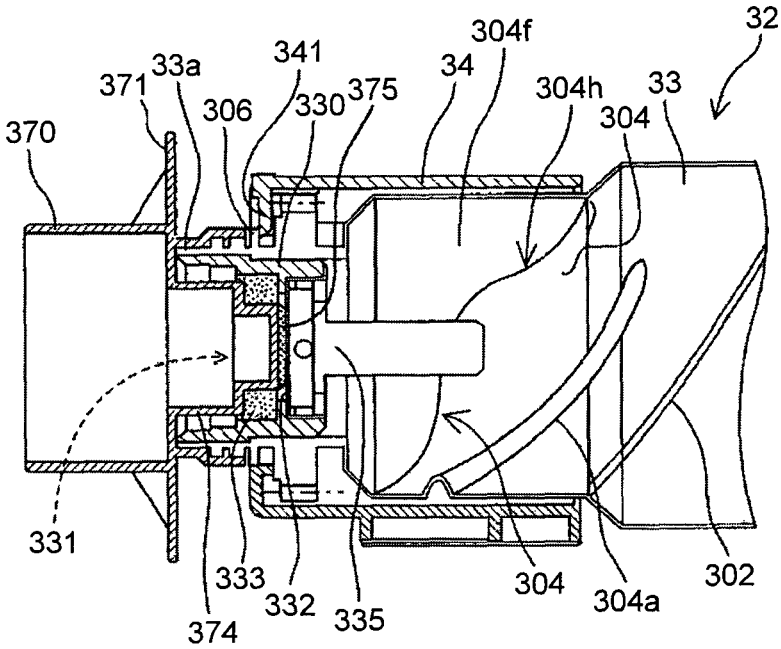
FIG. 44 is a cross-sectional view illustrating a toner container according to Example 3 of the fourth embodiment.

FIG. 44 is a cross-sectional view illustrating the toner container 32 of Example 3 of the present embodiment.

The toner container 32 of Example 3 includes the columnar portion 374 that is formed integrally with the cap 370 as the contact portion similarly to Example 2. The toner container 32 of Example 3 is different from the toner container 32 of Example 2 in that a front end columnar elastic member 375 formed of a highly flexible material such as rubber or sponge is provided on the front end surface of the columnar portion 374.

The toner container 32 of Example 3 includes the columnar portion 374 that makes contact with the elastic sheet 332. Thus, similarly to the toner container 32 of Examples 1 and 2, it is possible to suppress toner stored in the container body 33 from reaching a space between the cap 370 and the elastic sheet 332 in a state where the cap 370 is attached. Due to this, it is possible to suppress the leakage of toner when the cap 370 is detached from the toner container 32.

Moreover, since the toner container 32 of Example 3 includes the columnar portion 374 having the same shape as the toner container 32 of Example 2 of the first embodiment, it is possible to directly seal the nozzle insertion opening 331. Due to this, it is possible to prevent a gap from being provided in the elastic sheet 332 due to vibration or impact. Moreover, even if a gap is provided in the elastic sheet 332, it is possible to prevent the occurrence of toner leakage. Thus, in the toner container 32 of Example 3, it is possible to suppress the occurrence of toner leakage resulting from vibration or dropping during transportation of the toner container 32.

Further, in the toner container 32 of Example 3, the front end columnar elastic member 375 is provided on the end surface on one end side of the front-end-side columnar portion 374*a* of the columnar portion 374. Due to this, when the front end columnar elastic member 375 makes contact with the elastic sheet 332, the adhesion with the elastic sheet 332 is improved further than the toner container 32 of Example 2.

Specifically, the elastic sheet 332 can be displaced inward further by the amount corresponding to the thickness of the front end columnar elastic member 375. Due to this, in the toner container 32 according to Example 1 of FIG. 42 and the toner container 32 of Example 2, the tension applied to the elastic sheet 332 can be finely adjusted by the thickness of the front end columnar elastic member 375. Although a very small concave-convex surface corresponding to the thickness of the elastic sheet 332 is provided in the overlapping portion of the elastic sheet 332, the front end columnar elastic member 375 itself has elasticity. Thus, since elastic deformation can occur following the concave-convex surface, it is possible to further improve the adhesion between the columnar portion 374 of the cap 370 and the elastic sheet 332.

In order to apply tension to the elastic sheet 332, it is preferable that the columnar portion 374 is formed of a mobile terminal that is rarely deformed as compared to the elastic sheet 332. However, if such a material is used, it is not possible to obtain the ability to follow the shape of the overlapping portion. Thus, the front end columnar elastic member 375 is provided on the columnar portion 374. With such a configuration, by applying tension to the elastic sheet 332, it is possible to obtain the ability to follow the shape of the overlapping portion of the elastic sheet 332.

In Example 3, it is possible to prevent the toner leakage resulting from impact due to vibration or dropping more effectively.

Example 4

Next, the configuration according to Example 4 of the toner container 32 in which a contact portion is provided in a sealing member such as the cap 370 of the fourth embodiment will be described.

Figure 45:
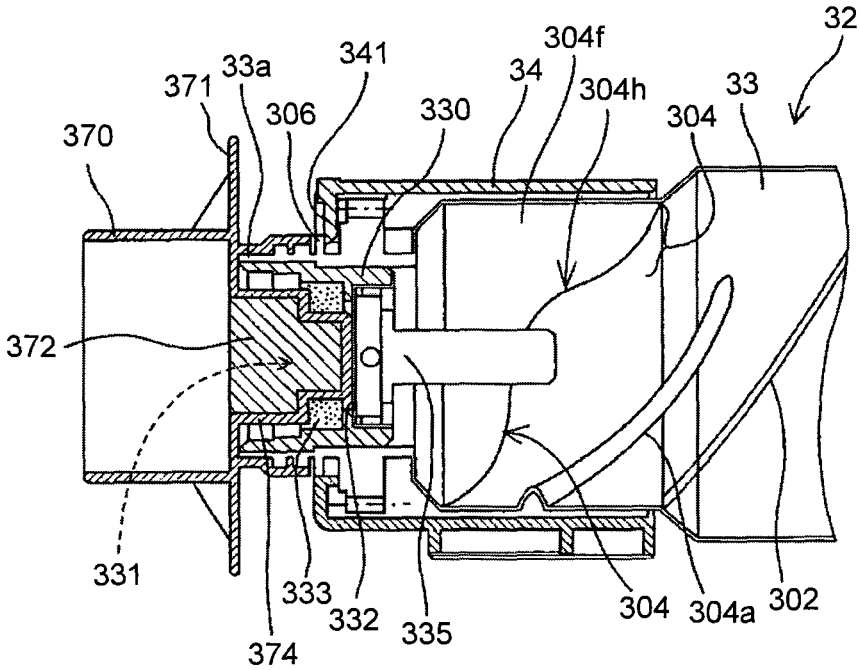
FIG. 45 is a cross-sectional view illustrating a toner container according to Example 4 of the fourth embodiment.

FIG. 45 is a cross-sectional view illustrating the toner container 32 of Example 4. The toner container 32 of Example 4 includes the columnar portion 374 that is formed integrally with the cap 370 as the contact portion similarly to Example 2. The toner container 32 of Example 4 is different from the toner container 32 of Example 2 in that an adsorbent 372 is provided inside the columnar portion 374 so as to be open to the outside, that is, in a state of being exposed to the outside air.

Since the toner container 32 of Example 4 has the adsorbent 372 added to the toner container 32 of Example 2, satisfactory characteristics against vibration and impact are obtained similarly to the toner container 32 of Example 2. That is, the toner container 32 of Example 4 includes the columnar portion 374 that makes contact with the elastic sheet 332. Thus, similarly to the toner container 32 of Example 2, it is possible to suppress toner stored in the container body 33 from reaching a space between the cap 370 and the elastic sheet 332 in a state where the cap 370 is attached. Due to this, it is possible to suppress the leakage of toner when the cap 370 is detached from the toner container 32. Moreover, since the columnar portion 374 can be formed (molded) integrally with a portion of the cap 370, it is possible to reduce the cost.

Further, the toner container 32 of Example 4 includes the adsorbent 372.

Example 4 is the toner container 32 that uses an adsorbent such as a drying agent during storage. The adsorbent adsorbs various substances (gas or the like) without limiting to moisture. Thus, a drying agent is included in an adsorbent. Examples of the adsorbent include silica gel, aluminum oxide, zeolite, and the like, and any agent having adsorbing capability may be used.

In the toner container 32 of Example 4, since the adsorbent 372 is provided in the columnar portion 374 provided in the cap 370, the adsorbent 372 can be removed together with the cap 370 when the cap 370 is detached during use. Thus, the operability is improved.

In the toner container 32 of Example 4, when the toner container 32 is transported in a state of being packaged with the cap 370 attached, since the adsorbent 372 is exposed to the outside air around the toner container 32, it is possible to absorb moisture around the toner container 32 in the package.

In Example 4, the contact portion in which the adsorbent 372 exposed to the outside air is provided is the columnar portion 374 that is formed integrally with the cap 370. However, the contact portion having such adsorbent 372 therein is not limited to the configuration illustrated in FIG. 45, and the contact portion may be formed of a different member from the cap 370 similarly to the columnar member 373 of the toner container 32 illustrated in FIG. 42.

Example 5

Next, the configuration according to Example 5 of the toner container 32 in which a contact portion is provided in a sealing member such as the cap 370 of the fourth embodiment will be described.

Figure 46:
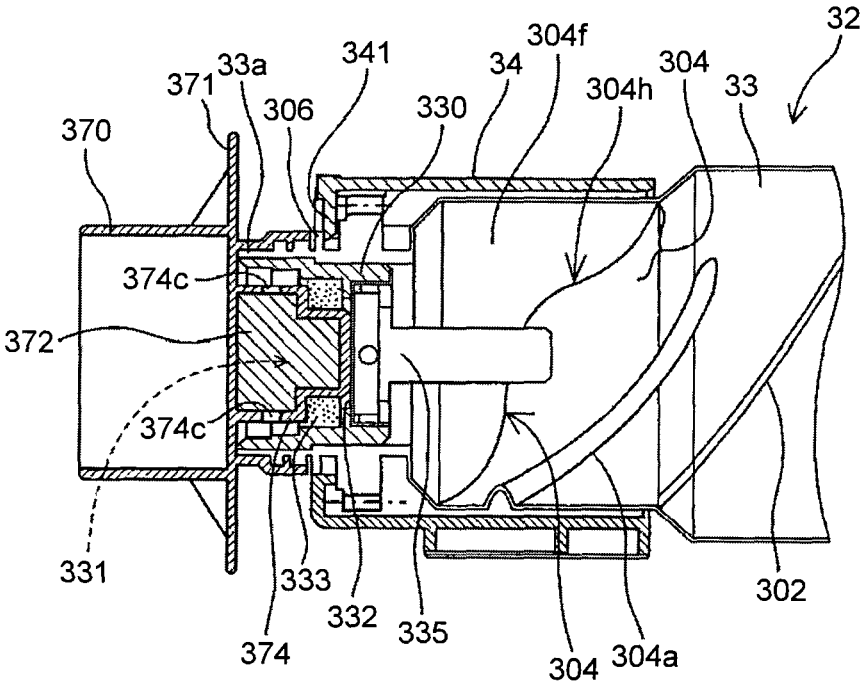
FIG. 46 is a cross-sectional view illustrating a toner container according to Example 5 of the fourth embodiment.

FIG. 46 is a cross-sectional view illustrating the toner container 32 of Example 5. The toner container 32 of Example 5 includes the columnar portion 374 that is formed integrally with the cap 370 as the contact portion similarly to Example 2. The toner container 32 of Example 4 is different from the toner container 32 of Example 2 in that an adsorbent 372 is disposed in the columnar portion 374 so as to adsorb a target substance in the space sealed by the cap 370.

Since the toner container 32 of Example 5 has the adsorbent 372 added to the toner container 32 of Example 2, satisfactory characteristics against vibration and impact are obtained similarly to the toner container 32 of Example 2. That is, the toner container 32 of Example 5 includes the columnar portion 374 that makes contact with the elastic sheet 332. Thus, similarly to the toner container 32 of Example 2 of the first embodiment, it is possible to suppress toner stored in the container body 33 from reaching a space between the cap 370 and the elastic sheet 332 in a state where the cap 370 is attached. Due to this, it is possible to suppress the leakage of toner when the cap 370 is detached from the toner container 32.

Moreover, in the toner container 32 according to Example 5 illustrated in FIG. 46, an adsorbing hole 374*c* as an opening is provided in a side surface of the columnar portion 374 so that gas or the like generated from toner itself is adsorbed by the adsorbent. The space where the adsorbing hole 374*c* is disposed communicates with the space sealed by the cap 370.

Here, when the container body 33 is completely sealed by the cap 370, since entering of air or moisture can be prevented, the adsorbent is not necessary, and as a result, a packaging material is not required. In this method, it is possible to reduce a packaging material such as a pouch, a cushioning material, or an individual packing box for packing the toner container 32 and to reduce the size of the package. Thus, it is possible to reduce an environmental load by reducing the materials uses.

However, the present inventors have found that toner itself which is powder generated gas to produce an aggregate which is a small lump of toner although the gas did not condense or solidify. Since such an aggregate can generate an abnormal image such as a white spot or spots of respective colors, it is necessary to suppress the occurrence of the aggregate. Although the container body 32 may be sealed without providing the adsorbent as illustrated in FIGS. 42, 43, and 44 unless toner itself does not generate gas, it is preferable that the toner container 32 that stores toner that generates gas by itself has an adsorbent that adsorbs gas.

Since the toner container 32 of Example 5 has the adsorbent 372, it is possible to prevent air or moisture from entering into the toner container 32. Moreover, since the adsorbent 372 is provided in the columnar portion 374 provided in the cap 370, the adsorbent 372 can be removed together with the cap 370 by detaching the cap 370 when using the toner container 32. Thus, the operability is improved.

Moreover, in the toner container 32 of Example 5, since the space (the inner space of the container body 33) that stores toner is completely sealed by the cap 370, it is possible to prevent air or moisture from entering into the toner storage space. Further, since the space where the adsorbing hole 374*c* is disposed communicates with the space that is sealed by the cap 370, it is possible to adsorb gas generated from the toner itself, and the adsorbing performance is improved as compared to the configuration of Example 4. Moreover, since the toner storage space (the inner space of the container body 33) is sealed and the adsorbent 372 is provided in this sealed space, the toner and the adsorbent 372 are not affected by the outside air around the toner container 32. Thus, a packaging material is not required.

In Example 5, the contact portion in which the adsorbent 372 disposed so as to adsorb a target substance in the space sealed by the cap 370 is provided is the columnar portion 374 that is formed integrally with the cap 370. However, the contact portion having such adsorbent 372 therein may be formed of a different member from the cap 370 similarly to the columnar member 373 of the toner container 32 illustrated in FIG. 42.

Moreover, in the toner container 32 according to the fourth embodiment illustrated in FIGS. 42 to 46, a screw method is employed as a method of attaching the cap 370 which is a sealing member. An optional method such as a screw method or a hook method may be used as a method of attaching the cap 370 to the toner container 32 is not particularly limited as long as the cap 370 can be attached.

The above-described embodiments are examples, and the following aspects of the present invention provide characteristic advantages.

Aspect A

A powder container (for example, the toner container 32), including: a container body (for example, the container body 33) that stores a powder (for example, toner) to be supplied to a powder conveying device (for example, the toner replenishing device 60); a nozzle insertion portion (for example, the nozzle receiver 330) having a nozzle insertion opening (for example, the nozzle insertion opening 331) through which a powder conveying nozzle (for example, the conveying nozzle 611) of the powder conveying device is inserted into the container body; and an elastic sheet member (for example, the elastic sheet member 300) formed of a sheet-shaped elastic body (for example, the elastic sheet 332), which blocks the nozzle insertion opening in a state where the powder conveying nozzle is not inserted, and is elastically deformed so that the powder conveying nozzle can pass through a blocked portion of the nozzle insertion opening when the powder conveying nozzle is inserted, wherein the elastic sheet member is formed using a plurality of sheet-shaped elastic bodies, and at least a part of the plurality of elastic bodies is arranged so as to overlap at least partly in at least a diametric direction of the nozzle insertion opening in an insertion direction of the powder conveying nozzle.

According to this aspect, as described in the above embodiments, such a gap that a powder can pass through is rarely provided as compared to a configuration that includes the conventional elastic sheet member in which the nozzle insertion opening is blocked by one sheet-shaped elastic body. Thus, it is possible to suppress leakage of powder better than a powder container including the conventional elastic sheet member.

Aspect B

In Aspect A, three sheet-shaped elastic bodies (for example, the elastic sheets 332) are used as the elastic sheet member (for example, the elastic sheet member 300).

According to this aspect, as described in the second embodiment, it is possible to improve the sealing property further than the configuration in which the elastic sheet member is made up of two sheet-shaped elastic bodies and to prevent the occurrence of toner leakage more reliably.

Aspect C

In Aspect B, the sheet-shaped elastic bodies (for example, the elastic sheets 332) have the same shape.

According to this aspect, as described in the second embodiment, since the sheet-shaped elastic bodies having the same shape are used, it is possible to further reduce the cost of the powder container.

Aspect D

In Aspect C, the sheet-shaped elastic body (for example, the elastic sheet 332) has a held portion (for example, the interposing portion 3321) that is held on the nozzle insertion portion (for example, the nozzle receiver 330) and an end portion (for example, the free end 432) that is not held, and an entire area of the end portion disposed to overlap another sheet-shaped elastic body to cover the entire nozzle insertion opening (for example, the nozzle insertion opening 331), and the three sheet-shaped elastic bodies are arranged so that an end portion (for example, the free ends 432*b* and 432*a*) of another sheet-shaped elastic body (the second and first elastic sheets 332*b* and 332*a*) is disposed at an angle of approximately 120° in a clockwise or counter-clockwise direction using the end portion (for example, the free end 432*j*) of one of the three sheet-shaped elastic bodies as a reference (for example, the third elastic sheet 332*j*).

According to this aspect, as described in the second embodiment, since three sheet-shaped elastic bodies can be arranged in a well-balanced manner, it is possible to further reduce toner scattering.

Aspect E

In Aspect C, the sheet-shaped elastic body (for example, the elastic sheet 332) has a held portion (for example, the interposing portion 3321) that is held on the nozzle insertion portion (for example, the nozzle receiver 330) and an end portion (for example, the free end 432) that is not held, and an entire area of the end portion disposed to overlap another sheet-shaped elastic body to cover the entire nozzle insertion opening (for example, the nozzle insertion opening 331), and the three sheet-shaped elastic bodies are arranged so that an end portion (for example, the free end 432*b*) of another sheet-shaped elastic body (for example, the second elastic sheet 332*b*) is disposed at an angle of approximately 180° in a clockwise or counterclockwise direction using an end portion (for example, the free end 432*j*) of one of the three sheet-shaped elastic bodies as a reference (for example, the third elastic sheet 332*j*), and an end portion (for example, the free end 432*a*) of still another sheet-shaped elastic body (for example, the first elastic sheet 332*a*) is disposed at an angle of approximately 90° in a clockwise or counter-clockwise direction.

According to this aspect, as described in the second embodiment, one sheet-shaped elastic body is rotated by 90° to provide strength (closing force) of the overlapping portion (for example, the overlapping portion 332*c*). Due to this, it is possible to further prevent the toner leakage from the container opening (for example, the container opening 33*a*) due to vibration during transportation.

Aspect F

In Aspect C, the sheet-shaped elastic body (for example, the elastic sheet 332) has a held portion (for example, the interposing portion 3321) that is held on the nozzle insertion portion (for example, the nozzle receiver 330) and an end portion (for example, the free end 432) that is not held, and an entire area of the end portion disposed to overlap another sheet-shaped elastic body to cover the entire nozzle insertion opening (for example, the nozzle insertion opening 331), and the three sheet-shaped elastic bodies are arranged so that an end portion (for example, the free end 432*b*) of another sheet-shaped elastic body (for example, the second elastic sheet 332*b*) is disposed at an angle of approximately 180° in a clockwise or counterclockwise direction using an end portion (for example, the free end 432*j*) of one of the three sheet-shaped elastic bodies as a reference (for example, the third elastic sheet 332*j*), and an end portion (for example, the free end 432*a*) of still another sheet-shaped elastic body (for example, the first elastic sheet 332*a*) is disposed to overlap the end portion (for example, the free end 432*j*) of the one sheet-shaped elastic body serving as a reference (for example, the third elastic sheet 332*j*).

According to this aspect, as described in the second embodiment, three sheet-shaped elastic bodies are sequentially superimposed to provide the strength (closing force) of the overlapping portion (for example, the sheet overlapping portion 332*c*). Due to this, it is possible to further prevent the toner leakage from the container opening (for example, the container opening 33*a*) due to vibration during transportation.

Aspect G

In Aspect B, the elastic sheet member (for example, the elastic sheet member 300) includes two sheet-shaped elastic bodies (for example, the second and third elastic sheets 332*b* and 332*j*) having the same shape and a sheet-shaped elastic body (for example, the first elastic sheet 332*a*) having a different shape from the two sheet-shaped elastic bodies, which are superimposed on each other.

According to this aspect, as described in the second embodiment, by using two sheet-shaped elastic bodies having the same shape and one sheet-shaped elastic body having a different shape from the two sheet-shaped elastic bodies, it is possible to further reduce toner scattering.

Aspect H

In Aspect G, the two sheet-shaped elastic bodies (for example, the second and third elastic sheets 332*b* and 332*j*) having the same shape have a held portion (for example, the interposing portion 3321) that is held on the nozzle insertion portion (for example, the nozzle receiver 330) and an end portion (for example, the free end 432) that is not held, and an entire area of the end portion disposed to overlap another sheet-shaped elastic body to cover the entire nozzle insertion opening (for example, the nozzle insertion opening 331), and the sheet-shaped elastic body (for example, the first elastic sheet 332*a*) having the different shape has a donut shape that covers a portion other than a central portion of the nozzle insertion opening.

According to this aspect, as described in the second embodiment, by using two sheet-shaped elastic bodies and a donut-shaped sheet-shaped elastic body, the strength (closing force) of the overlapping portion (for example, the overlapping portion 332*c*) of the two sheet-shaped elastic bodies is provided. Due to this, it is possible to further prevent the toner leakage from the container opening (for example, the container opening 33*a*) due to vibration during transportation.

Aspect I

In Aspect G, the two sheet-shaped elastic bodies (for example, the second and third elastic sheets 332*b* and 332*j*) having the same shape have a held portion (for example, the interposing portion 3321) that is held on the nozzle insertion portion (for example, the nozzle receiver 330) and an end portion (for example, the free end 432) that is not held, and an entire area of the end portion disposed to overlap another sheet-shaped elastic body to cover the entire nozzle insertion opening (for example, the nozzle insertion opening 331), and the sheet-shaped elastic body (for example, the first elastic sheet 332*a*) having the different shape has a shape that covers an entire area of the nozzle insertion opening and has a slit (for example, the first slit 332*f*) provided in a central portion.

According to this aspect, as described in the second embodiment, by using two sheet-shaped elastic bodies and the sheet-shaped elastic body having a slit, the strength (closing force) of the overlapping portion (for example, the overlapping portion 332*c*) of the two sheet-shaped elastic bodies is provided. Due to this, it is possible to further prevent the toner leakage from the container opening (for example, the container opening 33*a*) due to vibration during transportation.

Aspect J

In Aspect A, the elastic sheet member (for example, the elastic sheet 332) has a through-hole (for example, the first and second round through-holes 332*d* and 332*e*) that passes from one surface thereof to the other surface, and the plurality of elastic sheet members are arranged so that the positions of the respective through-holes do not overlap when the elastic sheet members are superimposed on the nozzle insertion opening (for example, the nozzle insertion opening 331).

According to this aspect, as described in Examples 2 and 3 of the first embodiment, since the through-holes are shifted from each other, it is possible to seal a through-hole provided in one of the plurality of sheet-shaped elastic bodies with the other sheet-shaped elastic bodies. Moreover, the plurality of sheet-shaped elastic bodies overlaps to seal the surrounding of the through-hole. Due to such a configuration, in a state where the powder conveying nozzle (for example, the conveying nozzle 611) is not inserted, it is possible to suppress powder (for example, toner) from leaking from the nozzle insertion opening due to vibration during transportation.

Aspect K

In Aspect J, a dimension of the through-hole (for example, the diameter of a round hole of the first and second round through-holes 332*d* and 332*e*) is smaller than a dimension of a cross-section orthogonal to the insertion direction of the powder conveying nozzle (for example, the diameter of the conveying nozzle 611).

According to this aspect, as described in Example 2 of the first embodiment, when the powder container is detached from the powder conveying device, the powder conveying nozzle is removed from the nozzle insertion opening (for example, the nozzle insertion opening 331) in a state where the sheet-shaped elastic body (for example, the elastic sheet 332) is in contact with the powder conveying nozzle. In this case, the powder conveying nozzle is removed from the nozzle insertion opening in such a manner that the contamination on the surface of the powder conveying nozzle is scraped off by the sheet-shaped elastic body. Since the dimension of the through-hole is smaller than the dimension of the powder conveying nozzle, the scraping-off effect is improved. Due to this, when the powder container is detached from the powder conveying device, it is possible to suppress powder (for example, toner) from leaking from the nozzle insertion opening.

Aspect L

In Aspect A, the elastic sheet member (for example, the elastic sheet 332) has a slit (for example, the first and second slits 332*f* and 332*g*) that passes from one surface thereof to the other surface, and the plurality of elastic sheet members are arranged so that the positions of the respective slits do not overlap when the elastic sheet members are superimposed on the nozzle insertion opening (for example, the nozzle insertion opening 331).

According to this aspect, as described in Example 3 of the first embodiment, by forming a slit, it is possible to decrease an opening area as compared to the configuration where a round hole is provided and to suppress toner leakage.

Aspect M

In Aspect L, the slit (for example, the first and second slits 332*f* and 332*g*) has a small-diameter round hole provided at both ends thereof.

According to this aspect, as described in Example 3 of the first embodiment, since a small round hole is provided at both ends of the slit, it is possible to suppress tearing of the sheet-shaped elastic body (for example, the elastic sheet 332).

Aspect N

In Aspect A, the plurality of sheet-shaped elastic bodies (for example, the elastic sheets 332) has a held portion (for example, the interposing portion 3321) that is held on the nozzle insertion portion (for example, the nozzle insertion opening 331) and an end portion (for example, the free end 432) that is not held, and an entire area of the end portion disposed to overlap another sheet-shaped elastic body to cover the entire nozzle insertion opening.

According to this aspect, as described in the embodiments, it is possible to realize a configuration in which leakage of a powder (for example, toner) resulting from vibration or dropping during transportation of the powder container (for example, the toner container 32) can be suppressed.

Aspect O

In Aspect N, a semi-circular notch (for example, the notch 332*h*) is provided in an end portion (for example, the free end 432).

According to this aspect, as described in Example 4 of the first embodiment, when the front end of the powder conveying nozzle (for example, the sheet member guide 611*a*) comes in contact with the sheet-shaped elastic body (for example, the elastic sheet 332) and is inserted in the powder container (for example, the toner container 32), it is possible to allow the powder conveying nozzle to follow along the notch. In this way, the powder conveying nozzle can be smoothly inserted along the notch.

Aspect P

In any one of Aspects A to O, the powder container (for example, the toner container 32) is attached to the powder conveying device (for example, the toner replenishing device 60) with a longitudinal direction extending in a horizontal direction and the powder conveying nozzle (for example, the conveying nozzle 611) is inserted along the longitudinal direction, the powder container further includes a powder conveyor (for example, the spiral projection 302) that is disposed inside the container body (for example, the container body 33) so as to convey a powder (for example, toner) from one end side in the longitudinal direction to the other end side, and the nozzle insertion portion (for example, the nozzle receiver 330) is disposed on the other end side.

According to this aspect, as described in the embodiments, it is possible to convey a powder in the container body toward the nozzle insertion portion and to suppress powder from leaking from the nozzle insertion portion using the elastic sheet member (for example, the elastic sheet member 300).

Aspect Q

In Aspect P, the container body (for example, the container body 33) includes a container opening (for example, the container opening 33*a*) on the other end side, and the nozzle insertion portion (for example, the nozzle receiver 330) is disposed in the container opening.

According to this aspect, as described in the embodiments, it is possible to convey a powder in the container body toward the container opening and to suppress a powder from leaking from the container opening using the elastic sheet member (for example, the elastic sheet member 300).

Aspect R

In Aspect P or Q, the container body (for example, the container body 33) has a container gear (for example, the container gear 301) that can transmit driving power to the powder conveyor (for example, the spiral projection 302) on the other end side, and the elastic sheet member (for example, the elastic sheet member 300) is disposed within a range of a gear width of the container gear in the longitudinal direction.

According to this aspect, as described in the second embodiment, such an action that tilts the powder container (for example, the toner container 32) during power transmission does not occur, and problems such as an increase in the output driving power and generation of noise resulting from the tilt of the powder container can be prevented.

Aspect S

In any one of Aspects P to R, the powder container includes a scooping portion (for example, the scooping portion 304) that receives powder (for example, toner) from the powder conveyor (for example, the spiral projection 302), rotates to scoop the powder from a lower side to an upper side in the container body (for example, the container body 33), and moves the powder to a powder inlet (for example, the nozzle opening 610) of the powder conveying nozzle (for example, the conveying nozzle 611).

According to this aspect, as described in the embodiments, such a gap that a powder can pass through is rarely provided as compared to the conventional elastic sheet member in which the nozzle insertion opening is blocked by one sheet-shaped elastic body. Thus, it is possible to suppress leakage of a powder better than the printer controller including the conventional elastic sheet member.

Aspect T

In Aspect S, the nozzle insertion portion (for example, the nozzle receiver 330) includes: an extension portion (for example, the extension portion 335*a*) provided so as to extend from a nozzle insertion opening (for example, the nozzle insertion opening 331) side of the nozzle insertion portion toward an inner side of the container body (for example, the container body 33); and a void region (for example, the extension-portion opening 335*b*) adjacent to the extension portion, wherein the nozzle insertion portion rotates whereby the extension portion and the void region alternately cross the powder inlet (for example, the nozzle opening 610).

According to this aspect, as described in the embodiments, it is possible to realize a configuration in which a powder (for example, toner) pumped by the scooping portion (for example, the scooping portion 304) is supplied to the powder inlet.

Aspect U

An image forming apparatus (for example, the copying machine 500) including: an image forming unit (for example, the printer unit 100) that forms an image on an image carrier (for example, the photoreceptor 41) using an image forming powder (for example, toner); a powder conveyor (for example, the toner replenishing device 60) that conveys the powder to the image forming unit; and a powder container that is detachably held in the powder conveyor, wherein the powder container (for example, the toner container 32) according to any one of Aspects A to T is used as the powder container.

According to this aspect, as described in the embodiments, it is possible to suppress the occurrence of contamination inside the device and contamination outside the device when the powder container is replaced.

Aspect A2

A powder container (for example, the toner container 32) including: a container body (for example, the container body 33) that stores a powder (for example, toner) to be supplied to a powder conveying device (for example, the toner replenishing device 60); a nozzle insertion portion (for example, the nozzle receiver 330) having a nozzle insertion opening (for example, the nozzle insertion opening 331) through which a powder conveying nozzle (for example, the conveying nozzle 611) of the powder conveying device is inserted into the container body; an opening blocking member (for example, the elastic sheet 332) that blocks the nozzle insertion opening in a state where the powder conveying nozzle is not inserted and is elastically deformed to allow the powder conveying nozzle to pass when the powder conveying nozzle is inserted; and a sealing member (for example, the cap 370) that is attached to the container body in which the powder conveying nozzle is inserted to seal the nozzle insertion opening and is detached from the container body when the powder conveying nozzle is inserted, wherein the sealing member includes a contact portion (for example, the columnar member 373) that comes in contact with the opening blocking member in a state of being attached to the container body.

According to this aspect, since the contact portion is in contact with the opening blocking member, even when vibration or impact is transmitted to the opening blocking member, it is possible to suppress elastic deformation resulting from the vibration or impact. By suppressing elastic deformation, it is possible to suppress a gap from being provided in a portion of the nozzle insertion opening blocked by the opening blocking member resulting from vibration or impact. Thus, it is possible to suppress a powder in the container body from reaching a space between the sealing member and the opening blocking member in a state where the sealing member is attached. Due to this, it is possible to suppress the leakage of powder when the sealing member is detached from the powder container.

Therefore, it is possible to suppress the leakage of a powder when the sealing member is detached from the powder container.

Aspect B2

In Aspect A2, the contact portion (for example, the columnar member 373) is formed of a different member from the sealing member (for example, the cap 370) and is attached to the sealing member.

According to this aspect, as described in the embodiments, since the sealing member is formed of an inexpensive material different from the contact portion while using a material that enhances adhesion to the contact portion, it is possible to reduce the cost while maintaining the powder leakage preventing function of the contact portion.

Aspect C2

In Aspect A2, the contact portion (for example, the columnar portion 374) is formed integrally with the sealing member (for example, the cap 370).

According to this aspect, as described in Example 2 of the first embodiment, since the contact portion can be formed (molded) integrally with a portion of the sealing member, it is possible to reduce the cost.

Aspect D2

In any one of Aspects A2 to C2, a portion of the contact portion (for example, the columnar portion 374) making contact with the opening blocking member (for example, the elastic sheet 332) is formed of an elastic body (for example, the front end columnar elastic member 375).

According to this aspect, as described in Example 3 of the first embodiment, the adhesion to the opening blocking member when the elastic body makes contact with the opening blocking member is improved further as compared to the configuration where the elastic body is not provided. Thus, it is possible to prevent the toner leakage resulting from impact due to vibration or dropping more effectively.

Aspect E2

In any one of Aspects A2 to D2, the sealing member (for example, the cap 370) has an adsorbent (for example, the adsorbent 372) provided to be open to the outside.

According to this aspect, as described in Example 4 of the first embodiment, it is possible to prevent air or moisture from entering into the powder container (for example, the toner container 32). Moreover, since the sealing member has the adsorbent, the adsorbent can be removed from the powder container together with the sealing member by detaching the sealing member when using the powder container, and the operability is improved.

Aspect F2

In any one of Aspects A2 to D2, the sealing member (for example, the cap 370) has an adsorbent (for example, the adsorbent 372) provided to be sealed from the outside.

According to this aspect, as described in the second embodiment, it is possible to prevent air or moisture from entering into the powder container (for example, the toner container 32). Moreover, since the sealing member has the adsorbent, the adsorbent can be removed from the powder container together with the sealing member by detaching the sealing member when using the powder container, and the operability is improved. Further, since it is possible to adsorb gas generated by the powder itself, the adsorbing performance is improved as compared to the configuration of Aspect E2. Moreover, since the powder storage space is sealed and the adsorbent is provided in this sealed space, the powder and the adsorbent are not affected by the outside air around the powder container. Thus, a packaging material is not required.

Aspect G2

In any one of Aspects A2 to F2, the opening blocking member (for example, the elastic sheet 332) is made up of a plurality of sheet-shaped elastic sheet members attached to the nozzle insertion portion (for example, the nozzle receiver 330), and the plurality of elastic sheet members overlaps in a portion through which the powder conveying nozzle (for example, the conveying nozzle 611) passes in a state where the nozzle insertion opening (for example, the nozzle insertion opening 331) is blocked.

According to this aspect, as described in the embodiments, it is possible to allow the contact portion (for example, the columnar member 373) to make contact with the opening blocking member so as to slightly enter therein. As a result, tension is applied to the opening blocking member, and adhesion (air-tightness) of the plurality of elastic sheet members (for example, the elastic sheets 332) in the overlapping portion is improved. Thus, it is possible to prevent toner leakage more effectively, and satisfactory characteristics against vibration and impact are obtained.

Aspect H2

In any one of Aspects A2 to G2, the container body is formed of a container body (for example, the container body 33) that rotates to convey a powder (for example, toner) stored therein from one end side (for example, the container rear end side) in a rotation axis direction to the other end side (for example, the container front end side) on which an opening (for example, the container opening 33*a*) is provided, the nozzle insertion portion (for example, the nozzle receiver 330) is provided in the opening, an end surface on the other end side of the container body protrudes in the rotation axis direction further than the end surface on the other end side of the nozzle insertion portion on which the nozzle insertion opening (for example, the nozzle insertion opening 331) is open, and the contact portion (for example, the columnar member 373) is a columnar portion that extends from a body portion of the sealing member located closer to the other end side than the end surface on the other end side of the container body to a position where the columnar portion makes contact with the opening blocking member (for example, the elastic sheet 332) in a state where the sealing member (for example, the cap 370) is attached to the container body.

According to this aspect, as described in the embodiments, the end surface on the other end side of the container body against which the body of the sealing member bumps protrudes in the rotation axis direction further than the end surface on the other end side on which the nozzle insertion opening of the nozzle insertion portion is open. In such a configuration, although there is a certain distance between the body of the sealing member and the opening blocking member, since the contact portion is a columnar portion that extends by this distance, it is possible to allow the contact portion to make contact with the opening blocking member. Therefore, it is possible to suppress leakage of a powder when the sealing member is detached from the powder container.

Aspect I2

An image forming apparatus (for example, the copying machine 500) including: a toner image forming means (for example, the printer unit 100) that forms a toner image using toner which is powder; and a toner conveying device (for example, the toner replenishing device 60) that conveys the toner from a toner container which is a container body (for example, the toner container 32) to the toner image forming means, wherein the powder container according to any one of Aspects A2 to H2 is used as the powder container.

According to this aspect, as described in the embodiments, it is possible to suppress the occurrence of contamination inside the device and contamination outside the device when the powder container is replaced.

The present embodiment includes inventions according to the following aspects.

Aspect J2

A powder container including: a container body that is attached to a powder conveying device with a longitudinal direction extending in a horizontal direction so as to store image forming powder to be supplied to the powder conveying device; a powder conveyor disposed inside the container body so as to convey the powder from one end side in the longitudinal direction to the other end side where a container opening is provided; a nozzle insertion portion that is disposed in the container opening and that has a nozzle insertion opening through which a powder conveying nozzle of the powder conveying device is inserted in the container body; and a scooping portion that receives the powder from the powder conveyor, rotates to scoop the powder from a lower side of the container body to an upper side, and moves the powder to a powder inlet of the powder conveying nozzle, wherein the nozzle insertion portion includes: an opening blocking member that blocks the nozzle insertion opening in a state where the powder conveying nozzle is not inserted and is deformed to allow the powder conveying nozzle to pass when the powder conveying nozzle is inserted; an extension portion provided so as to extend from a nozzle insertion opening side of the nozzle insertion portion toward an inner side of the container body; and a void region adjacent to the extension portion, and the nozzle insertion portion rotates whereby the extension portion and the void region alternately cross the powder inlet.

In the invention according to Aspect J2, in a state where toner is sufficient in the container body 33 as the container body, for example, immediately after the toner container 32 as the powder container is attached to the toner replenishing device 60 as the powder conveying device, an overflowably large amount of toner is continuously supplied to the nozzle opening 610 as the powder inlet of the conveying nozzle 611 as the powder conveying nozzle. Thus, the extension portion 335*a* is rotated to cross above the nozzle opening 610 to drop the overflowing toner, and the conveying screw 614 in the conveying nozzle 611 is controlled to rotate intermittently. In this way, it is possible to replenish a desired amount of toner to the developing device 50.

Aspect K2

In the powder container according to Aspect J2, at least an outer circumferential surface of the extension portion is a relaying portion that moves powder from the scooping portion to the powder inlet.

In the invention according to Aspect K2, even when the amount of toner in the container body 33 as the container body decreases, the replenishing speed is stable and the amount of toner remaining in the container body 33 during replacement of the toner container 32 as the powder container can be reduced. Moreover, since the amount of toner remaining in the container body 33 during replacement can be reduced, it is possible to reduce a running cost, improve cost performance, and reduce the amount of wasted toner to reduce an adverse effect on environment.

Aspect L2

In the powder container according to Aspect K2, the scooping portion and the relaying portion rotate in the same direction, and are disposed to be adjacent to each other so that an end in the circumferential direction of the extension portion and a convex portion of the scooping portion bulging toward the inner side of the container body appear in that order from a downstream side to an upstream side in the rotation direction.

The invention according to Aspect L2 is a specific layout that enables the extension portion 335*a* to function as the relaying portion.

Aspect M2

In the powder container according to Aspect J2, the container body has a longitudinal direction extending in a rotation axis when conveying a powder and is held in the powder conveying device so as to be rotatable in relation to the powder conveying nozzle, the nozzle insertion portion is attached to the container body, and the scooping portion includes a convex portion in which an inner wall surface of the container body bulges toward the inner side of the container body and a bulging inner wall surface that is connected from the convex portion to an inner circumferential surface of the container body.

The invention according to Aspect M2 relates to a specific shape of the scooping portion.

Aspect N2

In the powder container according to Aspect. J2 or K2, the container body has a longitudinal direction extending in a rotation axis when conveying powder and is held in the powder conveying device so as to be rotatable in relation to the powder conveying nozzle, the nozzle insertion portion is attached to the container body, the scooping portion includes a convex portion in which an inner wall surface of the container body bulges toward the inner side of the container body and a bulging inner wall surface that is connected from the convex portion to an inner circumferential surface of the container body, and the convex portion and the relaying portion are in close contact or face each other with a small gap.

The invention according to Aspect N2 can contribute to improving mass productivity by taking the dimensional accuracy upon manufacturing into consideration.

According to an embodiment, a plurality of elastic sheet members are arranged so as to overlap at least partially. Even when a gap through which powder can pass is provided in one elastic sheet member, it is possible to prevent powder from leaking if another elastic sheet member blocks a passage of the powder. Thus, it is possible to suppress leakage of powder better than a powder container having the conventional elastic sheet member in which a slit is provided in one elastic sheet member.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

REFERENCE SIGNS LIST

26: Sheet feeding tray
27: Sheet feeding roller
28: Registration roller pair
29: Sheet discharging roller pair
30: Stacking portion
32: Toner container
33: Container body
33*a*: Container opening
34: Container front end cover
34*a*: Gear exposing opening
34*b*: Color identifying rib
41: Photoreceptor
42*a*: Cleaning blade
42: Photoreceptor cleaning device
44: Charging roller
46: Image forming unit
47: Exposure device
48: Intermediate transfer belt
49: Primary transfer bias roller
50: Developing device
51: Developing roller
52: Doctor blade
53: First developer accommodating portion
54: Second developer accommodating portion
55: Developer conveying screw
56: Toner density detection sensor
60: Toner replenishing device
64: Falling path defining portion
70: Toner container receiving portion
71: Insertion opening defining portion
72: Container receiving portion
73: Cap portion
82: Secondary transfer backup roller
85: Intermediate transfer unit
86: Fixing device
89: Secondary transfer roller
90: Controller
91: Container rotation driving unit
100: Printer unit
200: Sheet feeding unit
301: Container gear
302: Spiral projection

303: Knob
304: Scooping portion
304*a*: Scooping spiral projection
304*f*: Scooping wall surface
304*h*: Convex portion
305: Front end opening
306: Cover hook stopper
330: Nozzle receiver
331: Nozzle insertion opening
332: Elastic sheet (opening blocking member)
332*a*: First elastic sheet
332*b*: Second elastic sheet
332*c*: Sheet overlapping portion
332*d*: First round through-hole
332*e*: Second round through-hole
332*f*: First slit
332*g*: Second slit
332*h*: Notch
332*j*: Third elastic sheet
332*k*: Third round through-hole
332*p*: Nozzle contact position
333: Container seal
335: Sheet stopper
335*a*: Extension portion
335*b*: Extension-portion opening
335*c*: Extension-portion downstream end surface
336: Container seal attached wall
337: Attaching portion of nozzle receiver
337*a*: Nozzle shutter bumping rib
339: Container engaged portion
339*a*: Guide projection
339*b*: Guide groove
339*c*: Step portion
339*d*: Engaged opening
341: Cover claw portion
361: Slide guide
361*a*: Slide groove
370: Cap
371: Cap flange portion
400: Scanner unit
372: Adsorbent
373: Columnar member
373*a*: Front-end-side columnar portion
373*b*: Base-end-side columnar portion
374: Columnar portion
374*a*: Front-end-side columnar portion
374*b*: Base-end-side columnar portion
374*c*: Adsorbing hole
375: Front end columnar elastic member
432: Free end
500: Copying machine
601: Container driving output gear
602: Frame
603: Driving motor
603*a*: Worm gear
604: Power transmission gear
605: Conveying screw gear
607: Nozzle holder
608: Set cover
609: Replenishing device-side locking member
610: Nozzle opening
611: Conveying nozzle
611*a*: Sheet member guide (Nozzle front end)
611*b*: Nozzle-front-end-side inner wall surface
611*s*: Nozzle-opening transversal edge
612: Nozzle shutter
612*a*: Nozzle shutter flange portion
612*b*: First shutter inner circumference rib
612*c*: Second shutter inner circumference rib
612*d*: Third shutter inner circumference rib
612*e*: Nozzle shutter cylinder portion
612*f*: Nozzle shutter spring receiving surface
612*g*: First inner-circumference-rib front end
612*h*: Nozzle shutter sealing member
612*j*: Nozzle shutter seal receiving portion
613: Nozzle shutter spring
614: Conveying screw
615*a*: Container-setting-portion inner circumferential surface
615*b*: Container-setting-portion end surface
615: Container setting portion
640: Oscillating spring
700: IC tag
800: Connector
G: Developer
L: Laser beam
P: Recording medium
T: Toner

The invention claimed is:

1. A powder container comprising:

a container body to store powder to be supplied to a powder conveying device;

a nozzle receiver including a nozzle insertion opening through which a powder conveying nozzle of the powder conveying device is inserted into the container body; and an elastic cover including a plurality of sheet-shaped elastic bodies, each of the plurality of sheet-shaped elastic bodies extending along a substantially same plane which is perpendicular to an insertion direction of the powder conveying nozzle, wherein:

the elastic cover blocks the nozzle insertion opening in a state where the powder conveying nozzle is not inserted, and is elastically deformed when the powder conveying nozzle passes through a blocked portion of the nozzle insertion opening, and at least a part of the plurality of elastic bodies is disposed so as to overlap relative to the insertion direction of the powder conveying nozzle, wherein each of the sheet-shaped elastic bodies has a held portion that is held on the nozzle receiver and an end portion that is not held such that an entire area of the end portion is covered by the elastic cover when there is no powder conveying nozzle passing through the elastic cover.

2. The powder container according to claim 1, wherein:

the elastic cover includes three sheet-shaped elastic bodies, the three sheet-shaped elastic bodies have a same shape, and the three sheet-shaped elastic bodies are arranged so that an end portion of one sheet-shaped elastic body is disposed at an angle of approximately 120° in a clockwise or counter-clockwise direction relative to an end portion of another sheet-shaped elastic body as a reference.

3. The powder container according to claim 1, wherein:

the elastic cover includes three sheet-shaped elastic bodies, the three sheet-shaped elastic bodies have a same shape, and the three sheet-shaped elastic bodies are arranged so that an end portion of one sheet-shaped elastic body is disposed at an angle of approximately 180° in a clockwise or counterclockwise direction relative to an end portion of an other sheet-shaped elastic bodies as a reference, and an end portion of the other sheet-shaped elastic body is disposed at an angle of approximately 90° in a clockwise or counter-clockwise direction relative to the reference.

4. The powder container according to claim 1, wherein:

the elastic cover includes three sheet-shaped elastic bodies, the three sheet-shaped elastic bodies have a same shape, and the three sheet-shaped elastic bodies are arranged so that an end portion of one sheet-shaped elastic body is disposed at an angle of approximately 180° in a clockwise or counterclockwise direction relative to an end portion of an other sheet-shaped elastic body as a reference, and an end portion of the one sheet-shaped elastic body is disposed to overlap the end portion of the other sheet-shaped elastic body serving as the reference.

5. The powder container according to claim 1, wherein:

the elastic cover includes three sheet-shaped elastic bodies, and the elastic cover includes two sheet-shaped elastic bodies having a same shape and a sheet-shaped elastic body having a different shape from the two sheet-shaped elastic bodies, which are superimposed on each other.

6. The powder container according to claim 5, wherein:

the sheet-shaped elastic body having the different shape has a donut shape that covers a portion other than a central portion of the nozzle insertion opening.

7. The powder container according to claim 5, wherein the sheet-shaped elastic body having the different shape has a shape that covers an entire area of the nozzle insertion opening and has a slit provided in a central portion.

8. The powder container according to claim 7, wherein each of the sheet-shaped elastic bodies has a semi-circular notch in an end portion thereof that covers the nozzle insertion opening.

9. The powder container according to claim 1, wherein each of the sheet-shaped elastic bodies has a through-hole as the end portion that passes from one surface thereof to the other surface, and the sheet-shaped elastic bodies are disposed so that the positions of the respective through-holes do not overlap in a state where the sheet-shaped elastic bodies are superimposed on the nozzle insertion opening.

10. The powder container according to claim 9, wherein a dimension of the through-hole is smaller than a dimension of a cross-section orthogonal to the insertion direction of the powder conveying nozzle.

11. The powder container according to claim 1, the powder container is attached to the powder conveying device with a longitudinal direction set as a horizontal direction and the powder conveying nozzle is inserted along the longitudinal direction, the powder container further comprising:

a powder conveyor disposed inside the container body so as to convey a powder from one end side in the longitudinal direction to the other end side, wherein:

the nozzle receiver is disposed on the other end side, the container body includes a container opening on the other end side, and the nozzle receiver is disposed in the container opening.

12. The powder container according to claim 11, wherein the container body has a container gear that can transmit driving power to the powder conveyor on the other end side, and the elastic cover is disposed within a plane which is within a gear width of the container gear in the longitudinal direction.

13. The powder container according to claim 11, further comprising:

a scooping portion to scoop up the powder from a lower side to an upper side by rotation, and moves the powder in the container body to a powder inlet of the powder conveying nozzle.

14. The powder container according to claim 13, wherein the nozzle receiver includes:

an extension portion provided so as to extend from a nozzle insertion opening side of the nozzle receiver toward an inner side of the container body; and a void region adjacent to the extension portion, wherein the nozzle receiver rotates so that the extension portion and the void region alternately cross the powder inlet.

15. An image forming apparatus comprising:

an image forming unit that forms an image on an image carrier using an image forming powder;

a powder replenishing device that conveys the powder to the image forming unit; and the powder container according to claim 1 is used as the powder container, the powder container being detachably held in the powder replenishing device.

16. The powder container according to claim 1, further comprising:

a cap to cover the nozzle insertion opening at outer side of the powder container, the cap being attached to the powder container when not in use, wherein the cap includes a contact portion that makes contact with the elastic cover in a state where the elastic cover is attached to a container opening.

17. The powder container according to claim 16, wherein:

the contact portion is to apply a tension to an overlapping portion where the end portion of the sheet-shaped elastic bodies overlap each other, when the cap is attached to the powder container.

18. The powder container according to claim 1, wherein the powder container stores toner as the powder.

* * * * *